US006787298B2

(12) United States Patent
Goto et al.

(10) Patent No.: US 6,787,298 B2
(45) Date of Patent: Sep. 7, 2004

(54) PHOTOTHERMOGRAPHIC MATERIAL

(75) Inventors: Takahiro Goto, Minami-ashigara (JP); Kohzaburoh Yamada, Minami-ashigara (JP); Tomoyuki Ohzeki, Minami-ashigara (JP); Eiichi Okutsu, Minami-ashigara (JP); Shoji Yasuda, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 27 days.

(21) Appl. No.: 10/262,955

(22) Filed: Oct. 3, 2002

(65) Prior Publication Data

US 2003/0194638 A1 Oct. 16, 2003

(30) Foreign Application Priority Data

Oct. 3, 2001 (JP) ..... 2001-307828
Apr. 2, 2002 (JP) ..... 2002-100160

(51) Int. Cl.[7] ..... G03C 1/00
(52) U.S. Cl. ..... 430/619; 430/200; 430/264; 430/566; 430/600; 430/603; 430/955

(58) Field of Search ..... 430/619, 600, 430/603, 264, 955, 200, 566

(56) References Cited

U.S. PATENT DOCUMENTS 5,843,632 A 12/1998 Eshelman et al.
6,203,972 B1 * 3/2001 Katoh et al. ..... 430/619
2003/0207221 A1 * 11/2003 Yamada et al. ..... 430/600

FOREIGN PATENT DOCUMENTS

EP 1111448 A1 6/2001
EP 1136875 A2 9/2001

* cited by examiner

*Primary Examiner*—Thorl Chea
(74) *Attorney, Agent, or Firm*—Birch, Stewart, Kolasch & Birch, LLP

(57) ABSTRACT

Disclosed is a highly sensitive photothermographic material containing on a support a silver salt of an organic acid, a photosensitive silver halide, a reducing agent, a binder and, for example, a compound of which one-electron oxidized derivative produced by one electron oxidation of the compound is capable of releasing two or more electrons with a bond cleavage.

24 Claims, 1 Drawing Sheet

PHOTOTHERMOGRAPHIC MATERIAL

TECHNICAL FIELD

The present invention relates to a photothermographic material, in particular, a photothermographic material that realizes higher sensitivity. More precisely, the present invention relates to a photothermographic material useful for use in image setters suitable for photomechanical processes, medical diagnosis and so forth.

RELATED ART

In recent years, reduction of amount of waste processing solutions is strongly desired in the fields of films for medical diagnosis, photomechanical processes and so forth from the standpoints of environmental protection and space savings. Therefore, photothermographic materials are noted as films for medical diagnosis and photomechanical processes that can be efficiently exposed by using a laser image setter or laser imager and can form clear black images with high resolution and sharpness. Such photothermographic materials can provide a simpler and non-polluting heat development processing system that does not require use of solution-type processing chemicals. Photothermographic materials contain a silver salt of an organic acid, photosensitive silver halide grains, reducing agent and binder on a support, and described in, for example, U.S. Pat. Nos. 3,152,904, 3,457,075 and D. Klosterboer, Imaging Processes and Materials, "Thermally Processed Silver Systems", 8th ed., Chapter 9, page 279, compiled by J. Sturge, V. Walworth and A. Shepp, Neblette (1989).

However, since the photosensitive silver halide contained in photothermographic materials is not fixed and remains in films even after image formation, grain size and amount thereof are limited in order to prevent degradation of printed out conditions. That is, the grain size and amount of photosensitive silver halide are designed so as to be as small as possible. Therefore, photothermographic materials have a problem of lower sensitivity compared with photosensitive materials for wet processing.

For use in photomechanical processes for printing, a substantially colorless photosensitive material (in particular, colorless for the UV region) that can provide high contrast photographic characteristic is required. As for methods of obtaining high contrast photographic characteristic, European Patent Publication EP762,196A, Japanese Patent Laid-open Publication (Kokai, henceforth referred to as JP-A) No. 9-90550 and so forth disclose that high-contrast photographic characteristic can be obtained by incorporating Group VII or VIII metal ions or metal complex ions thereof into photosensitive silver halide grains for use in photothermographic materials, or incorporating a hydrazine derivative into the photothermographic materials. Further, as for a photosensitive material for which exposure with an infrared ray is intended, techniques concerning infrared sensitive photothermographic silver halide photographic materials have been developed, which can markedly reduce absorption in the visible region of sensitizing dyes and antihalation dyes and hence enable easy production of a substantially colorless photosensitive material. Spectral sensitization techniques are disclosed in Japanese Patent Publication (Kokoku, hereinafter referred to as JP-B) No. 3-10391, JP-B-6-52387, JP-A-5-341432, JP-A-6-194781, JP-A-6-301141 and so forth, and antihalation techniques are disclosed in JP-A-7-13295, U.S. Pat. No. 5,380,635 and so forth.

Dyes providing spectral sensitization by infrared absorption generally show high HOMO and hence strong reducing ability, and thus they are likely to reduce silver ions in photosensitive materials to degrade fog of the photosensitive materials. In particular, during storage under high temperature and high humidity or storage for a long period of time, marked change of performance may be observed. Moreover, if a dye showing low HOMO is used in order to prevent the degradation of storability, there is caused a problem that LUMO also correspondingly becomes lower, spectral sensitization efficiency is reduced and hence sensitivity is lowered.

In the fields of newspaper printing and facsimile utilizing photomechanical processes, higher processing speed is preferred for photomechanical processing systems, and therefore a technique of providing a photothermographic material of high sensitivity has been desired. Considering these problems of the prior art, an object of the present invention is to provide a photothermographic material of high sensitivity. Another object of the present invention is to provide a photothermographic material useful for medical use, which exhibits high sensitivity and provides gradation suitable for diagnosis.

SUMMARY OF THE INVENTION

As a result of assiduous studies of the inventors of the present invention, it was found that high sensitivity could be realized by a photothermographic material containing a particular compound, and they accomplished the present invention.

That is, the present invention provides a photothermographic material containing a silver salt of an organic acid, a photosensitive silver halide, a reducing agent and a binder on a support, which contains at least one compound selected from compounds of the following Types (i) to (iv).

Type (i)

A compound of which one-electron oxidized derivative produced by one electron oxidation of the compound is capable of releasing two or more electrons with a bond cleavage.

Type (ii)

A compound of which one-electron oxidized derivative produced by one electron oxidation of the compound is capable of releasing one more electron with a bond cleavage and which has two or more groups adsorptive to silver halide in the molecule.

Type (iii)

A compound of which one-electron oxidized derivative produced by one electron oxidation of the compound is capable of releasing one or more electrons after undergoing a bond formation process.

Type (iv)

A compound of which one-electron oxidized derivative produced by one electron oxidation of the compound is capable of releasing one or more electrons after undergoing an intramolecular ring cleavage reaction.

In the present invention, the compounds of Types (i) to (iv) are preferably compounds represented by the following formulas (1-1) to (4-2).

Formula (1-1)

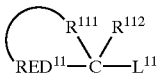

In the formula (1-1), $RED^{11}$ represents a reducing group that can be one electron-oxidized, and $L^{11}$ represents a leaving group. $R^{112}$ represents a hydrogen atom or a substituent. $R^{111}$ represents a nonmetallic group that can form a tetrahydro, hexahydro or octahydro derivative of a 5- or 6-membered aromatic ring (including an aromatic heterocyclic ring) together with the carbon atom to which $R^{111}$ bonds and $RED^{11}$.

Formula (1-2)

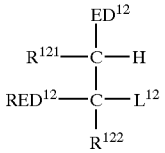

In the formula (1-2), $RED^{12}$ represents a reducing group that can be one electron-oxidized, and $L^{12}$ represents a leaving group. $R^{121}$ and $R^{122}$ each independently represent a hydrogen atom or a substituent. $ED^{12}$ represents an electron donor group. In the formula (1-2), $R^{121}$ and $RED^{12}$, $R^{121}$ and $R^{122}$ or $ED^{12}$ and $RED^{12}$ may bond to each other to form a ring structure.

Formula (1-3)

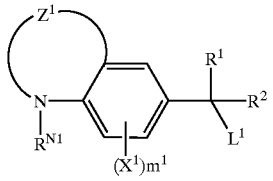

In the formula (1-3), $Z^1$ represents an atomic group that can form a 6-membered ring together with the nitrogen atom to which $Z^1$ bonds and two of carbon atoms of the benzene ring, $R^1$, $R^2$ and $R^{N1}$ each independently represent a hydrogen atom or a substituent, $X^1$ represents a substituent that can substitute on the benzene ring, $m^1$ represents an integer of 0–3, and $L^1$ represents a leaving group. A compound of the formula (1-3) can, after it is one electron-oxidized, further release two or more electrons due to spontaneous cleavage of the C (carbon atom)-$L^1$ bond.

Formula (1-4)

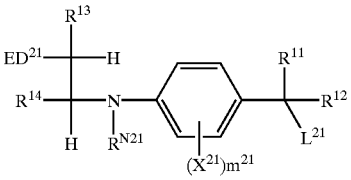

In the formula (1-4), $ED^{21}$ represents an electron donor group, $R^{11}$, $R^{12}$, $R^{N21}$, $R^{13}$ and $R^{14}$ each independently represents a hydrogen atom or a substituent, $X^{21}$ represents a substituent that can substitute on the benzene ring, $m^{21}$ represents an integer of 0–3, and $L^{21}$ represents a leaving group. $R^{N21}$, $R^{13}$, $R^{14}$, $X^{21}$ and $ED^{21}$ may bond to each other to form a ring structure. A compound of the formula (1-4) can, after it is one electron-oxidized, further release two or more electrons due to spontaneous cleavage of the C (carbon atom)-$L^{21}$ bond.

Formula (1-5)

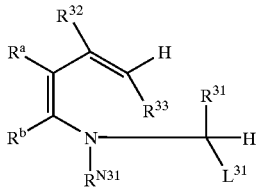

In the formula (1-5), $R^{32}$, $R^{33}$, $R^{31}$, $R^{N31}$, $R^a$ and $R^b$ each independently represents a hydrogen atom or a substituent, and $L^{31}$ represents a leaving group. However, when $R^{N31}$ represents a group other than an aryl group, $R^a$ and $R^b$ bond to each other to form an aromatic ring. A compound of the formula (1-5) can, after it is one electron-oxidized, further release two or more electrons due to spontaneous cleavage of the C (carbon atom)-$L^{31}$ bond.

Formula (2-1)

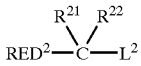

In the formula (2-1), $RED^2$ represents a reducing group that can be one electron-oxidized, and $L^2$ represents a leaving group. When $L^2$ represents a silyl group, the compound has two or more of nitrogen-containing heterocyclic groups substituted with a mercapto group as absorptive groups. $R^{21}$ and $R^{22}$ each independently represent a hydrogen atom or a substituent. $RED^2$ and $R^{21}$ may bond to each other to form a ring structure.

A compound of the formula (2-1) is a compound that can, after the reducing group represented by $RED^2$ is one electron-oxidized, further release one more electron due to spontaneous cleavage of the C (carbon atom)-$L^2$ bond.

Formula (3-1)

$$RED^3—L^3—Y^3$$

In the formula (3-1), $RED^3$ represents a reducing group that can be one electron-oxidized, $Y^3$ represents a reactive group moiety that reacts after $RED^3$ is one electron-oxidized, and $L^3$ represents a bridging group bonding $RED^3$ and $Y^3$.

Formula (4-1)

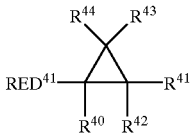

Formula (4-2)

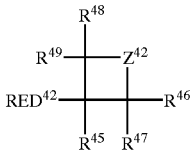

In the formulas (4-1) and (4-2), $RED^{41}$ and $RED^{42}$ each independently represent a reducing group that can be one electron-oxidized, and $R^{40}$ to $R^{44}$ and $R^{45}$ to $R^{49}$ each independently represent a hydrogen atom or a substituent. In the formula (4-2), $Z^{42}$ represents $—CR^{420}R^{421}—$, $—NR^{423}—$ or —O—. $R^{420}$ and $R^{421}$ each independently represent a hydrogen atom or a substituent, and $R^{423}$ represents a hydrogen atom, an alkyl group, an aryl group or a heterocyclic group.

When the photothermographic material of the present invention is subjected to light exposure and heat development at 121° C. for 24 seconds, it is preferred that 90% of developed silver grains in terms of grain number should be in contact with the silver halide. Further, an inclination of a straight line connecting points corresponding to Dmin+density 0.25 and Dmin+density 2.0 on the characteristic curve of the photothermographic material is preferably within the range of 2.0–5.0, more preferably within the range of 2.5–3.5. Further, the photothermographic material of the present invention preferably contains a high contrast agent.

BEST MODE FOR CARRYING OUT THE INVENTION

Figure 1:
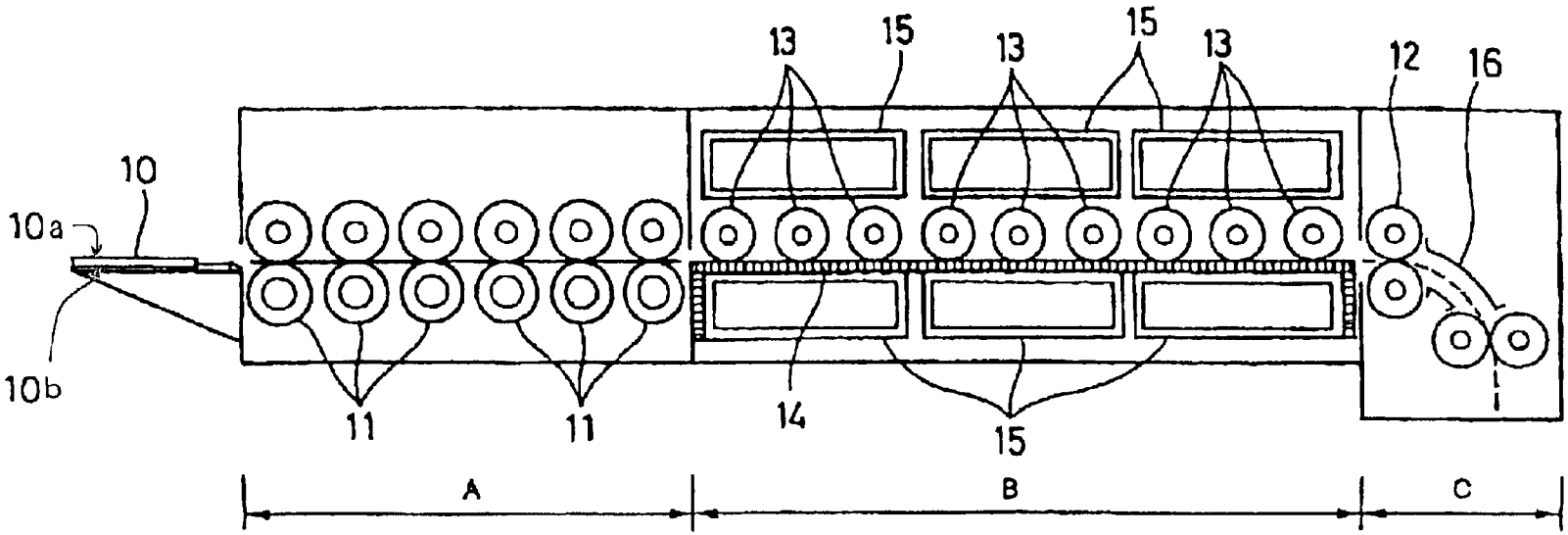
FIG. 1 is a side view of an exemplary heat development apparatus used for heat development of the photothermographic material of the present invention. In the figure, there are shown a photothermographic material 10, taking-in roller pairs 11, taking-out roller pairs 12, rollers 13, a flat surface 14, heaters 15, and guide panels 16. The apparatus consists of a preheating section A, a heat development section B, and a gradual cooling section C.

The photothermographic material of the present invention will be explained in detail hereafter. In the present specification, ranges indicated with "–" mean ranges including the numerical values before and after "–" as the minimum and maximum values.

The photothermographic material of the present invention contains a silver salt of an organic acid, a photosensitive silver halide, a reducing agent and a binder on a support. Further, the photothermographic material of the present invention is characterized by containing at least one compound selected from compounds of the aforementioned Types (i) to (iv). Therefore, the compounds of Types (i) to (iv) used in the present invention will be explained first.

Type (i)

A compound of which one-electron oxidized derivative produced by one electron oxidation of the compound is capable of releasing two or more electrons with a bond cleavage.

Type (ii)

A compound of which one-electron oxidized derivative produced by one electron oxidation of the compound is capable of releasing one more electron with a bond cleavage and which has two or more groups adsorptive to silver halide in the molecule.

Type (iii)

A compound of which one-electron oxidized derivative produced by one electron oxidation of the compound is capable of releasing one or more electrons after undergoing a bond formation process.

Type (iv)

A compound of which one-electron oxidized derivative produced by one electron oxidation of the compound is capable of releasing one or more electrons after undergoing an intramolecular ring cleavage reaction.

Among the aforementioned compounds of Type (i), Type (iii) and Type (iv), preferred are "compounds having a group adsorptive to silver halide in the molecules" or "compounds having a partial structure of sensitizing dye in the molecules". More preferred are "compounds having a group adsorptive to silver halide in the molecules".

The compounds of Types (i) to (iv) used in the present invention will be explained in detail hereafter.

In the definition of the compound of Type (i), the "bond cleavage reaction" specifically means a reaction for cleavage of a carbon-carbon, carbon-silicon, carbon-hydrogen, carbon-boron, carbon-tin or carbon-germanium bond, and it may further be accompanied by cleavage of carbon-hydrogen bond. The compound of Type (i) is a compound that is capable of releasing two or more electrons (preferably three or more electrons), in other words, that can further be oxidized for two or more electrons (preferably three or more electrons), with a bond cleavage reaction only after it is one electron-oxidized and thus becomes a one electron-oxidized derivative.

Preferred compounds as the compound of Type (i) are compounds represented by the formula (1-1), (1-2), (1-3), (1-4) or (1-5).

In the formula (1-1), $RED^{11}$ represents a reducing group that can be one electron-oxidized, and $L^{11}$ represents a leaving group. $R^{112}$ represents a hydrogen atom or a substituent. $R^{111}$ represents a nonmetallic group that can form a particular 5- or 6-membered ring structure together with the carbon atom (C) and $RED^{11}$. The particular 5- or 6-membered ring structure referred to here means a ring structure corresponding to a tetrahydro, hexahydro or octahydro derivative of a 5- or 6-membered aromatic ring (including an aromatic heterocyclic ring)

In the formula (1-2), $RED^{12}$ represents a reducing group that can be one electron-oxidized, and $L^{12}$ represents a leaving group. $R^{121}$ and $R^{122}$ each independently represent a hydrogen atom or a substituent. $ED^{12}$ represents an electron donor group. In the formula (1-2), $R^{121}$ and $RED^{12}$, $R^{121}$ and $R^{122}$ or $ED^{12}$ and $RED^{12}$ may bond to each other to form a ring structure.

These compounds are compounds that can, after one electron oxidization of the reducing group represented by $RED^{11}$ or $RED^{12}$ in the formula (1-1) or (1-2), release two or more electrons, preferably three or more electrons, due to spontaneous dissociation of $L^{11}$ or $L^{12}$, that is, due to cleavage of C (carbon atom)-$L^{11}$ bond or C (carbon atom)-$L^{12}$ bond, by a bond cleavage reaction.

In the formula (1-3), $Z^1$ represents an atomic group that can form a 6-membered ring together with the nitrogen atom and two of carbon atoms of the benzene ring, $R^1$, $R^2$ and $R^{N1}$ each independently represent a hydrogen atom or a substituent, $X^1$ represents a substituent that can substitute on the benzene ring, $m^1$ represents an integer of 0–3, and $L^1$ represents a leaving group. In the formula (1-4), $ED^{21}$ represents an electron donor group, $R^{11}$, $R^{12}$, $R^{N21}$, $R^{13}$ and $R^{14}$ each independently represents a hydrogen atom or a substituent, $X^{21}$ represents a substituent that can substitute on the benzene ring, $m^{21}$ represents an integer of 0–3, and $L^{21}$ represents a leaving group. $R^{N21}$, $R^{13}$, $R^{14}$, $X^{21}$ and $ED^{21}$ may bond to each other to form a ring structure. In the formula (1-5), $R^{32}$, $R^{33}$, $R^{31}$, $R^{N31}$, $R^a$ and $R^b$ each independently represents a hydrogen atom or a substituent, and $L^{31}$ represents a leaving group. However, when $R^{N31}$ represents a group other than an aryl group, $R^a$ and $R^b$ bond to each other to form an aromatic ring.

These compounds are compounds that can, after they are one electron-oxidized, further release two or more electrons, preferably three or more electrons, due to spontaneous dissociation of $L^1$, $L^{21}$ or $L^{31}$, i.e., cleavage of the C (carbon atom)-$L^1$ bond, C (carbon atom)-$L^{21}$ bond or C (carbon atom)-$L^{31}$ bond, by a bond cleavage reaction.

First, the compound represented by the formula (1-1) will be explained in detail hereafter.

The reducing group that can be one electron-oxidized represented by $RED^{11}$ in the formula (1-1) is a group that can bond to $R^{111}$ to be explained later to form a particular ring, and specific examples thereof include divalent groups formed from the following monovalent groups by removing one hydrogen atom at a site suitable for the ring formation. Such monovalent groups include, for example, an alkylamino group, an arylamino group (anilino group, naphthylamino group etc.), a hetelocyclylamino group (benzothiazolylamino group, pyrrolylamino group etc.), an alkylthio group, an arylthio group (phenylthio group etc.), a heterocyclylthio group, an alkoxy group, an aryloxy group (phenoxy group etc.), a hetelocyclyloxy group, an aryl group (phenyl group, naphthyl group, anthranyl group etc.), an aromatic or non-aromatic heterocyclic group (5- to 7-membered monocyclic or condensed ring heterocyclic ring group containing at least one hetero atom selected from nitrogen atom, sulfur atom, oxygen atom and selenium atom specific, and examples thereof include, for example, groups of tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring, methylenedioxyphenyl ring etc.) and so forth ($RED^{11}$ will be described with names of monovalent groups hereafter for convenience). These groups may have a substituent.

Examples of the substituent include, for example, a halogen atom, an alkyl group (including an aralkyl group, a cycloalkyl group, an active methine group etc.), an alkenyl group, an alkynyl group, an aryl group, a heterocyclic group (substitution position is not particularly limited), a heterocyclic group containing a quaternized nitrogen atom (e.g., pyridinio group, imidazolio group, quinolinio group, isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxy group, an alkoxy group (including a group containing an ethyleneoxy group or propyleneoxy group repeating unit), an aryloxy group, a hetelocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an acylamino group, a sulfonamido group, a ureido group, a thioureido group, an imido group, an (alkoxy or aryloxy) carbonylamino group, a sulfamoylamino group, a semicarbazido group, a thiosemicarbazide group, a hydrazino group, an ammonio group, an oxamoylamino group, an (alkyl or aryl)sulfonylureido group, an acylureido group, an acylsulfamoylamino group, a nitro group, a mercapto group, an (alkyl, aryl or heterocyclyl)thio group, an (alkyl or aryl) sulfonyl group, an (alkyl or aryl)sulfinyl group, a sulfo group or a salt thereof, a sulfamoyl group, an acylsulfamoyl group, a sulfonylsulfamoyl group or a salt thereof, a group containing a phosphoric acid amide or phosphoric acid ester structure and so forth. These substituents may be further substituted with these substituents.

In the formula (1-1), $L^{11}$ is represents a leaving group that can be eliminated by a bond cleavage only after the reducing group represented by $RED^{11}$ undergoes one electron oxidation, and it specifically represents a carboxyl group or a salt thereof, a silyl group, a hydrogen atom, a triarylboride anion, a trialkylstannyl group, trialkylgermyl group or a $—CR^{C1}R^{C2}R^{C3}$ group.

When $L^{11}$ represents a salt of carboxyl group, a counter ion that forms the salt may be specifically an alkali metal ion ($Li^+$, $Na^+$, $K^+$, $Cs^+$), alkaline earth metal ion ($Mg^{2+}$, $Ca^{2+}$, $Ba^{2+}$), heavy metal ion ($Ag^+$, $Fe^{2+/3+}$), ammonium ion, phosphonium ion or the like. When $L^{11}$ represents a silyl group, the silyl group specifically represents a trialkylsilyl group, an aryldialkylsilyl group, a triarylsilyl group or the like, wherein the alkyl group may be methyl group, ethyl group, benzyl group, tert-butyl group or the like, and the aryl group may be phenyl group or the like.

When $L^{11}$ represents a triarylboride anion, the aryl group is preferably a substituted or unsubstituted phenyl group, and examples of the substituent thereof include those substituents that $RED^{11}$ may have. When $L^{11}$ represents a trialkylstannyl group or a trialkylgermyl group, the alkyl group is a straight, branched or cyclic alkyl group having 1–24 carbon atoms and may have a substituent. Examples of the substituent include those substituents that $RED^{11}$ may have.

When $L^{11}$ represents $—CR^{C1}R^{C2}R^{C3}$, $R^{C1}$, $R^{C2}$ and $R^{C3}$ each independently represent a hydrogen atom, an alkyl group, an aryl group, a heterocyclic group, an alkylthio group, an arylthio group, an alkylamino group, an arylamino group, a hetelocyclylamino group, an alkoxy group, an aryloxy group or a hydroxy group, and they may bond to each other to form a ring structure and may further have a substituent. Examples of the substituent include those substituents that $RED^{11}$ may have. However, when one of $R^{C1}$, $R^{C2}$ and $R^{C3}$ represents a hydrogen atom or an alkyl group, the other two do not represent a hydrogen atom or an alkyl group. Preferably, $R^{C1}$, $R^{C2}$ and $R^{C3}$ each independently represent an alkyl group, an aryl group (especially phenyl group), an alkylthio group, an arylthio group, an alkylamino group, an arylamino group, a heterocyclic group, an alkoxy group or a hydroxy group, and specific examples thereof are phenyl group, p-dimethylaminophenyl group, p-methoxyphenyl group, 2,4-dimethoxyphenyl group, p-hydroxyphenyl group, methylthio group, phenylthio group, phenoxy group, methoxy group, ethoxy group, dimethylamino group, N-methylanilino group, diphenylamino group, morpholino group, thiomorpholino group, hydroxy group and so forth. Further, examples of a group having a ring structure formed by these groups bonded to each other are 1,3-dithiolan-2-yl group, 1,3-dithian-2-yl group, N-methyl-1,3-thiazolidin-2-yl group, N-benzylbenzothiazolidin-2-yl group and so forth.

Preferred examples of $—CR^{C1}R^{C2}R^{C3}$ group are trityl group, tri(p-hydroxyphenyl)methyl group, 1,1-diphenyl-1-(p-dimethylaminophenyl)methyl group, 1,1-diphenyl-1-(methylthio)methyl group, 1-phenyl-1,1-(dimethylthio) methyl group, 1,3-dithiolan-2-yl group, 2-phenyl-1,3-dithiolan-2-yl group, 1,3-dithian-2-yl group, 2-phenyl-1,3-dithian-2-yl group, 2-methyl-1,3-dithian-2-yl group, N-methyl-1,3-thiazolidin-2-yl group, 2-methyl-3-methyl-1,3-thiazolidin-2-yl group, N-benzyl-benzothiazolidin-2-yl group, 1,1-diphenyl-1-dimethylaminomethyl group, 1,1-diphenyl-1-morpholinomethyl group and so forth. Further, it is also preferred that $R^{C1}$, $R^{C2}$ and $R^{C3}$ are selected from the ranges of $R^{C1}$, $R^{C2}$ and $R^{C3}$ explained above, and as a result, $—CR^{C1}R^{C2}R^{C3}$ represents a group corresponding to a residue formed from a compound of the formula (1-1) by removing $L^{11}$.

In the formula (1-1), $R^{112}$ represents a hydrogen atom or a substituent that can substitute on a carbon atom. When $R^{112}$ represents a substituent that can substitute on a carbon atom, the substituents mentioned for $RED^{11}$ having a substituent can be mentioned as specific examples of the substituent. However, $R^{112}$ does not represent the same group as $L^{11}$.

In the formula (1-1), $R^{111}$ represents a nonmetallic group that can form a particular 5- or 6-membered ring structure together with the carbon atom (C) and $RED^{11}$. The particular 5- or 6-membered ring structure formed by $R^{111}$ means a ring structure corresponding to a tetrahydro, hexahydro or octahydro derivative of a 5- or 6-membered aromatic ring (including an aromatic heterocyclic ring). The hydro derivatives used herein mean ring structures of aromatic rings (including aromatic heterocyclic rings) of which carbon-carbon double bonds (or carbon-nitrogen double bonds) contained in the ring are partially hydrogenated. A tetrahydro derivative means such a structure in which two of carbon-carbon double bonds (or carbon-nitrogen double bonds) are hydrogenated, a hexahydro derivative means such a structure in which three of carbon-carbon double bonds (or carbon-nitrogen double bonds) are hydrogenated, and an octahydro derivative means such a structure in which four of carbon-carbon double bonds (or carbon-nitrogen double bonds) are hydrogenated. By the hydrogenation, an aromatic ring becomes a partially hydrogenated non-aromatic ring structure.

Specifically, examples of monocyclic 5-membered ring include pyrrolidine ring, imidazolidine ring, thiazolidine ring, pyrazolidine ring, oxazolidine ring etc., which correspond to tetrahydro derivatives of aromatic rings of pyrrole ring, imidazole ring, thiazole ring, pyrazole ring and oxazole ring etc., respectively. Examples of monocyclic 6-membered ring include tetrahydro derivatives or hexahydro derivatives of aromatic rings such as pyridine ring, pyridazine ring, pyrimidine ring and pyrazine ring, and there can be mentioned, for example, piperidine ring, tetrahydropyridine ring, tetrahydropyrimidine ring, piperazine ring and so forth. Examples of condensed rings of 6-membered ring include tetralin ring, tetrahydroquinoline ring, tetrahydroisoquinoline ring, tetrahydroquinazoline ring, tetrahydroquinoxaline ring etc., which correspond to tetrahydro derivatives of aromatic rings such as naphthalene ring, quinoline ring, isoquinoline ring, quinazoline ring, quinoxaline ring etc. Examples of tricyclic compound include tetrahydrocarbazole ring, which is a tetrahydro derivative of carbazole ring, octahydrophenanthridine ring, which is an octahydro derivative of phenanthridine ring, and so forth.

These ring structures may further have a substituent, and examples of the substituent include the same substituents explained as substituents of $RED^{11}$. Substituents of these ring structure may bond to each other to form a ring, and such a newly formed ring is a non-aromatic carbon ring or heterocyclic ring.

The preferred range of the compound represented by the formula (1-1) will be explained hereafter.

In the formula (1-1), $L^{11}$ is preferably a carboxyl group or a salt thereof or a hydrogen atom, more preferably a carboxyl group or a salt thereof.

The counter ion of the salt is preferably an alkali metal ion or ammonium ion, and an alkali metal ion (especially $Li^+$, $Na^+$ or $K^+$ ion) is most preferred.

When $L^{11}$ represents a hydrogen atom, the compound represented by the formula (1-1) preferably has a base moiety contained in the molecule. By an action of the base moiety, the hydrogen atom represented by $L^{11}$ is deprotonated after oxidation of the compound represented by the formula (1-1), and an electron is further released from the compound.

The base of the base moiety is specifically a conjugate base of an acid showing pKa of about 1 to about 10. Examples of the base moiety are nitrogen-containing heterocyclic rings (pyridines, imidazoles, benzimidazoles, thiazoles etc.), anilines, trialkylamines, an amino group, carbon acids (active methylene anion etc.), thioacetate anion, carboxylate (—$COO^-$), sulfate (—$SO_3^-$), amine oxide (>$N^+(O^-)$—) and so forth. The base is preferably a conjugate base of an acid showing pKa of about 1 to about 8, carboxylate, sulfate and amine oxide are more preferred, and carboxylate is particularly preferred. When these bases have an anion, it may have a counter cation, and examples thereof include an alkali metal ion, an alkaline earth metal ion, a heavy metal ion, an ammonium ion, a phosphonium ion and so forth.

These bases bond to the compound represented by the formula (1-1) at an arbitrary position. As for the position for bonding of these bases, they may bond to any of $RED^{11}$, $R^{111}$ and $R^{112}$ in the formula (1-1) or a substituent of these groups.

When $L^{11}$ represents a hydrogen atom, this hydrogen atom and the base moiety are preferably linked via an atomic group having 8 or less atoms, more preferably an atomic group having 5–8 atoms. In this case, atoms contained in an atomic group linking the center atom of the base moiety (i.e., an atom having anion or atom having lone pair) and the hydrogen atom via covalent bonds are counted. For example, in the case of carboxylate, two atoms of —C—$O^-$ are counted, and in the case of sulfate, two atoms of S—$O^-$ are counted. Moreover, the carbon atom represented by C in the formula (1-1) is also counted.

In the formula (1-1), when $L^{11}$ represents a hydrogen atom, $RED^{11}$ represents an aniline, and the nitrogen atom of the aniline forms a 6-membered saturated monocyclic ring structure (piperidine ring, piperazine ring, morpholine ring, thiomorpholine ring, selenomorpholine ring etc.) together with $R^{111}$, the compound preferably contains a group adsorptive to silver halide in the molecule, and more preferably, the compound also further has a base moiety contained in the molecule, and the base moiety is linked to the hydrogen atom via an atomic group having 8 or less atoms.

In the formula (1-1), $RED^{11}$ is preferably an alkylamino group, an arylamino group, a hetelocyclylamino group, an aryl group or an aromatic or a non-aromatic heterocyclic group. Among these, the heterocyclic group is preferably tetrahydroquinolinyl group, tetrahydroquinoxalinyl group, tetrahydroquinazolinyl group, indolyl group, indolenyl group, carbazolyl group, phenoxazinyl group, phenothiazinyl group, benzothiazolinyl group, pyrrolyl group, imidazolyl group, thiazolidinyl group, benzimidazolyl group, benzimidazolinyl group, 3,4-methylenedioxyphenyl-1-yl group or the like. More preferred are an arylamino group (especially anilino group) and an aryl group (especially phenyl group). When $RED^{11}$ represents an aryl group, the aryl group preferably has at least one electron donor group (number of the electron donor groups is preferably 4 or less, more preferably 1–3). The electron donor group referred to here is a hydroxy group, an alkoxy group, a mercapto group, a sulfonamido group, an acylamino group, an alkylamino group, an arylamino group, a hetelocyclylamino group, an active methine group, an aromatic heterocyclic group having excessive electrons (e.g., indolyl group, pyrrolyl group, imidazolyl group, benzimidazolyl group, thiazolyl group, benzothiazolyl group, indazolyl group etc.), a non-aromatic nitrogen-containing heterocyclic group that substitutes at a nitrogen atom (pyrrolidinyl group, indolinyl group, piperidinyl group, piperazinyl group, morpholino group etc.) or the like. The active methine group referred to here means a methine group substituted with two of electron-withdrawing groups, and the electron-withdrawing group referred to here means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. Two of the electron-withdrawing groups may bond to each other to form a ring structure. When $RED^{11}$ represents an aryl group, more preferred substituents of the aryl group are an alkylamino group, a hydroxy group, an alkoxy group, a mercapto group, a sulfonamido group, an active methine group and a non-aromatic nitrogen-containing heterocyclic group that substitutes at a nitrogen atom, further preferred are an alkylamino group, a hydroxy group, an active methine group and a non-aromatic nitrogen-containing heterocyclic group that substitutes at a nitrogen atom, and the most preferred are an alkylamino group and a non-aromatic nitrogen-containing heterocyclic group that substitutes at a nitrogen atom.

In the formula (1-1), $R^{112}$ preferably represents a hydrogen atom, an alkyl group, an aryl group (phenyl group etc.), an alkoxy group (methoxy group, ethoxy group, benzyloxy group etc.), a hydroxy group, an alkylthio group (methylthio group, butylthio group etc.), an amino group, an alkylamino group, an arylamino group or a hetelocyclylamino group, more preferably a hydrogen atom, an alkyl group, an alkoxy group, a hydroxy group, a phenyl group or an alkylamino group.

In the formula (1-1), $R^{111}$ preferably represents a nonmetallic group that can form any of the following particular 5- or 6-membered ring structures together with the carbon atom (C) and $RED^{11}$. That is, there are mentioned pyrrolidine ring, imidazolidine ring etc. corresponding to tetrahydro derivatives of pyrrole ring, imidazole ring etc., which are monocyclic 5-membered aromatic rings; tetrahydro derivatives or hexahydro derivatives of pyridine ring, pyridazine ring, pyrimidine ring and pyrazine ring, which are monocyclic 6-membered aromatic rings (e.g., piperidine ring, tetrahydropyridine ring, tetrahydropyrimidine ring, piperazine ring etc.); tetralin ring, tetrahydroquinoline ring, tetrahydroisoquinoline ring, tetrahydroquinazoline ring, tetrahydroquinoxaline ring etc. corresponding to tetrahydro derivatives of naphthalene ring, quinoline ring, isoquinoline ring, quinazoline ring and quinoxaline ring, which are condensed 6-membered aromatic rings; hydro derivatives of tricyclic aromatic rings such as tetrahydrocarbazole ring, which is a tetrahydro derivative of carbazole ring, octahydrophenanthridine ring, which is an octahydro derivative of phenanthridine ring, and so forth. The ring structure formed by $R^{111}$ is more preferably pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring or tetrahydrocarbazole ring, particularly preferably pyrrolidine ring, piperidine ring, piperazine ring, tetrahydroquinoline ring, tetrahydroquinazoline ring, tetrahydroquinoxaline ring or tetrahydrocarbazole ring, most preferably pyrrolidine ring, piperidine ring or tetrahydroquinoline ring.

The compound represented by the formula (1-2) will be explained in detail hereafter.

In the formula (1-2), $RED^{12}$ and $L^{12}$ are groups having the same meaning as those of $RED^{11}$ and $L^{11}$ in the formula (1-1), respectively, and the preferred ranges thereof are also the same. However, $RED^{12}$ is a monovalent group except for the case that it forms the ring structure mentioned below, and specific examples thereof include the groups mentioned for $RED^{11}$ with names of monovalent groups. $R^{121}$ and $R^{122}$ are groups having the same meanings as that of $R^{112}$ in the formula (1-1), and the preferred ranges thereof are also the same. $ED^{12}$ represents an electron donor group. $R^{121}$ and $RED^{12}$, $R^{121}$ and $R^{122}$ or $ED^{12}$ and $RED^{12}$ may bond to each other to form a ring structure.

The electron donor group represented by $ED^{12}$ in the formula (1-2) is a hydroxy group, an alkoxy group, a mercapto group, an alkylthio group, an arylthio group, a heterocyclylthio group, a sulfonamido group, an acylamino group, an alkylamino group, an arylamino group, a hetelocyclylamino group, an active methine group, an aromatic heterocyclic group having excessive electrons (e.g., indolyl group, pyrrolyl group, imidazolyl group etc.), a non-aromatic nitrogen-containing heterocyclic group that substitutes at a nitrogen atom (pyrrolidinyl group, piperidinyl group, indolinyl group, piperazinyl group, morpholino group etc.) or an aryl group substituted with any of these electron donor groups (e.g., p-hydroxyphenyl group, p-dialkylaminophenyl group, o,p-dialkoxyphenyl group, 4-hydroxynaphthyl group etc.). The active methine group referred to here may be the same as that explained as a substituent of the aryl group represented by $RED^{11}$. $ED^{12}$ is preferably a hydroxy group, an alkoxy group, a mercapto group, a sulfonamido group, an alkylamino group, an arylamino group, an active methine group, an aromatic heterocyclic group having excessive electrons, a non-aromatic nitrogen-containing heterocyclic group that substitutes at a nitrogen atom or a phenyl group substituted with any of these electron donor groups. Further preferred are a hydroxy group, a mercapto group, a sulfonamido group, an alkylamino group, an arylamino group, an active methine group, a non-aromatic nitrogen-containing heterocyclic group that substitutes at a nitrogen atom and a phenyl group substituted with any of these electron donor groups (e.g., p-hydroxyphenyl group, p-dialkylaminophenyl group, o,p-dialkoxyphenyl group etc.).

In the formula (1-2), $R^{122}$ and $RED^{12}$, $R^{122}$ and $R^{121}$ or $ED^{12}$ and $RED^{12}$ may bond to each other to form a ring structure. The ring formed in this case is a non-aromatic carbon ring or heterocyclic ring, and it may have a substituted or unsubstituted 5- to 7-membered monocyclic or condensed ring structure. When $R^{122}$ and $RED^{12}$ form a ring structure, specific examples of the ring structure include pyrrolidine ring, pyrroline ring, imidazolidine ring, imidazoline ring, thiazolidine ring, thiazoline ring, pyrazolidine ring, pyrazoline ring, oxazolidine ring, oxazoline ring, indan ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenz-1,4-oxazine ring, tetrahydro-1,4-thiazine ring, 2,3-dihydrobenzo-1,4-thiazine ring, 2,3-dihydrobenzofuran ring, 2,3-dihydrobenzothiophene ring and so forth. When $ED^{12}$ and $RED^{12}$ form a ring structure, $ED^{12}$ preferably represents an amino group, an alkylamino group or an arylamino group, and specific examples of the formed ring structure include tetrahydropyrazine ring, piperazine ring, tetrahydroquinoxaline ring, tetrahydroisoquinoline ring and so forth. When $R^{122}$ and $R^{121}$ form a ring structure, specific example of the ring structure include cyclohexane ring, cyclopentane ring and so forth.

Among the compounds represented by the formula (1-1), still more preferred are compounds represented by following formulas (1-1-1) to (1-1-3), and among the compounds represented by the formula (1-2), still more preferred are compounds represented by the following formulas (1-2-1)

and (1-2-2).

Formula (1-1-1)

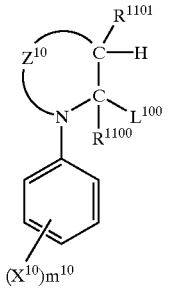

Formula (1-1-2)

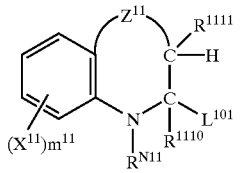

Formula (1-1-3)

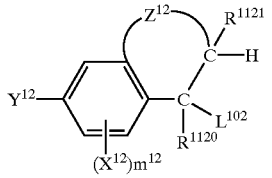

Formula (1-2-1)

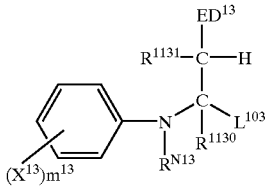

Formula (1-2-2)

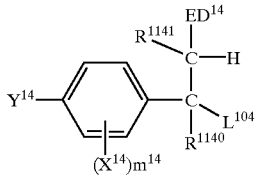

In the formulas (1-1-1) to (1-2-2), $L^{100}$, $L^{101}$, $L^{102}$, $L^{103}$ and $L^{104}$ are groups having the same meanings as that of $L^{11}$ in the formula (1-1), and the preferred ranges thereof are also the same. $R^{1100}$ and $R^{1101}$, $R^{1110}$ and $R^{1111}$, $R^{1120}$ and $R^{1121}$, $R^{1130}$ and $R^{1131}$, $R^{1140}$ and $R^{1141}$ are groups having the same meanings as those of $R^{121}$ and $R^{122}$ in the formula (1-2), respectively, and the preferred ranges thereof are also the same. $ED^{13}$ and $ED^{14}$ represent a group having the same meaning as $ED^{12}$ in the formula (1-2), and the preferred ranges thereof are also the same. $X^{10}$, $X^{11}$, $X^{12}$, $X^{13}$ and $X^{14}$ each represent a substituent that can substitute on a benzene ring. $m^{10}$, $m^{11}$, $m^{12}$, $m^{13}$ and $m^{14}$ each represent an integer of 0–3, and when these represent an integer of 2 or more, two or more of $X^{10}$, $X^{11}$, $X^{12}$, $X^{13}$ and $X^{14}$ may be the identical to or different from each other or one another. $Y^{12}$ and $Y^{14}$ represent an amino group, an alkylamino group, an arylamino group, a non-aromatic nitrogen-containing heterocyclic group that substitutes at a nitrogen atom (pyrrolyl group, piperidinyl group, indolinyl group, piperazino group, morpholino group etc.), a hydroxy group or an alkoxy group.

$Z^{10}$, $Z^{11}$ and $Z^{12}$ represent a nonmetallic group that can form a particular ring structure. The particular ring structure formed by $Z^{10}$ is a ring structure corresponding to a tetrahydro or hexahydro derivative of a 5- or 6-membered monocyclic or condensed ring nitrogen-containing aromatic heterocyclic ring. Specific examples thereof include pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring, tetrahydroquinoxaline ring and so forth. Specific examples of the particular ring structure formed by $Z^{11}$ include tetrahydroquinoline ring and tetrahydroquinoxaline ring. Specific examples of the particular ring structure formed by $Z^{12}$ include tetralin ring, tetrahydroquinoline ring and tetrahydroisoquinoline ring.

$R^{N11}$ and $R^{N13}$ each represent a hydrogen atom or a substituent that can substitute on a nitrogen atom. Specific examples of the substituent include an alkyl group, an alkenyl group, an alkynyl group, an aryl group, a heterocyclic group and an acyl group, and preferred are an alkyl group and an aryl group.

As specific examples of the substituent that can substitute on a benzene ring represented by $X^{10}$, $X^{11}$, $X^{12}$, $X^{13}$ and $X^{14}$, the same substituents as those of $RED^{11}$ in the formula (1-1) can be mentioned. Preferred are a halogen atom, an alkyl group, an aryl group, a heterocyclic group, an acyl group, an alkoxycarbonyl group, an aryloxycarbonyl group, a carbamoyl group, a cyano group, an alkoxy group (including a group containing an ethyleneoxy group or propyleneoxy group repeating unit), an (alkyl, aryl or heterocyclyl)amino group, an acylamino group, a sulfonamido group, a ureido group, a thioureido group, an imido group, an (alkoxy or aryloxy)carbonylamino group, a nitro group, an (alkyl, aryl or heterocyclyl)thio group, an (alkyl or aryl)sulfonyl group, a sulfamoyl group and so forth. $m^{10}$, $m^{11}$, $m^{12}$, $m^{13}$ and $m^{14}$ preferably represent 0–2, more preferably 0 or 1.

$Y^{12}$ and $Y^{14}$ preferably represent an alkylamino group, an arylamino group, a non-aromatic nitrogen-containing heterocyclic group that substitutes at a nitrogen atom, a hydroxy group or an alkoxy group, more preferably an alkylamino group, a non-aromatic 5- or 6-membered nitrogen-containing heterocyclic group that substitutes at a nitrogen atom or a hydroxy group, most preferably an alkylamino group (especially dialkylamino group) or a non-aromatic 5- or 6-membered nitrogen-containing heterocyclic group that substitutes at a nitrogen atom.

In the formula (1-2-1), $R^{1131}$ and $X^{13}$, $R^{1131}$ and $R^{N13}$, $R^{1130}$ and $X^{13}$ or $R^{1130}$ and $R^{N13}$ may bond to each other to form a ring structure. Moreover, in the formula (1-2-2), $R^{1141}$ and $X^{14}$, $R^{1141}$ and $R^{1140}$, $ED^{14}$ and $X^{14}$ or $R^{1140}$ and $X^{14}$ may bond to each other to form a ring structure. The ring structure formed in these cases is a non-aromatic carbon ring or heterocyclic ring structure, and it is a substituted or unsubstituted 5- to 7-membered monocyclic or condensed ring structure. The compounds of the formula (1-2-2) where $R^{1131}$ and $X^{13}$ bond to each other to form a ring structure or $R^{1131}$ and $R^{N13}$ bond to each other to form a ring structure as well as those compounds that do not form such a ring are preferred examples of the compounds represented by the formula (1-2-2). Specific examples of the ring structure formed by $R^{1131}$ and $X^{13}$ bonding to each other in the formula (1-2-2) include indoline ring ($R^{1131}$ represents a single bond in this case), tetrahydroquinoline ring, tetrahydroquinoxaline ring, 2,3-dihydrobenz-1,4-oxazine ring, 2,3-dihydrobenzo-1,4-thiazine ring and so forth. Particularly preferred are indoline ring, tetrahydroquinoline ring and tetrahydroquinoxaline ring. Specific examples of the ring structure formed by $R^{1131}$ and $R^{N13}$ in the formula (1-2-1) include pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenz-1,4-oxazine ring, tetrahydro-1,4-thiazine ring, 2,3-dihydrobenzo-1,4-thiazine ring, 2,3-dihydrobenzofuran ring, 2,3-dihydrobenzothiophene ring and so forth. Particularly preferred are pyrrolidine ring, piperidine ring, tetrahydroquinoline ring and tetrahydroquinoxaline ring.

The compounds of the formula (1-2-2) where $R^{1141}$ and $X^{14}$ bond to each other to form a ring structure and the compounds of the formula (1-2-2) where $ED^{14}$ and $X^{14}$ bond to each other to form a ring structure as well as the compounds where such a ring structure is not formed are preferred examples of the compound represented by the formula (1-2-2). Examples of the ring formed by $R^{1141}$ and $X^{14}$ bonding to each other in the formula (1-2-2) include indan ring, tetralin ring, tetrahydroquinoline ring, tetrahydroisoquinoline ring, indoline ring and so forth. Examples of the ring formed by $ED^{14}$ and $X^{14}$ bonding to each other include tetrahydroisoquinoline ring, tetrahydrocinnoline ring and so forth.

The compounds of the formulas (1-3) to (1-5) will be explained hereafter.

In the formulas (1-3) to (1-5), $R^1$, $R^2$, $R^{11}$, $R^{12}$ and $R^{31}$ each independently represent a hydrogen atom or a substituent. These are groups having the same meanings as that of $R^{112}$ in the formula (1-1), and the preferred ranges thereof are also the same. $L^1$, $L^{21}$ and $L^{31}$ each independently represent a leaving group. These represent the same groups as the groups mentioned as specific examples of $L^{11}$ in the formula (1-1), and the preferred ranges thereof are also the same. $X^1$ and $X^{21}$ represent a substituent that can substitute on the benzene ring, and the same examples as those of the substituent of $RED^{11}$ in the formula (1-1) can be mentioned for each of them. $m^1$ and $m^{21}$ represent an integer of 0–3, and they preferably represent 0–2, more preferably 0 or 1.

$R^{N1}$, $R^{N21}$ and $R^{N31}$ represent a hydrogen atom or a substituent that can substitute on the nitrogen atom. The substituent is preferably an alkyl group, an aryl group or a heterocyclic group, and may further have a substituent. Examples of this substituent are similar to those of the substituent that $RED^{11}$ in the formula (1-1) may have. $R^{N1}$, $R^{N21}$ and $R^{N31}$ preferably represent a hydrogen atom, an alkyl group or an aryl group, more preferably a hydrogen atom or an alkyl group.

$R^{13}$, $R^{14}$, $R^{32}$, $R^{33}$, $R^a$ and $R^b$ each independently represent a hydrogen atom or a substituent that can substitute on a carbon atom. Examples of the substituent are the same as those of the substituent that $RED^{11}$ in the formula (1-1) may have. The substituent is preferably an alkyl group, an aryl group, an acyl group, an alkoxycarbonyl group, a carbamoyl group, a cyano group, an alkoxy group, an acylamino group, a sulfonamido group, a ureido group, a thioureido group, an alkylthio group, an arylthio group, an alkylsulfonyl group, an arylsulfonyl group, a sulfamoyl group or the like.

In the formula (1-3), $Z^1$ represents an atomic group that can form a 6-membered ring together with the nitrogen atom and two carbon atoms of the benzene ring. The 6-membered ring formed by $Z^1$ is a non-aromatic heterocyclic ring condensed to the benzene ring in the formula (1-3), and it is specifically tetrahydroquinoline ring, tetrahydroquinoxaline ring or tetrahydroquinazoline ring as a ring structure including the benzene ring to which it is condensed. The ring structure may have a substituent. Examples the substituent are the same as those of the substituent represented by $R^{112}$ in the formula (1-1), and the preferred range thereof is also the same.

In the formula (1-3), $Z^1$ preferably represents an atomic group that forms tetrahydroquinoline ring or tetrahydroquinoxaline ring together with the nitrogen atom and two carbon atoms of the benzene ring.

In the formula (1-4), $ED^{21}$ represents an electron donor group. This is a group having the same meaning as $ED^{12}$ in the formula (1-2), and the preferred range thereof is also the same.

In the formula (1-4), any two of $R^{N21}$, $R^{13}$, $R^{14}$, $X^{21}$ and $ED^{21}$ may bond to each other to form a ring structure. The ring structure formed by bonded $R^{N21}$ and $X^{21}$ is preferably a 5- to 7-membered non-aromatic carbon ring or heterocyclic ring condensed to the benzene ring, and specific examples thereof are tetrahydroquinoline ring, tetrahydroquinoxaline ring, indoline ring, 2,3-dihydro-5,6-benzo-1,4-thiazine ring and so forth. It is preferably tetrahydroquinoline ring, tetrahydroquinoxaline ring or indoline ring.

When $R^{N31}$ represents a group other than an aryl group in the formula (1-5), $R^a$ and $R^b$ bond to each other to form an aromatic ring. The aromatic ring formed in this case may be an aryl group (e.g., phenyl group, naphthyl group) or an aromatic heterocyclic group (e.g., pyridine ring group, pyrrole ring group, quinoline ring group, indole ring group etc.), and it is preferably an aryl group. The aromatic ring may have a substituent. Examples thereof are the same as those of the substituent represented by $X^1$ in the formula (1-3), and the preferred range thereof is also the same.

In the formula (1-5), it is preferred that $R^a$ and $R^b$ bond to each other to form an aromatic ring (especially phenyl group).

In the formula (1-5), $R^{32}$ is preferably a hydrogen atom, an alkyl group, an aryl group, a hydroxy group, an alkoxy group, a mercapto group, an amino group or the like. When $R^{32}$ represents a hydroxy group, a compound in which $R^{33}$ represents an electron-withdrawing group at the same time is one of preferred examples of the compound of the formula (1-5). The electron-withdrawing group referred to here means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group, and an acyl group, an alkoxycarbonyl group, a carbamoyl group and a cyano group are preferred.

The compound of Type (ii) will be explained hereafter.

The compound of Type (ii) is a compound that can, only after it undergoes one electron oxidation and thus becomes one electron-oxidized derivative, further release one more electron with a bond cleavage reaction, in other wards, further undergo one electron oxidation. The bond cleavage reaction referred to here means a reaction for cleavage of a carbon-carbon, carbon-silicon, carbon-hydrogen, carbon-boron, carbon-tin or carbon-germanium bond, and it may be accompanied by cleavage of carbon-hydrogen bond.

In addition, the compound of Type (ii) is a compound having two or more (preferably 2–6, more preferably 2–4) groups adsorptive to silver halide in the molecule. More preferably, it is a compound having two or more nitrogen-containing heterocyclic groups substituted with a mercapto group as the adsorptive groups. The number of the adsorptive groups is preferably 2–6, more preferably 2–4. The adsorptive group will be explained later.

Among the compounds of Type (ii), preferred compounds are those represented by the formula (2-1).

The compound represented by the formula (2-1) is a compound that is capable of releasing one electron along with spontaneous dissociation of $L^2$ by a bond cleavage reaction, i.e., cleavage of C (carbon atom)-$L^2$ bond, after the reducing group represented by $RED^2$ undergoes one electron oxidation.

In the formula (2-1), $RED^2$ represents a group having the same meaning as that of $RED^{12}$ in the formula (1-2), and the preferred range thereof is also the same. $L^2$ represents a group having the same meaning as that of $L^{11}$ in the formula (1-1), and the preferred range thereof is also the same. When $L^2$ represents a silyl group, the compound is a compound having two or more nitrogen-containing heterocyclic groups substituted with a mercapto group as the absorptive groups. $R^{21}$ and $R^{22}$ each independently represent a hydrogen atom or a substituent. These are groups having the same meanings as that of $R^{112}$ in the formula (1-1), and the preferred ranges are also the same. $RED^2$ and $R^{21}$ may bond to each other to form a ring structure.

The ring structure formed in this case is a non-aromatic 5- to 7-membered monocyclic or condensed ring carbon ring or heterocyclic ring, which may have a substituent. However, this ring structure is not a ring structure that corresponds to a tetrahydro, hexahydro or octahydro derivative of an aromatic ring or aromatic heterocyclic ring. Examples of the substituent are similar to those of the substituent that $RED^{11}$ in the formula (1-1) may have. The ring structure is preferably a ring structure that corresponds to a dihydro derivative of an aromatic ring or aromatic heterocyclic ring, and specific examples thereof include, for example, 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofuran ring, benzo-a-pyran ring, 1,2-dihydroquinoline ring, 1,2-dihydroquinazoline ring, 1,2-dihydroquinoxaline ring and so forth.

Preferred are 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring, 1,2-dihydroquinoxaline ring and so forth, more preferred are indoline ring, benzimidazoline ring, benzothiazoline ring and 1,2-dihydroquinoline ring, and particularly preferred is indoline ring.

The compound of Type (iii) will be explained hereafter.

The compound of Type (iii) is a compound characterized in that its one-electron oxidized derivative produced by one electron oxidation of the compound is capable of releasing one or more electrons after undergoing a bond formation process. The bond formation referred to herein means formation of bond between atoms such as carbon-carbon, carbon-nitrogen, carbon-sulfur and carbon-oxygen.

The compound of Type (iii) is preferably a compound characterized in that its one electron-oxidized derivative produced by one electron oxidation of the compound is capable of releasing one or more electrons after reacting with a reactive group moiety present in the molecule (carbon-carbon double bond moiety, carbon-carbon triple bond moiety, aromatic group moiety or benzo-condensed non-aromatic heterocyclic group moiety) to form a bond.

Although one electron-oxidized derivative that is formed one electron oxidation of the compound of Type (iii) is a cation radical species, it may become a neutral radical species along with elimination of a proton. This one electron-oxidized derivative (cation radical species or radical species) reacts with a carbon-carbon double bond moiety, carbon-carbon triple bond moiety, aromatic group moiety or benzo-condensed non-aromatic heterocyclic group moiety present in the same molecule to form a bond between atoms such as carbon-carbon, carbon-nitrogen, carbon-sulfur and carbon-oxygen and thereby newly form a ring structure in the molecule. The compound of Type (iii) is characterized in that it releases one or more electrons at the same time with or after the bond formation.

More precisely, the compound of Type (iii) is characterized in that it newly produces, after one electron oxidation, a radical species having a ring structure by the bond formation reaction, and a second electron is further released from the radical species directly or with elimination of proton so that the compound is oxidized.

Further, the compound of Type (iii) include a compound of which two electron oxidized derivative produced as describe above has an ability to cause, after undergoing hydrolysis in some cases or directly in some cases, a tautomerization reaction with transfer of proton to further release one or more electrons, usually two or more electrons, and thus to be oxidized. It further includes a compound of which two electron oxidized derivative has an ability to directly release one or more electrons, usually two or more electrons, and thus to be oxidized without undergoing such a tautomerization reaction.

The compound of Type (iii) is preferably represented by the formula (3-1).

In the formula (3-1), $RED^3$ represents a reducing group that can be one electron-oxidized, and $Y^3$ represents a reactive group moiety that reacts after $RED^3$ is one electron-oxidized, specifically an organic group containing a carbon-carbon double bond moiety, carbon-carbon triple bond moiety, aromatic group moiety or benzo-condensed non-aromatic heterocyclic group moiety. $L^3$ represents a bridging group bonding $RED^3$ and $Y^3$.

In the formula (3-1), $RED^3$ represents a group having the same meaning as that of $RED^{12}$ in the formula (1-2).

$RED^3$ in the formula (3-1) is preferably an arylamino group, a hetelocyclylamino group, an aryloxy group, an arylthio group, an aryl group or an aromatic or non-aromatic heterocyclic group (a nitrogen-containing heterocyclic group is particularly preferred), more preferably an arylamino group, a hetelocyclylamino group, an aryl group or an aromatic or non-aromatic heterocyclic group. As for the heterocyclic group among these, tetrahydroquinoline ring group, tetrahydroquinoxaline ring group, tetrahydroquinazoline ring group, indoline ring group, indole ring group, carbazole ring group, phenoxazine ring group, phenothiazine ring group, benzothiazoline ring group, pyrrole ring group, imidazole ring group, thiazole ring group, benzimidazole ring group, benzimidazoline ring group, benzothiazoline ring group, 3,4-methylenedioxyphenyl-1-yl group and so forth are preferred.

$RED^3$ is particularly preferably an arylamino group (especially anilino group), an aryl group (especially phenyl group) or an aromatic or non-aromatic heterocyclic group.

When $RED^3$ represents an aryl group, the aryl group preferably has at least one electron donor group. The electron donor group referred to here is a hydroxy group, an alkoxy group, a mercapto group, an alkylthio group, a sulfonamido group, an acylamino group, an alkylamino group, an arylamino group, a hetelocyclylamino group, an active methine group, an aromatic heterocyclic group having excessive electrons (e.g., indolyl group, pyrrolyl group, indazolyl group) or a non-aromatic nitrogen-containing heterocyclic group that substitutes at a nitrogen atom (pyrrolidinyl group, indolinyl group, piperidinyl group, piperazinyl group, morpholino group, thiomorpholino group etc.). The active methine group referred to here means a methine group substituted with two electron-withdrawing groups, and the electron-withdrawing group referred to here means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. Two of the electron-withdrawing groups may bond to each other to form a ring structure.

When $RED^3$ represents an aryl group, the substituent thereof is preferably an alkylamino group, a hydroxy group, an alkoxy group, a mercapto group, a sulfonamido group, an active methine group or a nitrogen-containing non-aromatic heterocyclic group that substitutes at a nitrogen atom, more preferably an alkylamino group, a hydroxy group, an active methine group or a nitrogen-containing non-aromatic heterocyclic group that substitutes at a nitrogen atom, most preferably an alkylamino group or a nitrogen-containing non-aromatic heterocyclic group that substitutes at a nitrogen atom.

When the reactive group represented by $Y^3$ in the formula (3-1) represents an organic group containing a carbon-carbon double bond or carbon-carbon triple bond moiety having a substituent, the substituent is preferably an alkyl group (preferably containing 1–8 carbon atoms), an aryl group (preferably containing 6–12 carbon atoms), an alkoxycarbonyl group (preferably containing 2–8 carbon atoms), a carbamoyl group, an acyl group, an electron donor group or the like. The electron donor group referred to here is an alkoxy group (preferably containing 1–8 carbon atoms), a hydroxy group, an amino group, an alkylamino group (preferably containing 1–8 carbon atoms), an arylamino group (preferably containing 6–12 carbon atoms), a hetelocyclylamino group (preferably containing 2–6 carbon atoms), a sulfonamido group, an acylamino group, an active methine group, a mercapto group, an alkylthio group (preferably containing 1–8 carbon atoms), an arylthio group (preferably containing 6–12 carbon atoms) or an aryl group having any of these groups as a substituent (the aryl moiety preferably contains 6–12 carbon atoms). The hydroxy group may be protected with a silyl group, and examples of such a group include, for example, trimethylsilyloxy group, tert-butyldimethylsilyloxy group, triphenylsilyloxy group, triethylsilyloxy group, phenyldimethylsilyloxy group and so forth. Examples of the carbon-carbon double bond moiety and carbon-carbon triple bond moiety include vinyl group and ethynyl group.

When $Y^3$ represents an organic group containing a carbon-carbon double bond moiety having a substituent, the substituent is more preferably an alkyl group, a phenyl group, an acyl group, a cyano group, an alkoxycarbonyl group, a carbamoyl group, an electron donor group or the like. The electron donor group referred to here is preferably an alkoxy group, a hydroxy group (it may be protected with a silyl group), an amino group, an alkylamino group, an arylamino group, a sulfonamido group, an active methine group, a mercapto group, an alkylthio group or a phenyl group having any of these electron donor groups as a substituent.

When the organic group containing a carbon-carbon double bond moiety has a hydroxy group as a substituent in the above case, $Y^3$ contains the following partial structure: $>C^1{=}C^2(-OH)-$, and this may undergo tautomerization and thereby become the following partial structure: $>C^1H-C^2(=O)-$. Further, in this case, a compound in which the substituent substituting on the $C^1$ carbon is an electron-withdrawing group is also preferred. In this case, $Y^3$ has a partial structure of "active methylene group" or "active methine group". The electron-withdrawing group that can provide such a partial structure of active methylene group or active methine group may be the same as that mentioned in the explanation of the "active methine group" described above.

When $Y^3$ represents an organic group containing a carbon-carbon triple bond moiety having a substituent, the substituent is preferably an alkyl group, a phenyl group, an alkoxycarbonyl group, a carbamoyl group, an electron donor group or the like. The electron donor group referred to here is preferably an alkoxy group, an amino group, an alkylamino group, an arylamino group, a heterocyclylamino group, a sulfonamido group, an acylamino group, an active methine group, a mercapto group, an alkylthio group or a phenyl group having any of these electron donor groups as a substituent.

When $Y^3$ represents an organic group containing an aromatic group moiety, the aromatic group is preferably an aryl group (phenyl group is particularly preferred) or indole ring group having an electron donor group as a substituent. The electron donor group referred to here is preferably a hydroxy group (it may be protected with a silyl group), an alkoxy group, an amino group, an alkylamino group, an active methine group, a sulfonamido group or a mercapto group.

When $Y^3$ represents an organic group containing a benzo-condensed non-aromatic heterocyclic group moiety, the benzo-condensed non-aromatic heterocyclic group is preferably one containing an aniline structure in the molecule as a partial structure, and examples of such a group include indoline ring group, 1,2,3,4-tetrahydroquinoline ring group, 1,2,3,4-tetrahydroquinoxaline ring group, 4-quinolone ring group and so forth.

The reactive group represented by $Y^3$ in the formula (3-1) is more preferably an organic group containing a carbon-carbon double bond moiety, an aromatic group moiety or a benzo-condensed non-aromatic heterocyclic group, still more preferably a phenyl group or indole ring group containing a carbon-carbon double bond moiety and an electron donor group as a substituent or a benzo-condensed non-aromatic heterocyclic group containing an aniline structure in the molecule as a partial structure. The carbon-carbon double bond moiety more preferably has at least one electron donor group as a substituent.

A compound of the formula (3-1) in which the reactive group represented by $Y^3$ is selected from the range explained above and as a result, it has the same partial structure as the reducing group represented by $RED^3$ in the formula (3-1) is also a preferred example of the compound represented by the formula (3-1).

In the formula (3-1), $L^3$ represents a bridging group that links $RED^3$ and $Y^3$, and it is specifically each of a single bond, an alkylene group, an arylene group, a heterocyclic ring group, —O—, —S—, $-NR^N-$, —C(=O)—, $-SO_2-$, —SO— and —P(=O)— or a group consisting of a combination of these groups. $R^N$ represents a hydrogen atom, an alkyl group, an aryl group or a heterocyclic group. The bridging group represented by $L^3$ may have a substituent. As the substituent, those explained as substituents that $RED^{11}$ in the formula (1-1) may have can be mentioned. The bridging group represented by $L^3$ can be bonded at arbitrary positions on the groups represented by $RED^3$ and $Y^3$ in such a manner that $L^3$ should replace a hydrogen atom in each of the groups As for the group represented by $L^3$ in the formula (3-1), it is preferred that, when a cation radical species (X.) produced by oxidation of $RED^3$ in the formula (3-1) or a radical species ($X^+$.) produced therefrom with elimination of proton reacts with the reactive group represented by $Y^3$ in the formula (3-1) to form a bond, an atomic group involved in this reaction can form a 3- to 7-membered ring structure including $L^3$. For this, the radical species ($X^+$. or X.), the reactive group represented by $Y^3$ and $L^3$ are preferably linked with atomic groups containing 3–7 atoms.

Preferred examples of $L^3$ include a single bond, an alkylene group (especially methylene group, ethylene group, propylene group), an arylene group (especially phenylene group), a —C(═O)— group, a —O— group, a —NH— group, a —N(alkyl group)-group and a divalent bridging group consisting of a combination of these groups.

Among the compounds represented by the formula (3-1), preferred compounds are represented by following formulas (3-1-1) to (3-1-4).

Formula (3-1-1)

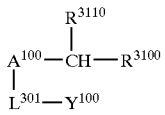

Formula (3-1-2)

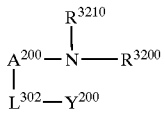

Formula (3-1-3)

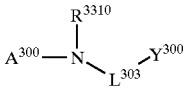

Formula (3-1-4)

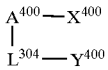

In the formulas (3-1-1) to (3-1-4), $A^{100}$, $A^{200}$ and $A^{400}$ represent an arylene group or a divalent heterocyclic group, and $A^{300}$ represents an aryl group or a heterocyclic group. Preferred ranges thereof are the same as that of the preferred range of $RED^3$ in the formula (3-1). $L^{301}$, $L^{302}$, $L^{303}$ and $L^{304}$ represent a bridging group. This bridging group represents a group having the same meaning as $L^3$ in the formula (3-1), and the preferred range thereof is also the same. $Y^{100}$, $Y^{200}$, $Y^{300}$ and $Y^{400}$ represent a reactive group. This reactive group represents a group having the same meaning as $Y^3$ in the formula (3-1), and the preferred range thereof is also the same. $R^{3100}$, $R^{3110}$, $R^{3200}$, $R^{3210}$ and $R^{3310}$ represent a hydrogen atom or a substituent. $R^{3100}$ and $R^{3110}$ preferably represent a hydrogen atom, an alkyl group or an aryl group. $R^{3200}$ and $R^{3310}$ preferably represent a hydrogen atom. $R^{3210}$ is preferably a substituent, and the substituent is preferably an alkyl group or an aryl group. $R^{3110}$ and $A^{100}$, $R^{3210}$ and $A^{200}$, and $R^{3310}$ and $A^{300}$ may bond to form a ring structure, respectively. The ring structure formed in this case is preferably tetralin ring, indan ring, tetrahydroquinoline ring, indoline ring or the like. $X^{400}$ represents a hydroxy group, a mercapto group or an alkylthio group, preferably a hydroxy group or a mercapto group, more preferably a mercapto group.

Among the compounds represented by the formula (3-1-1) to (3-1-4), more preferred compounds are compounds represented by the formula (3-1-2), (3-1-3) or (3-1-4), and further preferred compounds are compounds represented by the formula (3-1-2) or (3-1-3).

The compound of Type (iv) will be explained hereafter.

The compound of Type (iv) is a compound having a ring structure on which a reducing group substitutes, which can, after the reducing group undergoes one electron oxidation, further release one ore more electrons with a cleavage reaction of the ring structure.

In the compound of Type (iv), the ring structure is cleaved after the compound undergoes on electron oxidation. The cleavage reaction of the ring in this case referred to a reaction caused in the manner mentioned below.

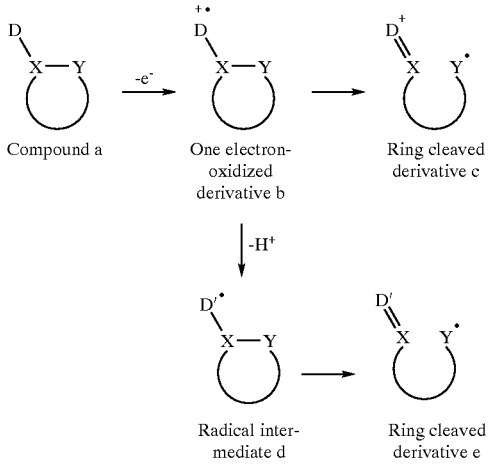

In the aforementioned formulas, Compound a represents a compound of Type (iv). In Compound a, D represents a reducing group, and X and Y represent atoms forming a bond to be cleaved after one electron oxidation in the ring structure. First, Compound a undergoes one electron oxidization to form One electron-oxidized derivative b. After that, the single bond of D—X becomes a double bond, and the bond of X—Y is simultaneously cleaved so that Ring cleaved derivative c is produced. Alternatively, Radical intermediate d may be produced from One electron-oxidized derivative b with elimination of proton, and Ring cleaved derivative e may be produced from Radical intermediate d in a similar manner. The compound is characterized in that one or more electrons are further released thereafter from Ring cleaved derivative c or e produced as described above.

The ring structure of the compound of Type (iv) is a 3- to 7-membered carbon ring or heterocyclic ring, and it may be a monocyclic or condensed ring saturated or unsaturated aromatic or non-aromatic ring. It is preferably a saturated ring structure, more preferably a 3- or 4-membered ring. Examples of preferred ring structures include cyclopropane ring, cyclobutane ring, oxirane ring, oxetane ring, aziridine ring, azetidine ring, episulfide ring and thietane ring. More preferred are cyclopropane ring, cyclobutane ring, oxirane ring, oxetane ring and azetidine ring, and particularly preferred are cyclopropane ring, cyclobutane ring and azetidine ring. The ring structure may have a substituent.

The compound of Type (iv) is preferably represented by the formula (4-1) or (4-2).

In the formulas (4-1) and (4-2), $RED^{41}$ and $RED^{42}$ each represent a group having the same meaning as $RED^{12}$ in the formula (1-2), and the preferred ranges thereof are also the same. $R^{40}$ to $R^{44}$ and $R^{45}$ to $R^{49}$ each represent a hydrogen atom or a substituent. Examples of the substituent are the same as those of substituent that $RED^{12}$ may have. In the formula (4-2), $Z^{42}$ represents —$CR^{420}R^{421}$—, —$NR^{423}$— or —O—. $R^{420}$ and $R^{421}$ each represent a hydrogen atom or a substituent, and $R^{423}$ represents a hydrogen atom, an alkyl group, an aryl group or a heterocyclic group.

In the formula (4-1), $R^{40}$ is preferably a hydrogen atom, an alkyl group, an alkenyl group, an alkynyl group, an aryl group, a heterocyclic group, an alkoxy group, an amino group, an alkylamino group, an arylamino group, a hetelocyclylamino group, an alkoxycarbonyl group, an acyl group, a carbamoyl group, a cyano group or a sulfamoyl group, more preferably a hydrogen atom, an alkyl group, an aryl group, a heterocyclic group, an alkoxy group, an alkoxycarbonyl group, an acyl group or a carbamoyl group, particularly preferably a hydrogen atom, an alkyl group, an aryl group, a heterocyclic group, an alkoxycarbonyl group or a carbamoyl group.

As for $R^{41}$ to $R^{44}$, it is preferred that at least one of them is a donor group, or both of $R^{41}$ and $R^{42}$ or both of $R^{43}$ and $R^{44}$ are electron-withdrawing groups. It is more preferred that at least one of $R^{41}$ to $R^{44}$ is a donor group. It is still more preferred that at least one of $R^{41}$ to $R^{44}$ is a donor group, and groups of $R^{41}$ to $R^{44}$ other than donor group are hydrogen atoms or alkyl groups.

The donor group referred to in this case is a group selected from the group consisting of a hydroxy group, an alkoxy group, an aryloxy group, a mercapto group, an acylamino group, a sulfonylamino group, an active methine group and groups preferred as $RED^{41}$ and $RED^{42}$. Preferably used as the donor group are an alkylamino group, an arylamino group, a hetelocyclylamino group, a 5-membered aromatic heterocyclic group containing one nitrogen atom in the ring (monocyclic ring or condensed ring), a non-aromatic nitrogen-containing heterocyclic group that substitutes at a nitrogen atom, a phenyl group substituted with at least one electron donor group (in this case, the electron donor group is a hydroxy group, an alkoxy group, an aryloxy group, an amino group, an alkylamino group, an arylamino group, a hetelocyclylamino group and a non-aromatic nitrogen-containing heterocyclic group that substitutes at a nitrogen atom). More preferably used are an alkylamino group, an arylamino group, a 5-membered aromatic heterocyclic group containing one nitrogen atom in the ring (in this case, the aromatic heterocyclic ring is indole ring, pyrrole ring or carbazole ring) and a phenyl group substituted with an electron donor group (especially a phenyl group substituted with three or more alkoxy groups or a phenyl group substituted with a hydroxy group, an alkylamino group or an arylamino group in this case). Particularly preferably used are an arylamino group, a 5-membered aromatic heterocyclic group containing one nitrogen atom in the ring (in this case, 3-indolyl group) and a phenyl group substituted with an electron donor group (especially a trialkoxyphenyl group or a phenyl group substituted with an alkylamino group or an arylamino group in this case). The electron-withdrawing group has the same meaning as that already explained in the explanation of the active methine group.

In the formula (4-2), the preferred range of $R^{45}$ is the same as that of $R^{40}$ of the aforementioned formula (4-1). Preferred as $R^{46}$ to $R^{49}$ are a hydrogen atom, an alkyl group, an alkenyl group, an alkynyl group, an aryl group, a heterocyclic group, a hydroxy group, an alkoxy group, an amino group, an alkylamino group, an arylamino group, a hetelocyclylamino group, a mercapto group, an arylthio group, an alkylthio group, an acylamino group and a sulfoneamino group, more preferred are a hydrogen atom, an alkyl group, an aryl group, a heterocyclic group, an alkoxy group, an alkylamino group, an arylamino group and a hetelocyclylamino group. Particularly preferred as $R^{46}$ to $R^{49}$ are a hydrogen atom, an alkyl group, an aryl group, a heterocyclic group, an alkylamino group and an arylamino group when $Z^{42}$ is a group represented as —$CR^{420}R^{421}$—, a hydrogen atom, an alkyl group, an aryl group and a heterocyclic group when $Z^{42}$ represents —$NR^{423}$—, or a hydrogen atom, an alkyl group, an aryl group and a heterocyclic group when $Z^{42}$ represents —O—.

$Z^{42}$ is preferably —$CR^{420}R^{421}$— or —$NR^{423}$—, more preferably —$NR^{423}$—. $R^{420}$ and $R^{421}$ preferably represent a hydrogen atom, an alkyl group, an alkenyl group, an alkynyl group, an aryl group, a heterocyclic group, a hydroxy group, an alkoxy group, an amino group, a mercapto group, an acylamino group or a sulfoneamino group, more preferably a hydrogen atom, an alkyl group, an aryl group, a heterocyclic group, an alkoxy group or an amino group. $R^{423}$ preferably represents a hydrogen atom, an alkyl group, an aryl group or an aromatic heterocyclic group, more preferably methyl group, ethyl group, isopropyl group, tert-butyl group, tert-amyl group, benzyl group, diphenylmethyl group, allyl group, phenyl group, naphthyl group, 2-pyridyl group, 4-pyridyl group or 2-thiazolyl group.

When each of $R^{40}$ to $R^{49}$, $R^{420}$, $R^{421}$ and $R^{423}$ is a substituent, each preferably has a total carbon atom number of 40 or less, more preferably 30 or less, particularly preferably 15 or less. Moreover, these substituents may bond to each other or to another moiety in the molecule ($RED^{41}$, $RED^{42}$ or $Z^{42}$) to form a ring.

Each of the compounds of Types (i), (iii) and (iv) is preferably "a compound having a group adsorptive to silver halide in the molecule" or "a compound having a partial structure of a spectral sensitization dye in the molecule". Each of the compounds of Types (i), (iii) and (iv) is more preferably "a compound having a group adsorptive to silver halide in the molecule". The compound of Type (ii) is "a compound having two or more groups adsorptive to silver halide in the molecule". Each of the compounds of Types (i) to (iv) is more preferably "a compound having two or more nitrogen-containing heterocyclic groups substituted with a mercapto group as groups adsorptive to silver halide in the molecule".

The group adsorptive to silver halide contained in the compounds of Types (i) to (iv) is a group directly adsorbing to silver halide or a group accelerating adsorption to silver halide. It is specifically a mercapto group (or a salt thereof), a thione group (—C(=S)—), a heterocyclic group containing at least one atom selected from a nitrogen atom, sulfur atom, selenium atom and tellurium atom, a sulfide group, a cationic group or an ethynyl group. However, the compound of Type (ii) does not contain a sulfide group as an adsorptive group.

The mercapto group (or a salt thereof) as the adsorptive group more preferably means, besides mercapto group (or a salt thereof) itself, a heterocyclic group, aryl group or alkyl group substituted with at least one mercapto group (or salt thereof). The heterocyclic group in this case is a 5- to 7-membered monocyclic or condensed ring aromatic or non-aromatic heterocyclic group. Examples thereof are, for example, imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group, triazine ring group and so forth. Moreover, it may be a heterocyclic group containing a quaternized nitrogen atom. In this case, the substituting mercapto group may be dissociated to serve as a meso ion. Examples of such a heterocyclic group include imidazolium ring group, pyrazolium ring group, thiazolium ring group, triazolium ring group, tetrazolium ring group, thiadiazolium ring group, pyridinium ring group, pyrimidinium ring group, triazinium ring group and so forth, and a triazolium ring group (e.g., 1,2,4-triazolium-3-thiolate ring group) is especially preferred. As the aryl group, phenyl group and naphthyl group can be mentioned. As the alkyl group, a straight, branched or cyclic alkyl group having 1–30 carbon atoms can be mentioned. When the mercapto group forms a salt, the counter ion may be a cation of an alkali metal, alkaline earth metal or heavy metal ($Li^+$, $Na^+$, $K^+$, $Mg^{2+}$, $Ag^+$, $Zn^{2+}$ etc.), an ammonium ion, a heterocyclic group containing a quaternized nitrogen atom, a phosphonium ion or the like.

Further, the mercapto group as the adsorptive group may undergo tautomerization and thereby become a thione group, specifically, a thioamido group (—C(═S)—NH— group in this case) or a group containing a partial structure of the thioamide group, i.e., a straight or cyclic thioamido group, thioureido group, thiourethane group, dithiocarbamic acid ester group or the like. Examples of such a cyclic group include thiazolidine-2-thione group, oxazolidine-2-thione group, 2-thiohydantoin group, rhodanine group, isorhodanine group, thiobarbituric acid group, 2-thioxo-oxazolidin-4-one group and so forth.

The thione group as the adsorptive group include, besides the thione group derived from a mercapto group by tautomerization, a straight or cyclic thioamido group, thioureido group, thiourethane group and dithiocarbamic acid ester group that cannot be converted into a mercapto group by tautomerization, i.e., that do not have a hydrogen atom at the a-position of the thione group.

The heterocyclic group containing at least one atom selected from a nitrogen atom, sulfur atom, selenium atom and tellurium atom as the adsorptive group is a nitrogen-containing heterocyclic group having a —NH— group that can form imino silver (>NAg) as a partial structure of the heterocyclic ring, or a heterocyclic group having a —S— group, —Se— group, —Te— group or ═N— group that can coordinate with a silver ion via a coordinate bond as a partial structure of the heterocyclic ring. Examples of the former include benzotriazol group, triazole group, indazole group, pyrazole group, tetrazole group, benzimidazole group, imidazole group, purine group and so forth. Examples of the latter include thiophene group, thiazole group, oxazole group, benzothiazole group, benzoxazole group, thiadiazole group, oxadiazole group, triazine group, selenazole group, benzoselenazole group, tellurazole group, benzotellurazole group and so forth. The former is preferred.

The sulfide group as the adsorptive group may be any group having a partial structure of —S—. However, it is preferably a group having a partial structure of (alkyl or alkylene)-S-(alkyl or alkylene), (aryl or arylene)-S-(alkyl or alkylene) or (aryl or arylene)-S-(aryl or arylene). Further, these sulfide groups may form a ring structure or form a —S—S— group. Specific examples of the group forming a ring structure include groups containing thiolane ring, 1,3-dithiolane ring, 1,2-dithiolane ring, thiane ring, dithiane ring, tetrahydro-1,4-thiazine ring (thiomorpholine ring) or the like. Particularly preferred sulfide groups are groups having a partial structure of (alkyl or alkylene)-S-(alkyl or alkylene).

The cationic group as the adsorptive group means a group containing a quaternized nitrogen atom, specifically a group containing a nitrogen-containing heterocyclic group that contains an ammonio group or quaternized nitrogen atom. However, the cationic group does not constitute a part of atomic group forming a dye structure (e.g., cyanine chromophore). Examples of the ammonio group include a trialkylammonio group, a dialkylarylammonio group, an alkyldiarylammonio group and so forth, specifically, benzyldimethylammonio group, trihexylammonio group, phenyldiethylammonio group and so forth. Examples of the nitrogen-containing heterocyclic group containing a quaternized nitrogen atom include, for example, pyridinio group, quinolinio group, isoquinolinio group, imidazolio group and so forth. Preferred are pyridinio group and imidazolio group, and particularly preferred is pyridinio group. The nitrogen-containing heterocyclic group containing a quaternized nitrogen atom may have an arbitrary substituent. However, preferred substituents for pyridinio group and imidazolio group are an alkyl group, an aryl group, an acylamino group, a chlorine atom, an alkoxycarbonyl group, a carbamoyl group and so forth. A particularly preferred substituent for pyridinio group is a phenyl group.

The ethynyl group as the adsorptive group means a —C≡CH group, and the hydrogen atom may be substituted.

The aforementioned adsorptive groups may have an arbitrary substituent.

As specific examples of the adsorptive group, those disclosed in JP-A-11-95355, pages 4–7 can be further mentioned.

Preferred as the adsorptive group in the present invention are a mercapto-substituted nitrogen-containing heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group, 1,5-dimethyl-1,2,4-triazolium-3-thiolate group etc.) or a nitrogen-containing heterocyclic group having a —NH-group that can form imino silver (>NAg) as a partial structure of the heterocyclic ring (e.g., benzotriazol group, benzimidazole group, indazole group etc.). Particularly preferred are 5-mercaptotetrazole group, 3-mercapto-1,2,4-triazole group and benzotriazole group, and the most preferred are 3-mercapto-1,2,4-triazole group and 5-mercaptotetrazole group.

Among the compounds used in the present invention, those compounds having two or more mercapto groups as partial structures in the molecules are also particularly preferred compounds. The mercapto group (—SH) may become thione group when it can undergo tautomerization. Such a compound may be, for example, a compound having two or more of adsorptive groups having a mercapto group or thione group as partial structures described above (e.g., a ring-forming thioamide group, a carcaptoalkyl group, a mercaptoaryl group, a heterocyclic group having a mercapto group etc.) in the molecule or a compound having one or more adsorptive groups each having two or more mercapto groups or thione groups as partial structures (e.g., dimercapto-substituted nitrogen-containing heterocyclic group).

Examples of the adsorptive group having two or more mercapto groups as partial structures (dimercapto-substituted nitrogen-containing heterocyclic group etc.) include 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo(1,5-A)-pyrimidine group, 2,6,8-trimercaptopurine group, 6,8-dimercaptopurine group, 3,5,7-trimercapto-s-triazolotriazine group, 4,6-dimercaptopyrazolopyrimidine group, 2,5-dimercaptoimidazole group and so forth, and 2,4-dimercaptopyrimidine group, 2,4-dimercaptotriazine group and 3,5-dimercapto-1,2,4-triazole group are particularly preferred.

Although the adsorptive group may substitute at any position in the compounds of the formulas (1-1) to (4-2), it preferably exists on $RED^{11}$, $RED^{12}$, $RED^{2}$ or $RED^{3}$ in the compounds of the formulas (1-1) to (3-1), on $RED^{41}$, $R^{41}$, $RED^{42}$ or any of $R^{46}$ to $R^{48}$ in the compounds of the formulas (4-1) and (4-2), or on a group other than $R^{1}$, $R^{2}$, $R^{11}$, $R^{12}$, $R^{31}$, $L^{1}$, $L^{21}$ and $L^{31}$ in the compounds of the formulas (1-3) to (1-5), and it more preferably exists on any of $RED^{11}$ to $RED^{42}$ for all of the compounds of the formulas (1-1) to (4-2).

The partial structure of spectral sensitization dye is a group containing a chromophore of spectral sensitization dye, and it is a residue obtained by removing an arbitrary hydrogen atom or substituent from a spectral sensitization dye compound. Although the partial structure of spectral sensitization dye may substitute at any position in the compounds of the formulas (1-1) to (4-2), it preferably exists on $RED^{11}$, $RED^{12}$, $RED^{2}$ or $RED^{3}$ in the compounds of the formulas (1-1) to (3-1), on $RED^{41}$, $R^{41}$, $RED^{42}$ or any of $R^{46}$ to $R^{48}$ in the compounds of the formulas (4-1) and (4-2) or on a group other than $R^{1}$, $R^{2}$, $R^{11}$, $R^{12}$, $R^{31}$, $L^{1}$, $L^{21}$ and $L^{31}$ in the compounds of the formulas (1-3) to (1-5), and it more preferably exists on any of $RED^{11}$ to $RED^{42}$ for all of the compounds of the formulas (1-1) to (4-2). Preferred spectral sensitization dyes are spectral sensitization dyes typically used in color sensitization techniques, and include, for example, cyanine dyes, complex cyanine dyes, melocyanine dyes, complex melocyanine dyes, homopolar cyanine dyes, stilyl dyes and hemicyanine dyes. Typical spectral sensitization dyes are disclosed in Research Disclosure, Item 36544, September, 1994. Those skilled in the art can synthesize these dyes according to the procedures described in Research Disclosure (supra) or F. M. Hamer, The Cyanine dyes and Related Compounds (Interscience Publishers, New York, 1964). Further, all the dyes disclosed in JP-A-11-95355 (U.S. Pat. No. 6,054,260), pages 7–14 can be used as they are.

The compounds of Types (i) to (iv) preferably have a total carbon number of 10–60, more preferably 10–50, still more preferably 11–40, particularly preferably 12–30.

The compounds of Types (i) to (iv) undergo one electron oxidization, which is triggered by light exposure of photothermographic material containing them, then after a subsequent reaction, further release one electron or two or more electrons depending on the type of the compounds and thereby oxidized. The oxidation potential for the first electron is preferably about 1.4 V or lower, more preferably 1.0 V or lower. This oxidation potential is preferably higher than 0 V, more preferably higher than 0.3 V. Therefore, the oxidation potential is preferably about 0 to about 1.4 V, more preferably about 0.3 V to about 1.0 V.

The oxidation potential referred to herein can be measured by a technique of cyclic voltammetry. Specifically, a sample is dissolved in a solution of acetonitrile:water (containing 1.0 M lithium perchlorate)=80%:20% (volume %), nitrogen gas is bubbled in the solution for 10 minutes, and then the potential is measured by using a glassy carbon disk for a working electrode, a platinum line for a counter electrode and a calomel electrode (SCE) for a reference electrode at 25° C. and a potential scanning rate of 0.1 V/second. A ratio of oxidation potential and SCE is measured when a cyclic voltammetry wave showed a peak potential.

When the compounds of Types (i) to (iv) consist of a compound that undergoes one electron oxidation and then after a subsequent reaction, further releases one electron, the oxidation potential for the latter oxidation is preferably −0.5 to −2 V, more preferably −0.7 V to −2 V, still more preferably −0.9 to −1.6 V.

When the compounds of Types (i) to (iv) consist of a compound that undergoes one electron oxidation, then after a subsequent reaction, further releases two or more electron and is thereby oxidized, the oxidation potential for the latter oxidation is not particularly limited. This is because, in many cases, oxidation potential for the second electron and those of the third and subsequent electrons cannot be clearly distinguished and thus they cannot be accurately measured.

Specific examples of the compounds of Types (i) to (iv) are listed below. However, the compounds of Types (i) to (iv) that can be used for the present invention are not limited to these.

1

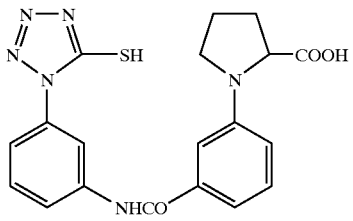

2

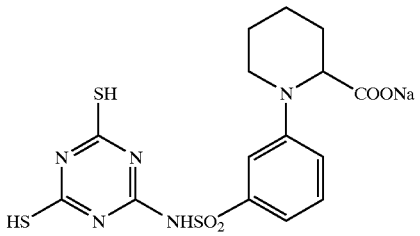

3

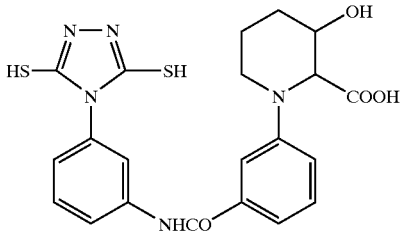

4

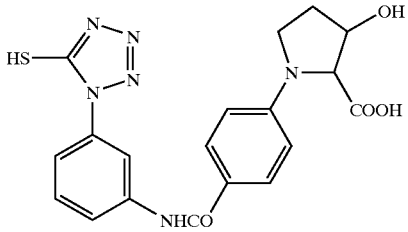

-continued
5
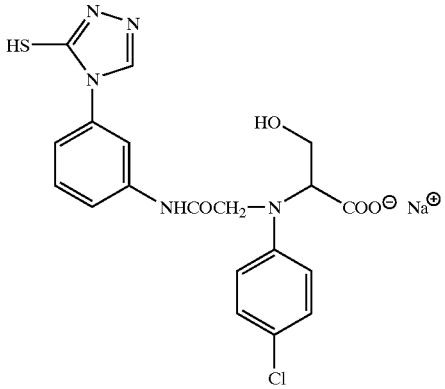
6
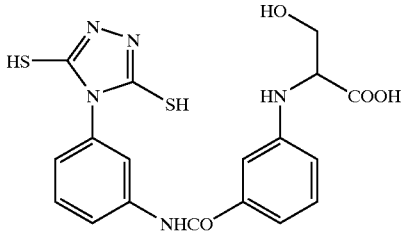
7
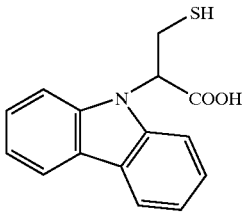
8
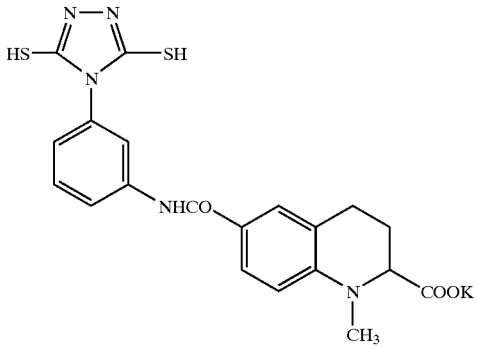
9
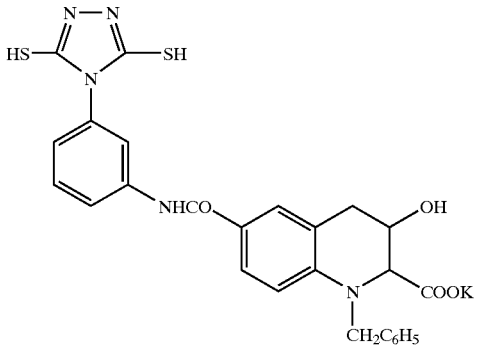
10
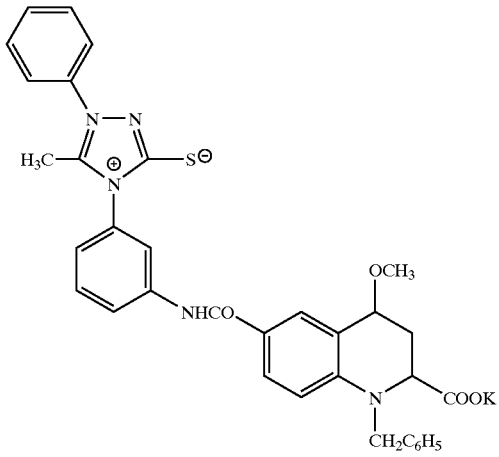
11
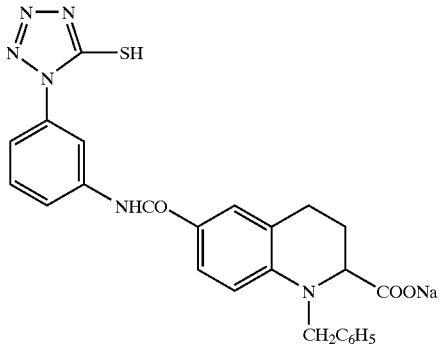
12
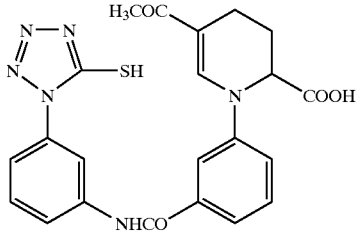

-continued
13
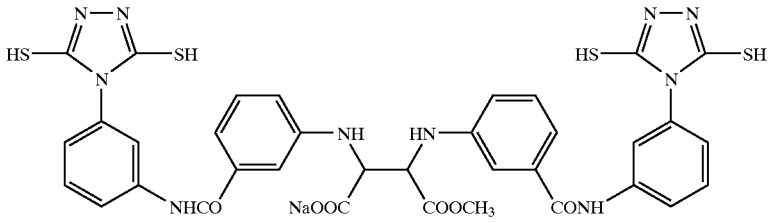
14
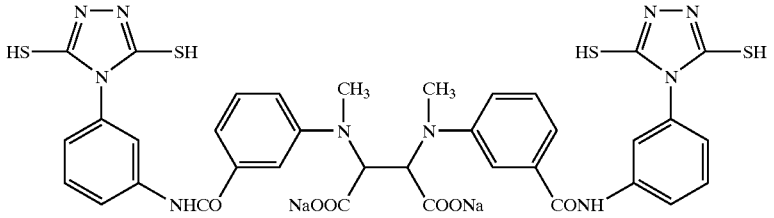
16
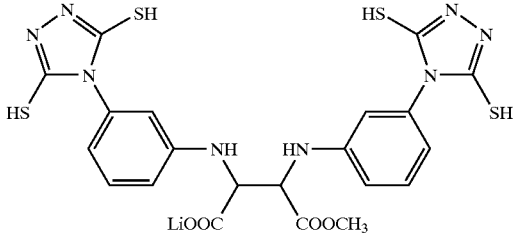
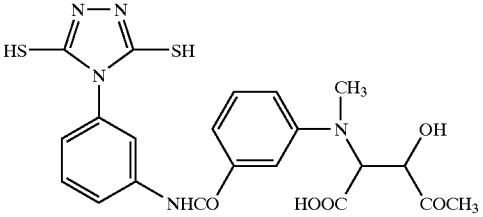
17
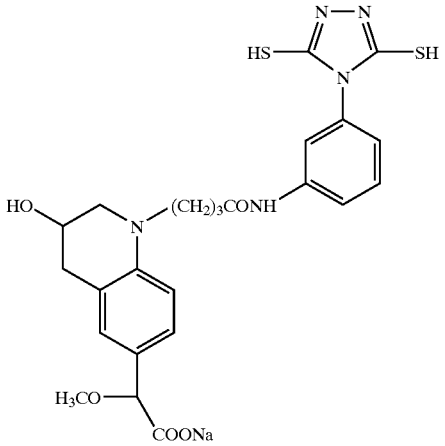
18
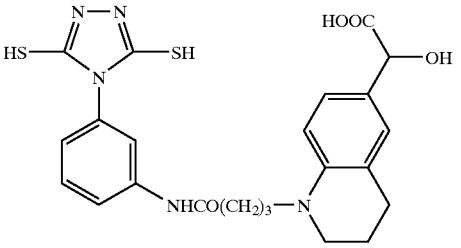
19
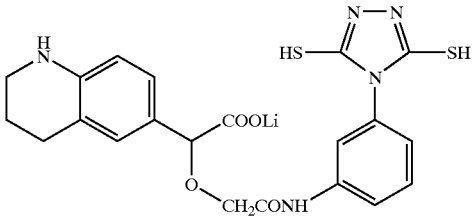
20
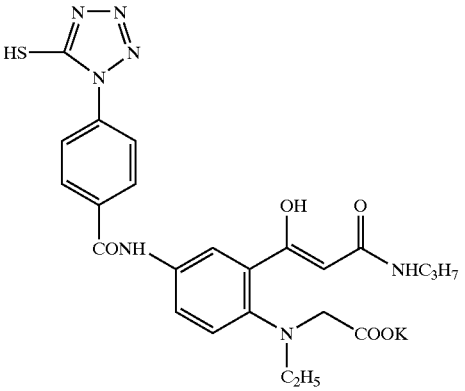

-continued
21
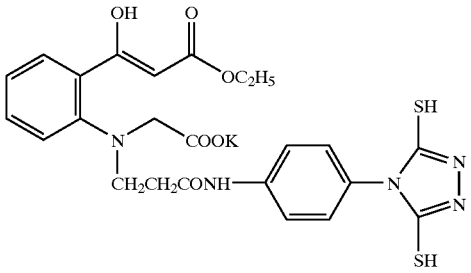
22
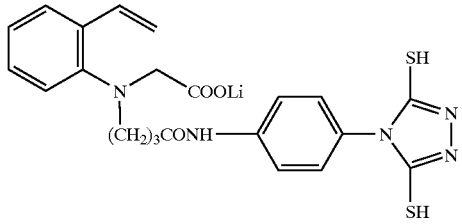
23
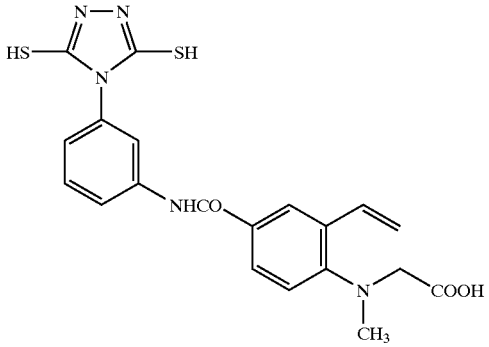
24
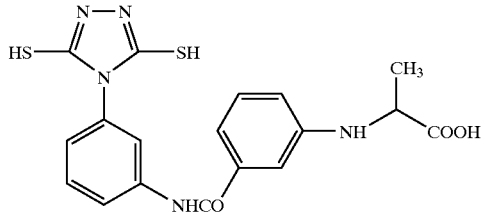
25
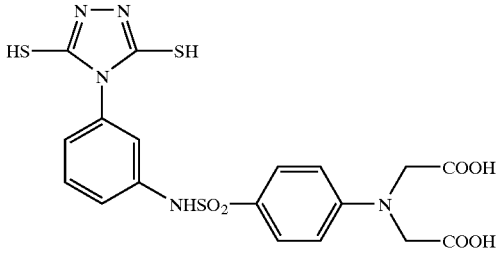
26
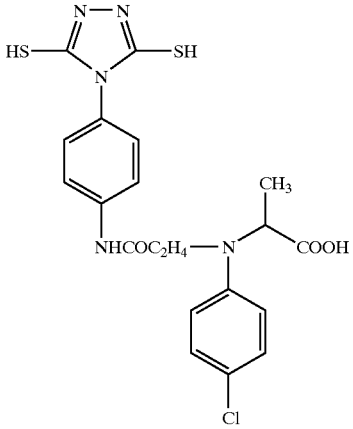
27
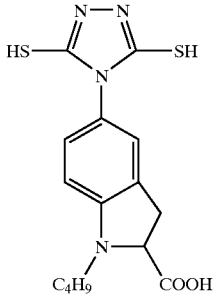
28
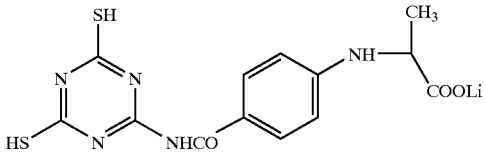

-continued
29
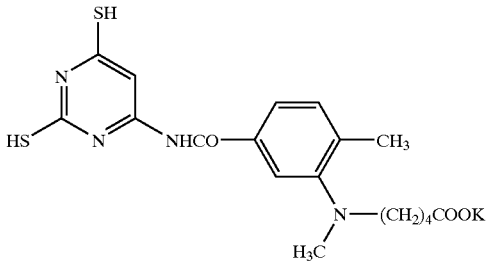
30
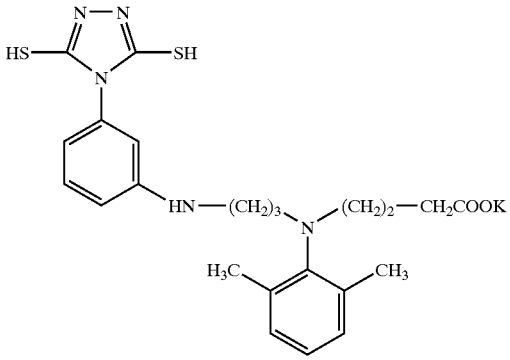
31
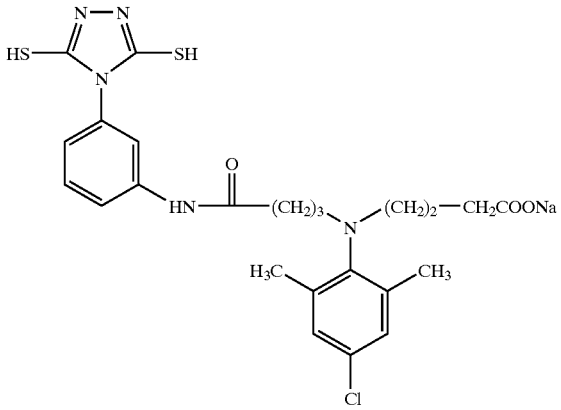
32
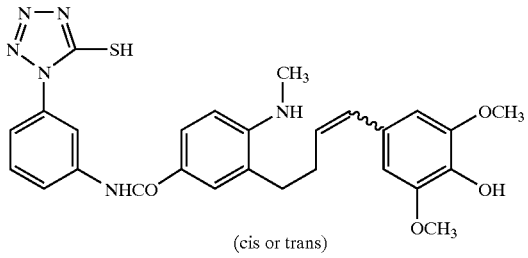
33
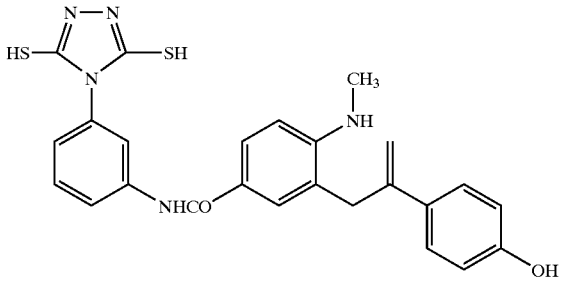
34
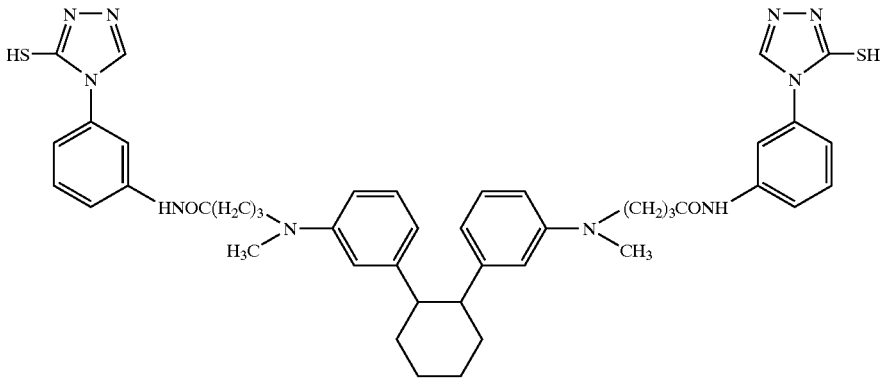

-continued
35
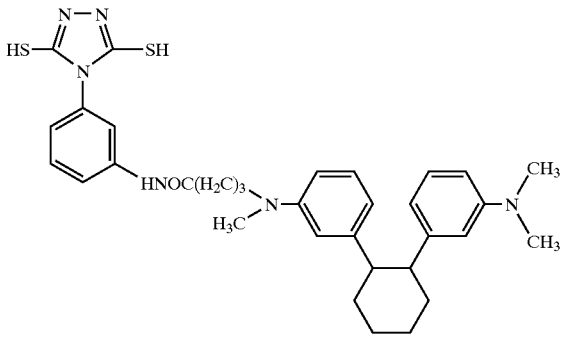
36
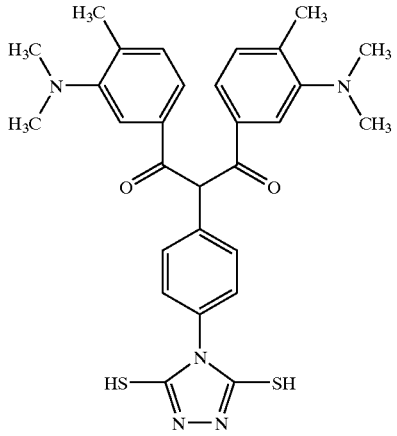
37
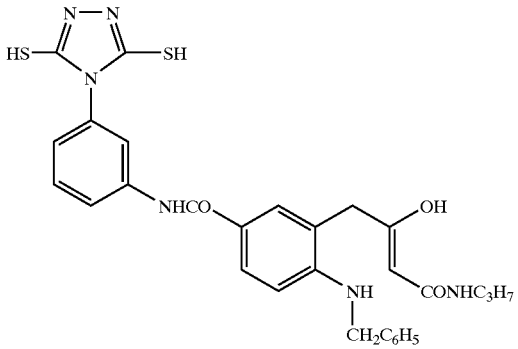
38
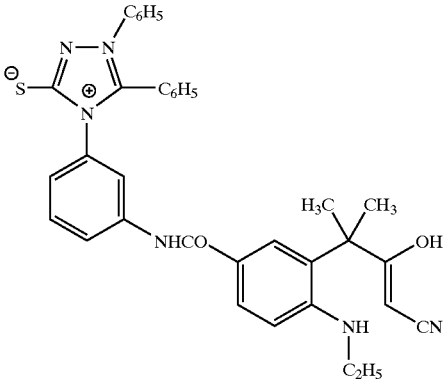
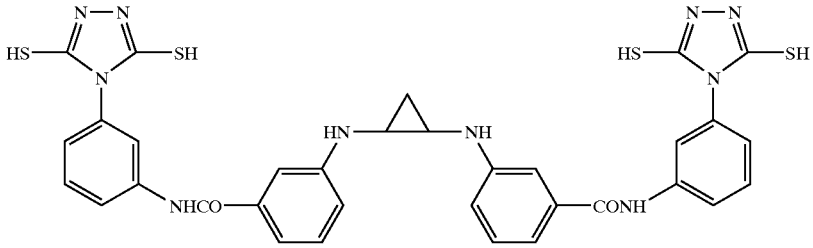
40
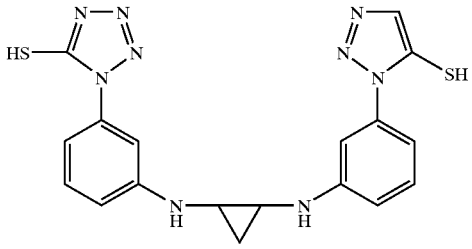
42
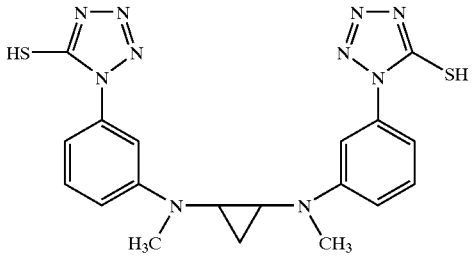
41
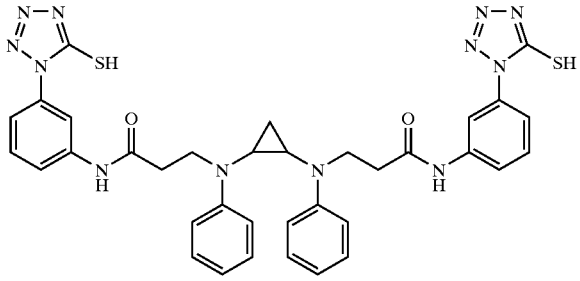
43
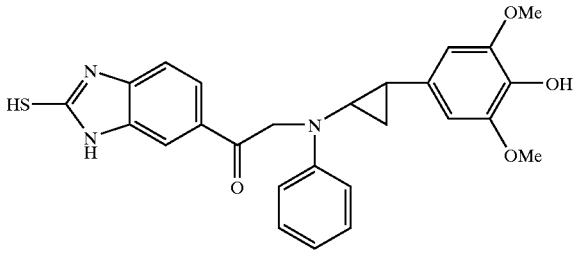

-continued
44
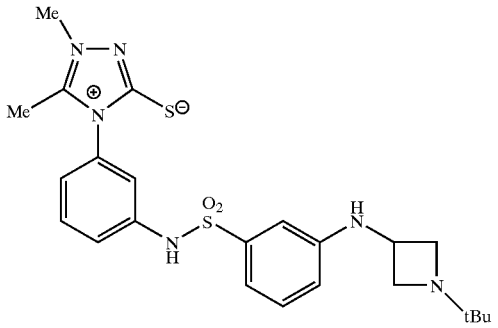
45
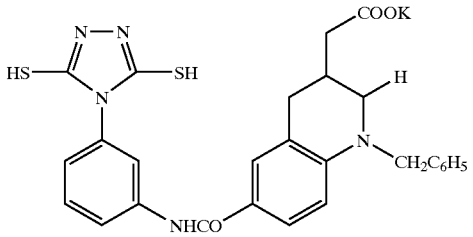
46
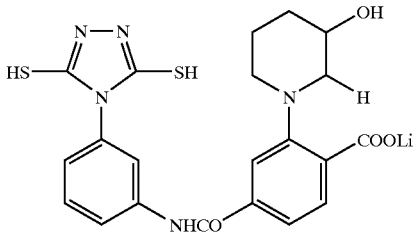
47
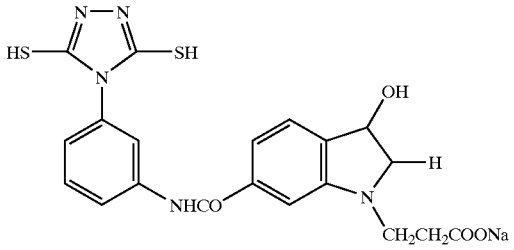
48
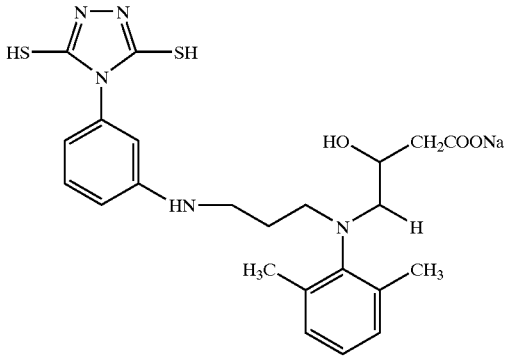
49
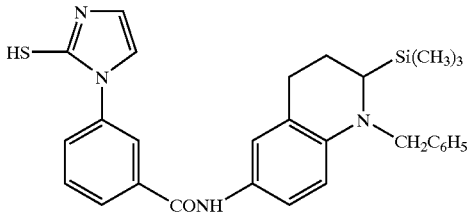
50
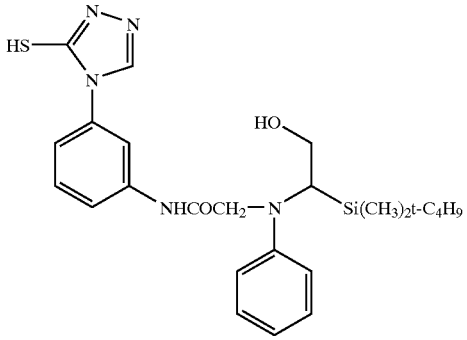
51
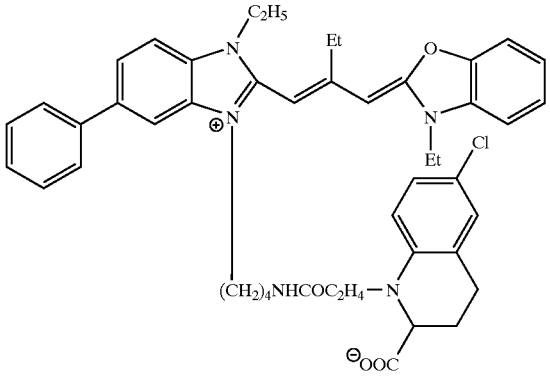
52
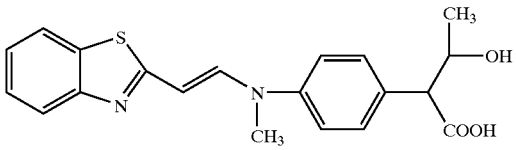
53
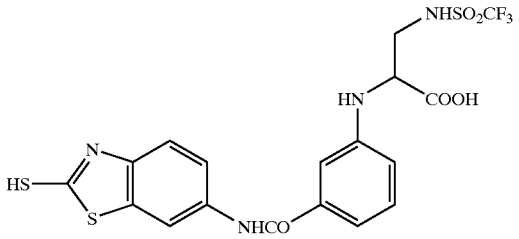

-continued

54

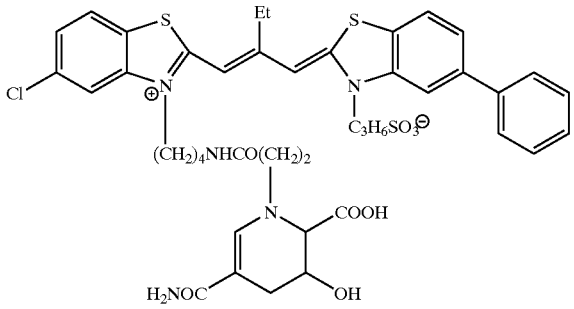

55

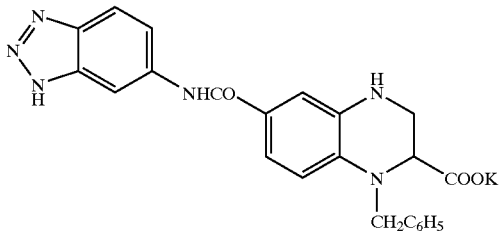

56

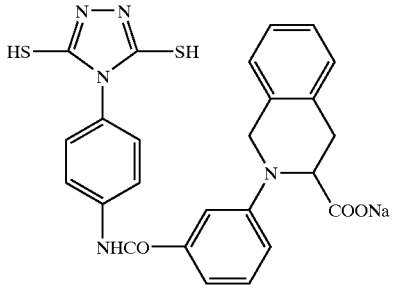

57

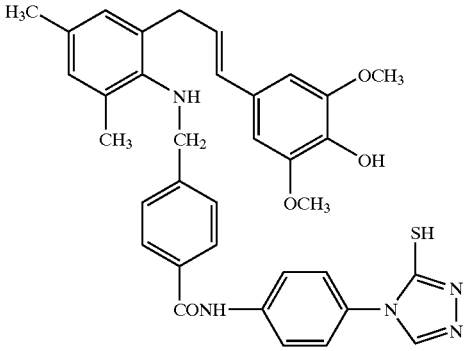

58

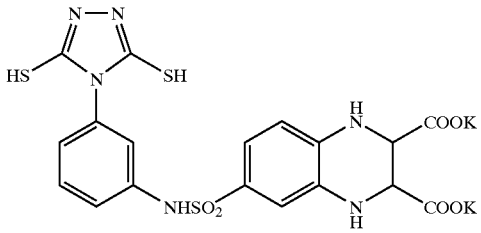

59

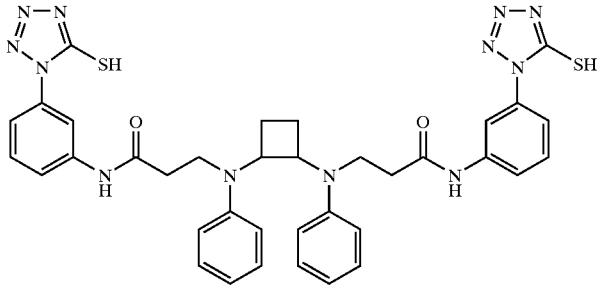

The compounds of Types (i) to (iv) are the same as those explained in detail in Japanese Patent Application Nos. 2002-192373, 2002-188537, 2002-188536 and 2001-272137, respectively. The specific exemplary compounds mentioned in these patent applications can also be mentioned as specific examples of the compounds of Types (i) to (iv) of the present invention. Further, synthesis examples of the compounds of Types (i) to (iv) of the present invention are similar to those described in these patent applications.

The compounds of Types (i) to (iv) can be added at any time during the emulsion preparation process or production process of the photothermographic material. For example, they may be added during grain formation, desalting process, chemical sensitization, before coating etc. They can also be dividedly added at multiple times during these processes. The addition time is preferably after completion of the grain formation and before the desalting process, during chemical sensitization (from immediately before the start of chemical sensitization to immediately after completion thereof) or before coating, and they are more preferably added during chemical sensitization or before coating.

The compounds of Types (i) to (iv) are preferably added after being dissolved in water, a water-soluble solvent such as methanol and ethanol or a mixed solvent thereof. When they are dissolved in water, a compound of which solubility is increased by increasing or decreasing pH may be dissolved with increase or decrease of pH and the obtained solution may be added.

The compounds of Types (i) to (iv) are preferably used in an image-forming layer. However, they may be added to a protective layer or intermediate layer in addition to the image-forming layer and allowed to diffuse during coating. The compounds of Types (i) to (iv) may be added before or after addition of the sensitizing dye, and each of them is preferably added to a silver halide emulsion layer in an amount of $1\times10^{-9}$ to $5\times10^{-2}$ mol, more preferably $1\times10^{-8}$ to $2\times10^{-3}$ mol, per one mole of silver halide.

The silver salt of an organic acid used for the photothermographic material of the present invention is a reducible silver source, and it is a silver salt that is relatively stable against light, but forms a silver image when it is heated at 80° C. or higher in the presence of an exposed photocatalyst (e.g., a latent image of photosensitive silver halide) and a reducing agent. Silver salts of an organic acid or heteroorganic acid containing a reducible silver ion source, in particular, silver salts of long-chain (10–30, preferably 15–25 carbon atoms) aliphatic carboxylic acids and heteroorganic acids containing a nitrogen-containing heterocyclic ring are preferred. Organic or inorganic silver salt complexes having a total ligand stability constant of 4.0–10.0 with respect to silver ion are also useful.

Preferred examples of silver salts are described in Research Disclosure (henceforth abbreviated as "RD") Nos. 17029 and 29963 and include the followings: salts of organic acids (e.g., salts of gallic acid, oxalic acid, behenic acid, arachidic acid, stearic acid, palmitic acid, lauric acid); silver salts of carboxyalkylthioureas (e.g., 1-(3-carboxypropyl) thiourea, 1-(3-carboxypropyl)-3,3-dimethylthiourea etc.); silver complexes of polymerization product of aldehydes (e.g., formaldehyde, acetaldehyde, butylaldehyde) with hydroxy-substituted aromatic carboxylic acid (e.g., salicylic acid, benzoic acid, 3,5-dihydroxybenzoic acid, 5,5-thiodisalicylic acid); silver salts or complexes of thioenes (e.g., 3-(2-carboxyethyl)-4-hydroxymethyl-4-thiazoline-2-thione, 3-carboxymethyl-4-thiazoline-2-thione); silver complexes or salts of nitrogenic acid selected from the group consisting of imidazole, pyrazole, urazole, 1,2,4-thiazole, 1H-tetrazole, 3-amino-5-benzylthio-1,2,4-triazole and benzotriazole; silver salts of saccharin, 5-chlorosalicylaldoxim etc.; and silver salts of mercaptides. Among these, preferred silver sources are silver behenate, silver arachidate and/or silver stearate and a mixture thereof.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used.

As silver salts of an organic acid other than silver behenate contained in the silver salts of organic acid used for the present invention, the silver salts of an organic acid exemplified above can preferably be used.

The silver salt of an organic acid can be obtained by mixing a water-soluble silver compound with a compound that form a complex with silver, and the forward mixing method, reverse mixing method, simultaneous mixing method, controlled double jet method as disclosed in JP-A-9-127643 and so forth are preferably used. For example, an organic acid can be added with an alkali metal salt (e.g., sodium hydroxide, potassium hydroxide etc.) to produce an organic acid alkali metal salt soap (e.g., sodium behenate, sodium arachidate etc.) and then the soap and silver nitrate or the like can be added by the controlled double jet method to prepare crystals of silver salt of an organic acid. At that time, silver halide grains may be mixed.

Silver salts of an organic acid that can be preferably used for the present invention can be prepared by allowing a solution or suspension of an alkali metal salt (e.g., Na salt, K salt, Li salt) of the aforementioned organic acids to react with silver nitrate. As the preparation method, the method mentioned in JP-A-2000-292882, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method mentioned in JP-A-2001-33907 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in JP-A-2000-305214, paragraph 0052.

The silver salt of an organic acid for use in the present invention is preferably prepared in the presence of a tertiary alcohol. The tertiary alcohol preferably has a total carbon number of 15 or less, particularly preferably 10 or less. Examples of preferred tertiary alcohols include tert-butanol. However, tertiary alcohol that can be used for the present invention is not limited to it.

The tertiary alcohol used for the present invention may be added at any time during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in any amount of 0.01–10 in terms of the weight ratio to water used as a solvent for the preparation of the silver salt of an organic acid, but preferably added in an amount of 0.03–1 in terms of weight ratio to water.

Although shape and size of the organic acid silver salt are not particularly limited, those mentioned in JP-A-2000-292882, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by volume weight average diameter (variation coefficient) is preferably 80% or less, more preferably 50% or less, particularly preferably 30% or less. As a measurement method, for example, the grain size can be determined by irradiating organic acid silver salt dispersed in a liquid with a laser ray and determining an autocorrelation function for change of fluctuation of the scattered light with time (volume weight average diameter). The average grain size determined by this method is preferably from 0.05–10.0 $\mu$m, more preferably from 0.1–5.0 $\mu$m, further preferably from 0.1–2.0 $\mu$m, as in solid microparticle dispersion.

The silver salt of an organic acid used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method mentioned in JP-A-2000-305214 can be used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in JP-A-2000-292882, paragraphs 0027–0038 can be used.

The grain size distribution of the silver salt of an organic acid preferably corresponds to monodispersion. Specifically, the percentage (variation coefficient) of the value obtained by dividing a standard deviation of volume weight average diameter by volume weight average diameter is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of 0.1–5 g/m$^2$, more preferably 1–3 g/m$^2$, particularly preferably 1–1.6 g/m$^2$, in terms of silver.

In the present invention, ions of metal selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt that is not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not a halide compound.

The ions of metal selected from Ca, Mg, Zn and Ag, which are preferably used in the present invention, may be added at any time after the formation of the non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the ions of metal selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The photosensitive silver halide used for the present invention is not particularly limited as for the halogen composition, and silver chloride, silver chlorobromide, silver bromide, silver iodobromide, silver chloroiodobromide and so forth may be used. Silver chlorobromide, silver bromide and silver iodobromide are preferred. As for the preparation of grains of the photosensitive silver halide emulsion, the grains can be prepared by the method described in JP-A-11-119374, paragraphs 0217-0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halogen composition may have a uniform distribution in the grains for the internal portion and surface portion, or the composition may change stepwise or continuously in the grains. When silver halide grains having a core/shell structure is used, preferred are core/shell grains having preferably a double to quintuple structure, more preferably a double to quadruple structure. A technique for localizing silver bromide on the surfaces of silver chloride or silver chlorobromide grains may also be used. However, distribution of halogen composition is preferably uniform for the internal portion and surface portion.

The grain size of the silver halide grains of the photosensitive silver halide used in the present invention is not particularly limited. However, the grain size is preferably 0.12 μm or less, more preferably 0.01–0.10 μm. As for the grain size distribution of the silver halide grains that can be used in the present invention, the grains show monodispersion degree of 30% or less, preferably 1–20%, more preferably 5–15%. The monodispersion degree used herein is defined as a percentage (%) of a value obtained by dividing standard deviation of grain size with average grain size (variation coefficient). The grain size of the silver halide grains is represented as a ridge length for cubic grains, or a diameter as circle of projected area for the other grains (octahedral grains, tetradecahedral grains and so forth) for convenience.

The photosensitive silver halide grains that can be used in the present invention preferably contain a metal of Group VII or Group VIII in the periodic table of elements or a complex of such a metal. The metal of Group VII or Group VIII of the periodic table as the aforementioned metal or center metal of the complex is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation.

The photosensitive silver halide emulsion used for the present invention is preferably sensitized by chemical sensitization. For the chemical sensitization, the method described in JP-A-11-119374, paragraphs 0242–0250 is preferably used.

Silver halide emulsions used in the present invention are preferably added with thiosulfonic acid compounds by the method described in EP293917A1.

As gelatin mixed with the photosensitive silver halide used in the present invention, low molecular weight gelatin is preferably used in order to maintain good dispersion state of the photosensitive silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, modified gelatin such as alkali-treated gelatin, acid-treated gelatin and phthalated gelatin is usually used. However, modified gelatin such as alkali-treated gelatin and phthalated gelatin is preferred.

As for the photosensitive silver halide emulsion used in the photosensitive material of the present invention, one kind of photosensitive silver halide emulsion may be used or two or more different emulsions (for example, those having different average grain sizes, different halogen compositions, different crystal habits or those subjected to chemical sensitization under different conditions) may be used in combination. However, one kind of silver halide emulsion is preferably used in the present invention.

The amount of the photosensitive silver halide used in the present invention per mole of the silver salt of an organic acid is preferably from 0.01–0.5 mole, more preferably from 0.02–0.3 mole, still more preferably from 0.03–0.25 mole. As methods and conditions for mixing photosensitive silver halide and silver salt of an organic acid, which are prepared separately, there are, for example, a method of mixing silver halide grains and silver salt of an organic acid after completion of respective preparations by using a high-speed stirring machine, ball mill, sand mill, colloid mill, vibrating mill, homogenizer or the like, a method of preparing a silver salt of an organic acid with mixing a photosensitive silver halide obtained separately at any time during the preparation of the silver salt of an organic acid and so forth. For the mixing of them, mixing of two or more kinds of aqueous dispersions of the silver salt of an organic acid and two or more kinds of aqueous dispersions of the photosensitive silver salt is preferably used for controlling photographic properties. In the present invention, separately prepared photosensitive silver halide and silver salt of an organic acid are preferably mixed in a propeller stirrer at a low speed (100–200 rpm).

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550 nm to 750 nm, there can be mentioned the compounds of formula (II) described in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750 nm to 1400 nm, there can be mentioned the compounds of the general formula (I) described in JP-A-11-119374, and more specifically, dyes of (25), (26), (30), (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination. However, they are preferably used each alone in the present invention.

These sensitizing dyes can be added by the method described in JP-A-11-119374, paragraph 0106. However, they are preferably added after being dissolved in ethanol or methanol.

While the amount of the sensitizing dye used in the present invention may be selected to be a desired amount depending on the performance including sensitivity and fog, it is preferably used in an amount of $10^{-6}$ to 1 mole, more preferably $10^{-4}$ to $10^{-1}$ mole, per mole of silver halide in the image-forming layer.

In the present invention, a supersensitizer is preferably used in order to improve spectral sensitization efficiency. Examples of the supersensitizer used for the present invention include the compounds disclosed in EP587338A, U.S. Pat. Nos. 3,877,943 and 4,873,184, and compounds selected from heteroaromatic or aliphatic mercapto compounds, heteroaromatic disulfide compounds, stilbenes, hydrazines, triazines and so forth.

Particularly preferred supersensitizers are heteroaromatic mercapto compounds and heteroaromatic disulfide compounds disclosed in JP-A-5-341432, the compounds represented by the formulas (I) and (II) mentioned in JP-A-4-182639, stilbene compounds represented by the formula (I) mentioned in JP-A-10-111543 and the compounds represented by the formula (I) mentioned in JP-A-11-109547. Particularly preferred supersensitizers are the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41–45 and 51–53 mentioned in JP-A-11-109547.

These supersensitizers can be added to the emulsion layer preferably in an amount of $10^{-4}$ to 1 mole, more preferably in an amount of 0.001–0.3 mole; per mole of silver halide.

In the photothermographic material the present invention, an acid formed by hydration of diphosphorus pentoxide or a salt thereof is preferably used together as a phosphorus-containing compound. Examples of the acid formed by hydration of diphosphorus pentoxide or a salt thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The compound containing phosphorus or acid formed by hydration of diphosphorus pentoxide or a salt thereof may be used in a desired amount (coated amount per $m^2$ of the photothermographic material) depending on the desired performance including sensitivity and fog. However, it can preferably be used in an amount of 0.1–500 $mg/m^2$, more preferably 0.5–100 $mg/m^2$.

The photothermographic material of the present invention preferably contains a high contrast agent.

While type of the high contrast agent used for the present invention are not particularly limited, examples of well-known high contrast agents include all of the hydrazine derivatives represented by the formula (H) mentioned in JP-A-2000-284399 (specifically, the hydrazine derivatives mentioned in Tables 1–4 of the same), and the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP741,320A. There can be further mentioned the substituted alkene derivatives, substituted isoxazole derivatives and particular acetal compounds represented by the formulas (1) to (3) mentioned in JP-A-2000-284399, the cyclic compounds represented by the formula (A) or (B) mentioned in the same, specifically Compounds 1–72 mentioned in Chemical Formulas 8 to 12 of the same, and the compounds represented by the general formulas (H), (G) and (P) mentioned in JP-A-2001-133924, specifically those of Chemical Formulas 3 to 9 and 11 to 53 of the same. Further, there can be also mentioned the hydrazine derivatives represented by the general formulas (H-1), (H-2), (H-3), (H-4), (H-5) and (H-1-1) mentioned in JP-A-2001-27790 (specifically, Compounds H-1-1 to H-1-28, Compounds H-2-1 to H-2-9, Compounds H-3-1 to H-3-12, Compounds H-4-1 to H-4-21 and Compounds H-5-1 to H-5-5 mentioned in the same), and the substituted alkene derivatives represented by the general formula (1) mentioned in JP-A-2001-125224 (specifically, compounds mentioned in Chemical Formulas 10 to 55 of the same). Although two or more kinds of these high contrast agents may be used in combination, one or two kinds of high contrast agents are preferably used in the present invention.

The high contrast agent can be used after being dissolved in water or an appropriate organic solvent. When it is added as an aqueous solution, solubilizing agents well known in the art can be used, and specifically, water-soluble polymers and surfactants described in JP-A-2001-83657, paragraphs 0091–0101 are preferably used. When it is used after being dissolved in an organic solvent, it is preferably dissolved in an alcohol (e.g., methanol, ethanol, propanol, fluorinated alcohol), ketone (e.g., acetone, methyl ethyl ketone, methyl isobutyl ketone), dimethylformamide, dimethyl sulfoxide, methyl cellosolve or the like and used. In the case of a compound having an acidic group, it is preferably neutralized with an equivalent amount of alkaline and used as a salt.

When solubility of the high contrast agent in water is low, it is preferably used after being dispersed by an emulsion dispersion method or solid dispersion method. When emulsion dispersion is performed, it is preferable to dissolve the high contrast agent by using an oil such as dibutyl phthalate, tricresyl phosphate, glyceryl triacetate or diethyl phthalate and an auxiliary solvent such as ethyl acetate or cyclohexanone, mechanically prepare an emulsion dispersion according to an emulsification dispersion method already well known in the art and use the emulsion dispersion in the photothermographic material. When solid dispersion is performed, the high contrast agent is preferably used in the photothermographic material after being dispersed as powder in water by using a ball mill, colloid mill, sand grinder mill, MANTON GAULIN, microfluidizer or the like, or by means of ultrasonic wave according to a method for solid dispersion well known in the art. Further, when emulsion dispersion or solid dispersion is performed, dispersion aids well known in the art are preferably used, and specifically, water-soluble polymers and surfactants described in JP-A-2001-83657, paragraphs 0091–0101 are preferably used.

The high contrast agent used in the present invention may be added to any layers on the image-forming layer side of the support. However, it is preferably added to the image-forming layer or a layer adjacent thereto. As for the amount of the high contrast agent, optimum amount may differ depending on particle size, halogen composition, degree of chemical sensitization of silver halide grains, type of inhibitor and so forth, and it cannot be generally defined. However, it is preferably from $10^{-6}$ to 1 mole, particularly preferably from $10^{-5}$ to $10^{-1}$ mole, per mole of silver.

The photothermographic material of the present invention contains a reducing agent for silver ions (silver salt of an organic acid). The reducing agent for the silver salt of an organic acid may be any substance that reduces silver ions to metal silver, preferably such an organic substance. Conventional photographic developing agents such as phenidone, hydroquinone and catechol are useful, but a hindered phenol reducing agent is preferred. The reducing agent is preferably contained in an amount of 5–50 mole %, more preferably from 10–40 mole %, per mole of silver on the side having the image-forming layer. The reducing agent may be added to any layer on the side having an image-forming layer of the support. In the case of adding the reducing agent to a layer other than the image-forming layer, the reducing agent is preferably used in a slightly larger amount of 10–50 mole % per mole of silver. The reducing agent may also be a so-called precursor that is derived to effectively function only at the time of development.

For photothermographic materials using a silver salt of an organic acid, reducing agents of a wide range can be used. There can be used, for example, the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP692732A and so forth. Examples thereof include amidoximes such as phenylamidoxime, 2-thienylamidoxime and p-phenoxyphenylamidoxime; azines such as 4-hydroxy-3,5-dimethoxy-benzaldehyde azine; combinations of an aliphatic carboxylic acid arylhydrazide with ascorbic acid such as a combination of 2,2'-bis(hydroxymethyl)propionyl-β-phenylhydrazine with ascorbic acid; combinations of polyhydroxybenzene with hydroxylamine, reductone and/or hydrazine such as a combination of hydroquinone with bis(ethoxyethyl) hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione and so forth; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-tert-butyl-5-methylphenyl)methane, 2,2-bis(4-hydroxy-3-methylphenyl) propane, 4,4-ethylidene-bis(2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Particularly preferred reducing agents are bisphenols and chromanols.

The reducing agent used in the present invention may be added in any form of an aqueous solution, solution in an organic solvent, powder, solid microparticle dispersion, emulsion dispersion or the like. However, it is preferably added as solid microparticle dispersion. Solid microparticle dispersion is performed by using a known pulverizing means (e.g., ball mill, vibrating ball mill, sand mill, colloid mill, jet mill, roller mill). At the time of solid microparticle dispersion, dispersion aids well known in the art are preferably used, and specifically, water-soluble polymers and surfactants described in JP-A-2001-83657, paragraphs 0091–0101 are preferably used.

If an additive known as "toning agent" that improves images is contained, optical density may be increased. Further, the toning agent may be advantageous also for forming black silver images. The toning agent is more preferably in the form of a so-called precursor derived so as to function only at the time of development.

For the photothermographic material using a silver salt of an organic acid, toning agents of a wide range can be used. For example, there can be suitably used toning agents disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(amino-methyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof such as 4-(1-naphthyl)phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-isobutylphthalazine, 6-tert-butylphthalazine, 5,7-dimethylphthalazine, 2,3-dihydrophthalazine) and metal salts thereof; combinations of a phthalazine or derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a toning agent but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines (e.g., 2,4-dihydroxpyrimidine, 2-hydroxy-4-aminopyrimidine); azauracil and tetraazapentalene derivatives (e.g., 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene) and so forth. Phthalazine derivatives and phthalic acid derivatives are particularly preferably used. In the present invention, the phthalazine derivatives represented by the formula (4-2) mentioned in JP-A-2000-35631 are preferably used as the toning agent. Specifically, A-1 to A-10 mentioned in the same are preferably used.

The toning agent is preferably used after being dissolved in water or an appropriate organic solvent. It is preferably added as an aqueous solution formed by using solubilizing agents well known in the art, and specifically, water-soluble polymers and surfactants described in JP-A-2001-83657, paragraphs 0091–0101 are preferably used. When it is used after being dissolved in an appropriate organic solvent, it is preferably dissolved in, for example, an alcohol (e.g., methanol, ethanol, propanol, fluorinated alcohol), ketone (e.g., acetone, methyl ethyl ketone, methyl isobutyl ketone), dimethylformamide, dimethyl sulfoxide, methyl cellosolve or the like and used. In the case of a compound having an acidic group, it is preferably neutralized with an equivalent amount of alkaline and used as a salt.

When solubility of the toning agent in water is low, it is preferably used after being dispersed by an emulsion dispersion method or solid dispersion method. When emulsion dispersion is performed, it is preferable to dissolve the toning agent by using an oil such as dibutyl phthalate, tricresyl phosphate, glyceryl triacetate or diethyl phthalate and an auxiliary solvent such as ethyl acetate or cyclohexanone, mechanically prepare an emulsion dispersion according to an already well known emulsification dispersion method and use the emulsion dispersion in the photothermographic material. When solid dispersion is performed, the toning agent is preferably used after being dispersed as powder in water by using a ball mill, colloid mill, sand grinder mill, MANTON GAULIN, microfluidizer or the like, or by means of ultrasonic wave according to a method for solid dispersion well known in the art. Further, when emulsion dispersion or solid dispersion is performed, dispersion aids well known in the art are preferably used, and specifically, water-soluble polymers and surfactants described in JP-A-2001-83657, paragraphs 0091–0101 are preferably used.

In the photothermographic material of the present invention, the silver halide emulsion and/or the silver salt of an organic acid is preferably further prevented from the production of additional fog or stabilized against the reduction in sensitivity during the stock storage by an antifoggant, a stabilizer or a stabilizer precursor. Examples of suitable antifoggant, stabilizer and stabilizer precursor that can be used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The photothermographic material of the present invention preferably contains a benzoic acid compound for the purpose of achieving higher sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound may be added to any layer of the photothermographic material, but it is preferably added to a layer on the image-forming layer side with respect to the support, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution and microparticle dispersion, or may be added as a solution containing a mixture of the benzoic acid compound with other additives such as a sensitizing dye, reducing agent and toning agent. The benzoic acid compound may be added in any amount. However, the amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halogenated compound, and examples thereof include, for example, those compounds disclosed in U.S. Pat. Nos. 3,874,946, 4,756,999, 5,340,712, 5,369,000, 5,464,737, JP-A-50-120328, JP-A-50-137126, JP-A-50-89020, JP-A-50-119624, JP-A-59-57234, JP-A-7-2781, JP-A-7-5621, JP-A-9-160164, JP-A-9-160167, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, JP-A-2000-2963, JP-A-2000-112070, JP-A-2000-284412, JP-A-2000-284399, JP-A-2000-284410, JP-A-2001-33911, JP-A-2001-5144 and so forth. Among these, particularly preferred organic halogenated compounds are 2-tribromomethylsulfonylquinoline described in JP-A-7-2781, 2-tribromomethylsulfonylpyridine described in JP-A-2001-5144, the compounds of P-1 to P-31 described in JP-A-2000-112070, the compounds of P-1 to P-73 described in JP-A-2000-284410, the compounds of P-1 to P-25 and P'-1 to P'-27 described in JP-A-2001-33911, the compounds of P-1 to P-118 described in JP-A-2000-284399, phenyltribromomethylsulfone and 2-naphthyltribromomethylsulfone.

The amount of the organic halogenated compounds is preferably $1\times10^{-5}$ mole to 2 moles/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halogenated compounds may be used each alone, but it is more preferable to use two or more of them in combination.

Further, the salicylic acid derivatives represented by the formula (Z) mentioned in JP-A-2000-284399 can be preferably used as the antifoggant. Specifically, the compounds (A-1) to (A-60) mentioned in the same are preferably used. The amount of the salicylic acid derivatives represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in JP-A-2000-221634.

The antifoggant used for the present invention can be used after being dissolved in water or an appropriate organic solvent. When it is added as an aqueous solution, solubilizing agents well known in the art can be used, and specifically, water-soluble polymers and surfactants described in JP-A-2001-83657, paragraphs 0091–0101 are preferably used. When it is used after being dissolved in an organic solvent, it is preferably dissolved in an alcohol (e.g., methanol, ethanol, propanol, fluorinated alcohol), ketone (e.g., acetone, methyl ethyl ketone, methyl isobutyl ketone), dimethylformamide, dimethyl sulfoxide, methyl cellosolve or the like and used. In the case of a compound having an acidic group, it is preferably neutralized with an equivalent amount of alkaline and used as a salt.

When solubility of the antifoggant in water is low, it is preferably used after being dispersed by an emulsion dispersion method or solid dispersion method. When emulsion dispersion is performed, it is preferable to dissolve the antifoggant by using an oil such as dibutyl phthalate, tricresyl phosphate, glyceryl triacetate or diethyl phthalate and an auxiliary solvent such as ethyl acetate or cyclohexanone, mechanically prepare an emulsion dispersion according to an emulsification dispersion method already well known in the art and use the emulsion dispersion in the photothermographic material. When solid dispersion is performed, the antifoggant is preferably used in the photothermographic material after being dispersed as powder in water by using a ball mill, colloid mill, sand grinder mill, MANTON GAULIN, microfluidizer or the like, or by means of ultrasonic wave according to a method for solid dispersion well known in the art. Further, when emulsion dispersion or solid dispersion is performed, dispersion aids well known in the art are preferably used, and specifically, water-soluble polymers and surfactants described in JP-A-2001-83657, paragraphs 0091–0101 are preferably used.

While the antifoggant used in the present invention may be added to any layer on the image-forming layer side with respect to the support, that is, the image-forming layer or another layer on that side, it is preferably added to the image-forming layer or a layer adjacent thereto. The image-forming layer is a layer containing a reducible silver salt (silver salt of an organic acid), preferably such an image-forming layer further containing a photosensitive silver halide.

The photothermographic material of the present invention may contain a mercapto compound, disulfide compound or thione compound so as to control the development by inhibiting or accelerating the development or improve the storability before or after the development.

Mercapto compounds that can be used in the present invention may have any structure, but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group of substituents consisting of a halogen (e.g., Br, Cl), hydroxy, amino, carboxy, alkyl (e.g., alkyl having one or more carbon atoms, preferably from 1–4 carbon atoms), alkoxy (e.g., alkoxy having one or more carbon atoms, preferably from 1–4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth.

The amount of the mercapto compound is preferably 0.9000–1.0 mole, more preferably 0.9000–0.3 mole, per mole of silver in the image-forming layer.

When the photothermographic material of the present invention is used for medical purpose, the sulfonamidophenol compounds represented by the formula (A) mentioned in JP-A-2000-267222 and JP-A-2000-330234, hindered phenol compounds represented by the formula (II) mentioned in JP-A-2001-92075, hydrazine compounds represented by the general formula (I) mentioned in JP-A-10-62895 and JP-A-11-15116 or the general formula (1) mentioned in Japanese Patent Application No. 2001-074278 and phenol or naphthol compounds represented by the general formula (2) mentioned in Japanese Patent Application No. 2000-76240 are preferably used as a development accelerator. These development accelerators are used in an amount in the range of 0.1–20 mol %, preferably 0.5–10 mol %, more preferably 1–5 mol %, with respect to the reducing agent. Although they can be introduced into the photothermographic material by a method similar to those used for introducing the reducing agent, they are particularly preferably introduced as a solid dispersion or emulsion dispersion. When they are added as an emulsion dispersion, they are preferably added as an emulsion dispersion prepared by emulsion dispersion using a high-boiling point solvent that is solid at an ordinary temperature and a low-boiling point auxiliary solvent or a so-called oilless emulsion dispersion that is not added with a high boiling-point solvent. When the photothermographic material of the present invention is used for medical purpose, the hydrazine compounds represented by the general formula (1) mentioned in Japanese Patent Application No. 2001-074278 and phenol or naphthol compounds represented by the general formula (2) mentioned in Japanese Patent Application No. 2000-76240 are particularly preferably used among the aforementioned development accelerators. Preferred development accelerators that can be used for the photothermographic material of the present invention will be mentioned below. However, development accelerators that can be used for the present invention are not limited to these specific examples.

(A'-1)

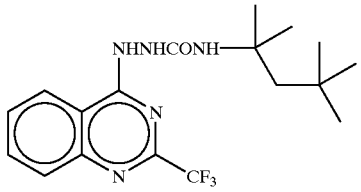

(A'-2)

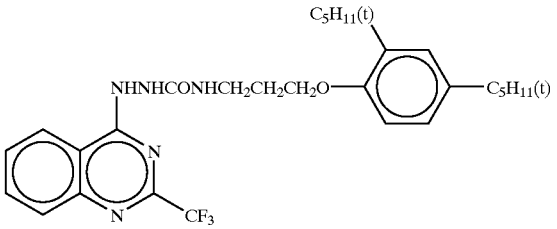

(A'-3)

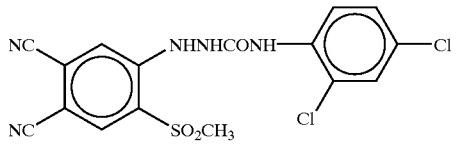

(A'-4)

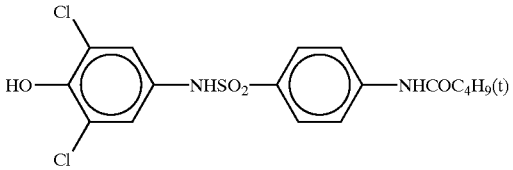

(A'-5)

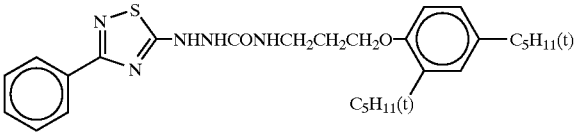

(A'-6)

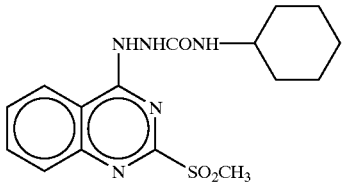

-continued (A'-7)

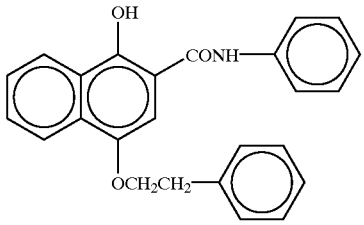

(A'-8)

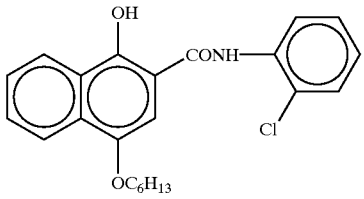

(A'-9)

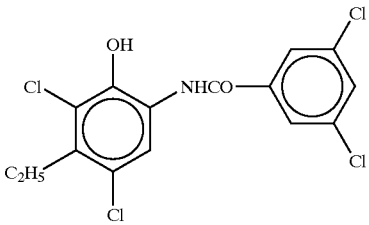

(A'-10)

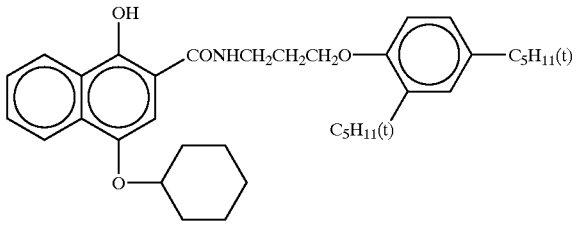

When the photothermographic material of the present invention is used for medical purpose, it is preferable to use a non-reducing compound having a group that can form a hydrogen bond with an aromatic hydroxyl group of the reducing agent (hydrogen bond-forming compound). When the reducing agent has an amino group, the hydrogen bond-forming compound may be a non-reducing compound having a group that can form a hydrogen bond with the amino group.

Examples of the group that can form a hydrogen bond include phosphoryl group, sulfoxido group, sulfonyl group, carbonyl group, amido group, an ester group, urethane group, ureido group, a tertiary amino group, a nitrogen-containing aromatic group and so forth. Particularly preferred examples of the compound are those compounds having phosphoryl group, sulfoxido group, amido group (provided that it does not have >N—H group, but it is blocked as >N—Ra (Ra is a substituent other than H)), urethane group (provided that it does not have >N—H group, but it is blocked as >N—Ra (Ra is a substituent other than H)), or ureido group (provided that it does not have >N—H group, but it is blocked as >N—Ra (Ra is a substituent other than H)).

Hydrogen bond-forming compounds particularly preferably used for the present invention are compounds represented by the following general formula (A).

Formula (A)

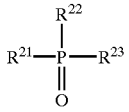

In the general formula (A), $R^{21}$, $R^{22}$ and $R^{23}$ each independently represent an alkyl group, an aryl group, an alkoxy group, an aryloxy group, an amino group or a heterocyclic group, and these groups may or may not have one or more substituents.

When $R^{21}$, $R^{22}$ and $R^{23}$ have one or more substituents, they can be selected from a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group and so forth, and they are preferably selected from an alkyl group and an aryl group. Specific examples thereof are methyl group, ethyl group, isopropyl group, t-butyl group, t-octyl group, phenyl group, 4-alkoxyphenyl group, 4-acyloxyphenyl group and so forth.

Specific examples of the alkyl group represented by $R^{21}$, $R^{22}$ and $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenethyl group, 2-phenoxypropyl group and so forth.

Specific examples of the aryl group include phenyl group, cresyl group, xylyl group, naphthyl group, 4-t-butylphenyl group, 4-t-octylphenyl group, 4-anisidyl group, 3,5-dichlorophenyl group and so forth.

Specific examples of the alkoxyl group include methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group and so forth.

Specific examples of the aryloxy group include phenoxy group, cresyloxy group, isopropylphenoxy group, 4-t-butylphenoxy group, naphthoxy group, biphenyloxy group and so forth.

Specific examples of the amino group include dimethylamino group, diethylamino group, dibutylamino group, dioctylamino group, N-methyl-N-hexylamino group, dicyclohexylamino group, diphenylamino group, N-methyl-N-phenylamino group and so forth.

$R^{21}$, $R^{22}$ and $R^{23}$ are preferably selected from an alkyl group, an aryl group, an alkoxy group and an aryloxy group. In view of the effects of the present invention, it is preferred that one or more of $R^{21}$, $R^{22}$ and $R^{23}$ should be selected from an alkyl group and an aryl group, and it is more preferred that two or more of $R^{21}$, $R^{22}$ and $R^{23}$ should be selected from an alkyl group and an aryl group. In view of availability at low cost, it is preferred that $R^{21}$, $R^{22}$ and $R^{23}$ should be the same groups.

Specific examples of the hydrogen bond-forming compound will be shown below. However, the hydrogen bond-forming compounds that can be used for the present invention are not limited to these examples.

(A-1)
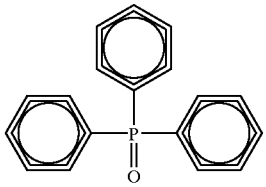
(A-2)
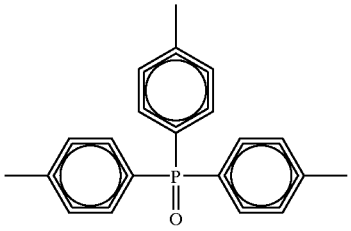
(A-3)
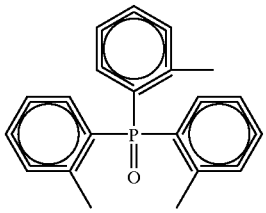
(A-4)
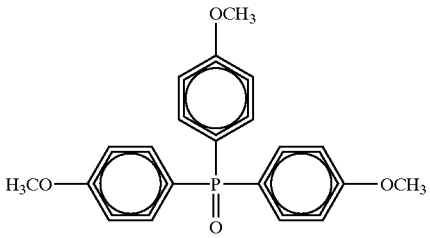
(A-5)
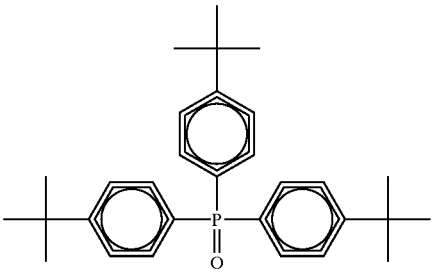
(A-6)
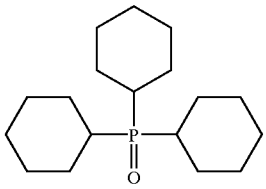
(A-7)
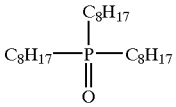
-continued
(A-8)
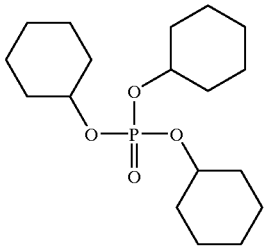
(A-9)
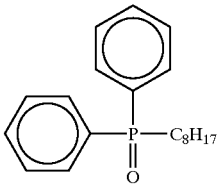
(A-10)
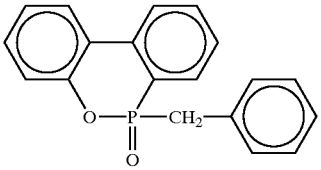
(A-11)
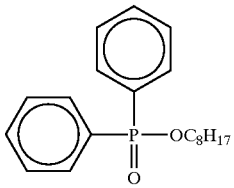
(A-12)
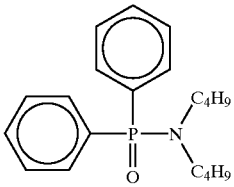
(A-13)
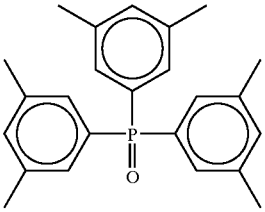
(A-14)
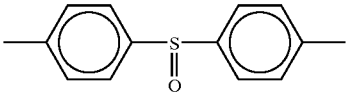
(A-15)
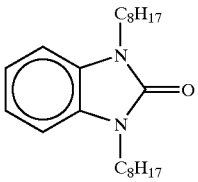

-continued (A-16)

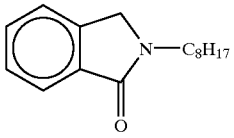

(A-17)

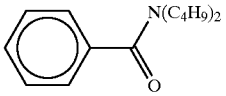

Specific examples of the hydrogen bond-forming compound include, besides those mentioned above, those disclosed in Japanese Patent Application Nos. 2000-192191 and 2000-194811.

The hydrogen bond-forming compound may be added to a coating solution, like the reducing agent, in the form of solution, emulsion dispersion or solid microparticle dispersion for use in the photosensitive material. The hydrogen bond-forming compound forms a complex in a solution with a compound having a phenolic hydroxyl group through hydrogen bond, and hence it can be isolated as crystals of such a complex depending on the combination of the reducing agent and the compound represented by the general formula (A).

Crystal powder isolated in such a manner is particularly preferably used as solid microparticle dispersion in order to obtain stable performance. Further, it is also preferable to mix the reducing agent and the hydrogen bond-forming compound as powders and allow them to form a complex during dispersion operation using a suitable dispersing agent in a sand grinder mill or the like.

The hydrogen bond-forming compound is preferably used in an amount of 1–200 mole %, more preferably 10–150 mole %, further preferably 30–100 mole %, with respect to the reducing agent.

In the photothermographic material of the present invention, it is not preferred that volatile bases such as ammonia exist in the films, since they are likely to evaporate and evaporates during not only coating process and heat development, but also during storage. The content of $NH_4^+$ is preferably 0.06 mmol or less, more preferably 0.03 mmol or less, in terms of the coated amount per 1 $m^2$ of the support. The amount of $NH_4^+$ in films was quantified by using an ion chromatography measurement apparatus Type 8000 (according to electric conduction degree method), produced by TOSOH CORP., which was provided with a TSKgel IC-Cation as a separation column and TSK guard column IC-C as a guard column produced by TOSOH CORP. As an eluent, 2 mM nitric acid aqueous solution was used at a flow rate of 1.2 mL/min. The column thermostat temperature was 40° C.

Extraction of $NH_4^+$ from a photothermographic material was attained by immersing the photosensitive material having a size of 1×3.5 cm into 5 mL of extraction solution consisting of a mixture of acetic acid and ion-exchanged water (1:148) for 2 hours and filtering the solution through a 0.45-$\mu$m filter, and the measurement was performed for the obtained filtrate.

For controlling the film surface pH, an organic acid such as phthalic acid derivatives or a nonvolatile acid such as sulfuric acid, and a nonvolatile base are preferably used. The photothermographic material of the present invention preferably has a film surface pH of 6.0 or less, more preferably 5.5 or less, before heat development. While it is not particularly limited as for the lower limit, it is normally around 3 or higher.

A method for measuring the film surface pH is described in JP-A-2000-284399, paragraph 0123.

The photothermographic material of the present invention has an image-forming layer containing a silver salt of an organic acid, a reducing agent and a photosensitive silver halide on a support, and at least one protective layer is preferably provided on the image-forming layer. Further, the photothermographic material of the present invention preferably has at least one back layer on the side of the support opposite to the side of the image-forming layer (back surface), Examples of the binder used in the present invention include natural polymers, synthetic resins, synthetic homopolymers and copolymers and other film-forming media. Specific examples thereof include, for example, gelatin, gum arabic, poly(vinyl alcohol), hydroxyethylcellulose, cellulose acetate, cellulose acetate butyrate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetal) (e.g., poly(vinyl formal), poly(vinyl butyral)), poly(ester), poly(urethane), phenoxy resin, poly (vinylidene chloride), poly(epoxide), poly(carbonate), poly (vinyl acetate), cellulose ester, poly(amide) and so forth.

Although the binder may be hydrophilic or hydrophobic, it is preferable to use a hydrophobic transparent binder in order to reduce fog after heat development. Preferred binders are polyvinyl butyral, cellulose acetate, cellulose acetate butyrate, polyester, polycarbonate, polyacrylic acid, polyurethane and so forth. Among these, polyvinyl butyral, cellulose acetate and cellulose acetate butyrate are particularly preferably used.

Further, in order to protect a surface or prevent scratches, the photothermographic material preferably has a protective layer outside the image-forming layer. Type of the binder used for the protective layer may be the same as or different from that of the binder used for the image-forming layer. Preferably used is a polymer having a softening point higher than that of the binder polymer constituting the image-forming layer in order to prevent scratches, deformation of the layer and so forth, and cellulose acetate, cellulose acetate butyrate and so forth are appropriate for this purpose.

When the binder used in the present invention is coated by using a solvent (dispersion medium) containing water as a main component, the polymer latex described below is preferably used.

Among image-forming layers containing a photosensitive silver halide in the photothermographic material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the photothermographic material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion themselves are dispersed in molecular state or the like. The polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type other than ordinary polymer latex having a uniform structure. In this case, use of different glass transition temperatures of core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably −30–40° C. for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resin, polyvinyl acetate resin, polyester resin, polyurethane resin, rubber resin, polyvinyl chloride resin, polyvinylidene chloride resin and polyolefin resin, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The copolymers may be random copolymers or block copolymers. The polymers may have a number average molecular weight of about 5,000 to 1,000,000, preferably from about 10,000 to 100,000. Polymers having a too small molecular weight may unfavorably suffer from insufficient mechanical strength of the image-forming layer, and those having a too large molecular weight may unfavorably suffer from bad film forming property.

Specific examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available, and examples thereof include acrylic resins such as CEBIAN A-4635, 46583, 4601 (all produced by Dicel Kagaku Kogyo Co., Ltd), Nipol LX 811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES 650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX 410, 430, 435, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them. However, they are preferably used individually.

The image-forming layer preferably contains 50 weight % or more, more preferably 70 weight % or more, of the aforementioned polymer latex based on the total binder.

If desired, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water is preferably a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably from 0.2–30 g/m$^2$, more preferably from 1–15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in JP-A-2000-267226, paragraphs 0025–0029.

In the present invention, a plasticizer described in JP-A-2000-267226, paragraphs 0021–0025 (e.g., benzyl alcohol, 2,2,4-trimethylpentanediol-1,3-monoisobutyrate etc.) can be added as required to control the film-forming temperature. Further, a hydrophilic polymer may be added to a polymer binder, and a water-miscible organic solvent may be added to a coating solution as described in JP-A-2000-267226, paragraphs 0027–0028.

First polymer latex introduced with functional groups, and a crosslinking agent and/or second polymer latex having a functional group that can react with the first polymer latex, which are described in JP-A-2000-19678, paragraphs 0023–0041, can also be added to each layer.

The aforementioned functional groups may be carboxyl group, hydroxyl group, isocyanate group, epoxy group, N-methylol group, oxazolinyl group or so forth. The crosslinking agent is selected from epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), aqueous dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binder for the image-forming layer is preferably in the range of 0.2–30 g/m$^2$, more preferably 1.0–15 g/m$^2$.

The total amount of the binder for the protective layer is preferably in the range of 1–10.0 g/m$^2$, more preferably 2–6.0 g/m$^2$, as an amount providing a film thickness of 3 $\mu$m or more, which is preferably used in the present invention.

In the present invention, the thickness of the protective layer is preferably 3 $\mu$m or more, more preferably 4 $\mu$m or more. While the upper limit of the thickness of the protective layer is not particularly limited, it is preferably 10 $\mu$m or less, more preferably 8 $\mu$m or less, in view of coating and drying.

The total amount of the binder for the back layer is preferably in the range of 0.01–10.0 g/m$^2$, more preferably 0.05–5.0 g/m$^2$.

Each of these layers may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one of the layers, especially the outermost protective layer. Further, the back layer is a layer provided on an undercoat layer for the back surface of the support, and it may consist of two or more layers. In such a case, it is preferred that polymer latex should be used for at least one of the layers, especially the outermost back layer.

A lubricant referred to in the present specification means a compound which, when present on a surface of an object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and JP-A-2000-47083, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.),

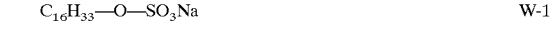

$C_{16}H_{33}$—O—$SO_3Na$ W-1

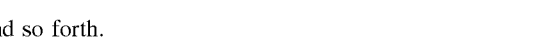

$C_{18}H_{37}$—O—$SO_3Na$ W-2 and so forth.

The amount of the lubricant is 0.1–50 weight %, preferably 0.5–30 weight %, of the amount of binder in a layer to which the lubricant is added.

When such a development apparatus as disclosed in JP-A-2000-171935 or JP-A-2000-47083 is used for the heat development of the photothermographic material of the present invention, in which a photothermographic material is transported in a pre-heating section by facing rollers, and the material is transported in a heat development section by driving force of rollers facing the side of the material having the image-forming layer, while the opposite back surface slides on a smooth surface, ratio of friction coefficients of the outermost surface layer of the side of the photothermographic material having the image-forming layer and the outermost surface layer of the back side is 1.5 or more, preferably 1.5–30, at the heat development temperature. Value of $\mu$b is preferably 1.0 or less, more preferably 0.05–0.8. This value can be obtained in accordance with the following equation Ratio of friction coefficients=coefficient of dynamic friction between roller material of heat development apparatus and surface of image-forming layer side ($\mu$e)/coefficient of dynamic friction between material of smooth surface member of heat development apparatus and back surface ($\mu$b)

In the present invention, the lubricity between the members of the heat development apparatus and the surface of image-forming layer side and/or the opposite back surface at the heat development temperature can be controlled by adding a lubricant to the outermost layers and adjusting its addition amount.

Various supports can be used for the photothermographic material of the present invention. Typical supports comprise polyester such as polyethylene terephthalate and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate (PET), is preferred in view of strength, dimensional stability, chemical resistance and so forth. The support preferably has a thickness of 90–180 $\mu$m as a base thickness except for the undercoat layers.

Preferably used as the support of the photothermographic material of the present invention is a polyester film, in particular polyethylene terephthalate film, subjected to a heat treatment in a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0 to 0.04% for the transverse direction (TD).

It is preferred that undercoat layers containing a vinylidene chloride copolymer comprising 70 weight % or more of repetition units of vinylidene chloride monomers should be provided on the both surface of the support. Such a vinylidene chloride copolymer is disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, JP-A-2000-39684, paragraphs 0020–0037 and JP-A-2000-47083, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, besides the repetition units of vinylidene chloride monomer. A polymer consists solely of vinylidene chloride monomers may crystallize, and therefore it may become difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of 0.3 μm or more, preferably 0.3 μm to 4 μm, as a total thickness of the undercoat layers containing the vinylidene chloride copolymer for one side.

The vinylidene chloride copolymer layer as an undercoat layer is preferably provided a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer is preferably within the range defined above.

Such layers preferably contain a crosslinking agent, matting agent or the like, in addition to the vinylidene chloride copolymer.

The support is preferably coated with an undercoat layer comprising SBR, polyester, gelatin or the like as a binder, in addition to the vinylidene chloride copolymer layer, as required. This undercoat layer preferably has a multilayer structure, and is preferably provided on both sides of the support. The undercoat layer generally has a thickness (per layer) of 0.01–5 μm, more preferably 0.05–1 μm.

The photothermographic material of the present invention is preferably subjected to an antistatic treatment using the conductive metal oxides and/or fluorine-containing surfactants disclosed in JP-A-11-84573, paragraphs 0040–0051 for the purposes of reducing adhesion of dusts, preventing generation of static marks, preventing transportation failure during the automatic transportation and so forth. As the conductive metal oxides, the conductive acicular tin oxide doped with antimony disclosed in U.S. Pat. No. 5,575,957 and JP-A-11-223901, paragraphs 0012–0020 and the fibrous tin oxide doped with antimony disclosed in JP-A-4-29134 can be preferably used.

The layer containing a metal oxide should show a surface specific resistance (surface resistivity) of $10^{12}$ O or less, preferably $10^{11}$ O or less, in an atmosphere at 25° C. and 20% of relative humidity. Such a resistivity provides good antistatic property. Although the surface resistivity is not particularly limited as for the lower limit, it is usually about $10^{7}$ O.

The photothermographic material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

Beck's smoothness referred to in the present invention can be easily determined according to Japanese Industrial Standard (JIS) P8119, "Test Method for Smoothness of Paper and Paperboard by Beck Test Device" and TAPPI Standard Method T479.

Beck's smoothness of the outermost surfaces of the image-forming layer side and the opposite side of the photothermographic material can be controlled by suitably selecting particle size and amount of matting agent to be contained in the layers constituting the surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methylcellulose, ethylcellulose, carboxymethylcellulose, hydroxyethylcellulose, hydroxypropylcellulose, hydroxypropylmethylcellulose etc.), synthetic polymers (polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylsulfinic acid or vinylsulfinic acid copolymer, polyacrylic acid or acrylic acid copolymer, acrylic acid or acrylic acid copolymer, maleic acid copolymer, maleic acid monoester copolymer and polyacryloylmethyl propanesulfonate or acryloylmethyl propanesulfonate copolymer etc.) and so forth.

Among these, water-soluble polymers preferably used are sodium arginate, gelatin, dextran, dextrin, methylcellulose, carboxymethylcellulose, hydroxyethylcellulose, hydroxypropylcellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are particularly preferably used as a thickener.

Among these, particularly preferred thickeners are gelatin, dextran, methylcellulose, carboxymethylcellulose, hydroxyethylcellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymers used as a thickener is not particularly limited so long as viscosity of a coating solution is increased when they are added to it. Their concentration in the solution is generally 0.01–30 weight %, preferably 0.05–20 weight %, particularly preferably 0.1–10 weight %. Viscosity to be increased by the polymers is preferably 1–200 mPa·s, more preferably 5–100 mPa·s, as increased degree of viscosity compared with the initial viscosity. The viscosity is represented by values measured at 25° C. by using a B type rotational viscometer. Upon addition to a coating solution or the like, it is generally desirable that the thickener is added as a solution diluted as much as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described below and using them. As the surfactants used in the present invention, any of nonionic or ionic (anionic, cationic, betaine) surfactants can be used. Furthermore, fluorine-containing surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid ester salts. Typical examples thereof are aliphatic acid salts, alkylbenzenesulfonates, alkylnaphthalenesulfonates, alkylsulfonates, a-olefinsulfonates, dialkylsulfosuccinates, a-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants", Saiwai Shobo, Sep. 1, 1980). In the present invention, amount of the surfactant is not particularly limited, and it can be used in an amount providing desired surface activating property. The coating amount of the fluorine-containing surfactant is preferably 0.01–250 mg per 1 $m^2$.

Specific examples of the surfactants are mentioned below. However, the surfactants that can be used in the present invention are not limited to these (—$C_6H_4$— represents phenylene group in the following formulas).

| | |
|---|---|
| $C_{16}H_{33}(OCH_2CH_2)_{10}OH$ | WA-1 |
| $C_9H_{19}$—$C_6H_4$—$(OCH_2CH_2)_{12}OH$ | WA-2 |
| Sodium dodecylbenzenesulfonate | WA-3 |
| Sodium tri(isopropyl)naphthalenesulfonate | WA-4 |
| Sodium tri(isobutyl)naphthalenesulfonate | WA-5 |
| Sodium dodecylsulfate | WA-6 |
| a-Sulfasuccinic acid di(2-ethylhexyl) ester sodium salt | WA-7 |
| $C_8H_{17}$—$C_6H_4$—$(CH_2CH_2O)_3(CH_2)_2SO_3K$ | WA-8 |
| Cetyltrimethylammonium chloride | WA-10 |
| $C_{11}H_{23}CONHCH_2CH_2N^{(+)}(CH_3)_2$—$CH_2COO^{(-)}$ | WA-11 |
| $C_8F_{17}SO_2N(C_3H_7)(CH_2CH_2O)_{16}H$ | WA-12 |
| $C_8F_{17}SO_2N(C_3H_7)CH_2COOK$ | WA-13 |
| $C_8F_{17}SO_3K$ | WA-14 |
| $C_8F_{17}SO_2N(C_3H_7)(CH_2CH_2O)_4(CH_2)_4SO_3Na$ | WA-15 |
| $C_8F_{17}SO_2N(C_3H_7)(CH_2)_3OCH_2CH_2N^{(+)}(CH_3)_3$—$CH_3.C_6H_4$—$SO_3^{(-)}$ | WA-16 |
| $C_8F_{17}SO_2N(C_3H_7)CH_2CH_2CH_2N^{(+)}(CH_3)_2$—$CH_2COO^{(-)}$ | WA-17 |

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in JP-A-2000-2964, FIG. 1 is particularly preferred.

Silver halide photographic photosensitive materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method of the second drying zone and subsequent zones, there can be mentioned the air loop method where a support held by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic photosensitive materials is used, uneven flow or uneven drying may occur, and therefore serious defects are likely to occur on the coated surface.

The preferred drying method for the present invention is such a method as described in JP-A-2000-002964, where the drying is attained in a horizontal drying zone irrespective of the drying zone, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The "constant rate drying" referred to in the present specification means a drying process in which all entering calorie is consumed for evaporation of solvent at a constant liquid film temperature. "Decreasing rate drying" referred to in the present specification means a drying process where the drying rate is reduced by various factors (for example, diffusion of moisture in the material for transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF of polymer is usually higher than glass transition temperature Tg of the polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The "liquid film surface temperature" referred to in this specification means a solvent liquid film surface temperature of coated liquid film coated on a support, and the "dry bulb temperature" means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer have not lost flowability, and hence it is likely that unevenness is formed on the surface. Furthermore, if the support (base) is exposed to excessive heat at a temperature higher than its Tg, dimensional stability and resistance to curl tendency of the photosensitive material tends to be degraded.

The same shall apply to the serial coating, in which an under layer is coated and dried and then an upper layer is coated. As for properties of coating solutions when an upper layer and a lower layer are coated as stacked layers by coating the upper layer before drying of the lower layer and the both layers are dried simultaneously, in particular, a coating solution for the image-forming layer and a coating solution for protective layer preferably show a pH difference of 2.5 or less, and a smaller value of this pH difference is more preferred. If the pH difference of the coating solutions becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 mPa·S, more preferably 30–70 mPa·S, at 25° C. The coating solution for the protective layer preferably has a viscosity of 5–75 mPa·S, more preferably 20–50 mPa·S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side should be toward the outside or inside of the roll according to a shape suitable for subsequent processing. Further, it is also preferred that, when the material is further processed in a rolled shape, the material should be rolled up into a shape of roll in which the sides are reversed compared with the original rolled shape during processing, in order to eliminate the curl generated while the material is in the original rolled shape. Relative humidity of the photosensitive material is preferably controlled to be in the range of 20–55% (measured at 25° C.).

In conventional coating solutions for photographic emulsions, which are viscous solutions containing silver halide and gelatin as a base, air bubbles are dissolved in the solutions and eliminated only by feeding the solution by pressurization, and air bubbles are scarcely formed even when the solutions are placed under atmospheric pressure again for coating. However, as for the coating solution for the image-forming layer containing dispersion of silver salt of organic acid, polymer latex and so forth preferably used in the present invention, only feeding of it by pressurization is likely to result in insufficient degassing. Therefore, it is preferably fed so that air/liquid interfaces should not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in JP-A-2000-98534, examples and FIG. 2 is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5 V to 3.0 V. Although a higher sound pressure is generally preferred, an unduly high sound pressure provides high temperature portions due to cavitation, which may cause fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy imparted to the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg. Time under the reduced pressure is 30 minutes or more, preferably 45 minutes or more, and its upper limit is not particularly limited.

In the present invention, the image-forming layer, protective layer for the image-forming layer, undercoat layer and back layer may contain a dye in order to prevent halation and so forth as disclosed in JP-A-11-84573, paragraphs 0204–0208 and JP-A-2000-47083, paragraphs 0240–0241.

Various dyes and pigments can be used for the image-forming layer for improvement of color tone and prevention of irradiation. While arbitrary dyes and pigments may be used for the image-forming layer, the compounds disclosed in JP-A-11-119374, paragraphs 0297, for example, are preferably used. These dyes may be added in any form such as solution, emulsion, solid microparticle dispersion and macromolecule mordant mordanted with the dyes, and they are preferably added as a solution containing gelatin. Although the amount of these compounds is determined by the desired absorption, they are preferably used in an amount of $1\times10^{-6}$ g to 1 g per 1 m$^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 are preferably used. There are also preferably used a method of reducing density obtained with a dye by thermal decoloration as disclosed in Belgian Patent No. 733,706, a method of reducing the density by decoloration utilizing light irradiation as disclosed in JP-A-54-17833 and so forth.

When the photothermographic material of the present invention after heat development is used as a mask for the production of printing plate from a PS plate, the photothermographic material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by using LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposing, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used.

The light exposure in the present invention is performed with overlapped light beams of light sources. The term "overlapped" means that a vertical scanning pitch width is smaller than the diameter of the beams. The overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred, because it provides high output and shortens writing time. In particular, for the cylinder external surface scanning method, a multichannel carrying several to several tens or more of laser heads is preferably used.

The scanning method of the light source of the light exposure apparatus preferably used for the present invention is the inner drum method (cylinder internal surface scanning method). The light exposure is attained by scanning the surface of the photothermographic material transported into the inner drum section with a laser light emitted from a laser diode and reflected by a polygon mirror (prism). The exposure time for the main scanning direction is determined by the rotation number of the polygon mirror and the inner diameter of the drum. The main scanning speed on the surface of the photothermographic material of the present invention is preferably 500–1500 m/second, more preferably 1100–1500 m/second.

If a photothermographic material to be exposed shows low haze upon light exposure, it is likely to generate interference fringes and therefore it is preferable to prevent it. As techniques for preventing such interference fringes, there are known a technique of obliquely irradiating a photosensitive material with a laser light as disclosed in JP-A-5-113548 and so forth, a technique of utilizing a multimode laser as disclosed in WO95/31754 and so forth, and these techniques are preferably used.

Although any method may be used as the heat development process for image formation on the photothermographic material of the present invention, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred are the heat development apparatuses of non-contact type.

As a method for preventing uneven development due to dimensional change of the photothermographic material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Therefore, a preferred image-forming method used for the photothermographic material of the present invention is a method in which the photothermographic material is light-exposed to form a latent image, and then subjected to development in a development apparatus equipped with a preheating section, a heat development section and a gradual cooling section. The development temperature of the photothermographic material of the present invention in a development apparatus is preferably 80–250° C., more preferably 100–140° C. The development time in the development apparatus is preferably 1–180 seconds, more preferably 5–90 seconds, in total. Further, the heat development speed in the heat development section of the heat development apparatus is preferably 21–100 mm/second, more preferably 27–50 mm/second.

The light-exposed photothermographic material is first heated in the preheating section. The preheating section is provided in order to prevent uneven development caused by dimensional change of the photothermographic material during the heat development. As for the heating in the preheating section, temperature is desirably controlled to be lower than the heat development temperature (for example, lower by about 10–30° C.), and the temperature and time in this section are desirably adjusted so that they should be sufficient for evaporating moisture remaining in the photothermographic material. The temperature is also preferably adjusted to be higher than the glass transition temperature (Tg) of the support of the photothermographic material so that uneven development should be prevented. It is generally preferred that the photothermographic material should be heated at a temperature of 80° C. or higher but lower than 115° C. for 5 seconds or more.

The photothermographic material heated at the preheating section is subsequently heated in the heat development section. The heat development section is provided with heating members on image-forming layer side and back layer side and transportation rollers only on the image-forming layer side with respect to the photothermographic material to be transported. For example, when the photothermographic material is transported so that it should have the image-forming layer on the upper side, there is employed a configuration that no transportation rollers are provided on the lower side of the photothermographic material (back layer side of the photothermographic material) and transportation rollers are provided only on the upper side (image-forming layer side of the photothermographic material) with respect to the transportation plane of the photothermographic material. Generation of uneven density and physical deformation are prevented by employing the above configuration of the heat development section.

In the heat development section, the photothermographic material is heated by heating members such as heaters. The heating temperature in the heat development section is a temperature sufficient for the heat development, and it is generally 110–140° C. Since the photothermographic material is subjected to a high temperature of 110° C. or higher in the heat development section, a part of the components contained in the material or a part of decomposition products produced by the heat development may be volatilized. It is known that these volatilized components invite various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination. For example, WO95/30933, WO97/21150 and International Patent Publication in Japanese (Kohyo) No. 10-500496 disclose use of a filter cartridge containing binding absorption particles and having a first vent for taking up volatilized components and a second vent for discharging them in a heating apparatus for heating a film by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention. Further, U.S. Pat. No. 4,518,845 and JP-B-3-54331 disclose structures comprising means for eliminating vapor from a film, pressing means for pressing the film to a heat-conductive member and means for heating the heat-conductive member. Furthermore, WO98/27458 discloses elimination of components volatilized from a film and increasing fog from a surface of the film. These techniques are also preferably used for the present invention.

Temperature distribution in the preheating section and the heat development section is preferably in the range of ±1° C. or less, more preferably ±0.5° C. or less, respectively.

The photothermographic material heated in the heat development section is then cooled in the gradual cooling section. It is preferred that the cooling should be gradually attained so that the photothermographic material should not physically deform, and the cooling rate is preferably 0.5–10° C./second.

An exemplary structure of heat development apparatus used for the image formation method of the present invention is shown in FIG. 1.

FIG. 1 depicts a schematic side view of a heat development apparatus. The heat development apparatus shown in FIG. 1 consists of a preheating section A for preheating a photothermographic material 10, a heat development section B for carrying out the heat development, and a gradual cooling section C for cooling the photothermographic material. The preheating section A comprises taking-in roller pairs 11 (upper rollers are silicone rubber rollers, and lower rollers are aluminum heating rollers). The Heat development section B is provided with multiple rollers 13 on the side contacting with the surface 10*a* of the side of the photothermographic material 10 on which the image-forming layer is formed, and a flat surface 14 adhered with non-woven fabric (composed of, for example, aromatic polyamide, Teflon™ etc.) or the like on the opposite side to be contacted with the back layer side surface 10*b* of the photothermographic material 10. The clearance between the rollers 13 and the flat surface 14 is suitably adjusted to a clearance that allows the transportation of the photothermographic material 10. The clearance is generally about 0–1 mm. In the heat development section B, heaters 15 (panel heaters etc.) are further provided over the rollers 13 and under the flat surface 14 so as to heat the photothermographic material 10 from the image-forming layer side and the back layer side. The gradual cooling section C is provided with taking-out roller pairs 12 for taking out the photothermographic material 10 from the heat development section B and guide panels 16.

The photothermographic material 10 is subjected to heat development while it is transported by the taking-in roller pairs 11 and then by the taking-out roller pairs 12.

After the light exposure, the photothermographic material 10 is carried into the preheating section A. In the preheating section A, the photothermographic material 10 is made into a flat shape, preheated and then transported into the heat development section B by the multiple taking-in rollers 12. The photothermographic material 10 carried into the heat development section B is inserted into the clearance between the multiple rollers 13 and the flat surface 14 and transported by driving of the rollers 13 contacting with the surface 10*a* of the photothermographic material 10, while the back layer side surface 10*b* slides on the flat surface 14. During the transportation, the photothermographic material 10 is heated to a temperature sufficient for the heat development by the heaters 15 from both of the image-forming layer side and the back layer side so that the latent image formed by the light exposure is developed. Then, the photothermographic material 10 is transported into the gradual cooling section C, and made into a flat shape and taken out from the heat development apparatus by the taking-out roller pairs 12.

The materials of the surfaces of the rollers 13 and the member of the flat surface 14 in the heat development section B may be composed of any materials so long as they have heat resistance and they should not cause any troubles in the transportation of the photothermographic material 10. However, the material of surfaces of the rollers 13 is preferably composed of silicone rubber, and the member of the flat surface 14 is preferably composed of non-woven fabric made of aromatic polyamide or Teflon (PTFE). Shape and number of the heaters 15 are not particularly limited so long as they can heat the photothermographic material 10 to a temperature sufficient for the heat development of the material. However, they preferably have such a configuration that heating temperature of each heater can be adjusted freely.

The photothermographic material 10 is heated in the preheating section A comprising the taking-in roller pairs 11 and the heat development section B comprising the heaters 15. Temperature of the preheating section A is desirably controlled to be lower than the heat development temperature (for example, lower by about 10–30° C.), and the temperature and time in this section are desirably adjusted so that they should be sufficient for evaporating solvent contained in the photothermographic material 10. The temperature is also preferably adjusted to be higher than the glass transition temperature (Tg) of the support of the photothermographic material 10 so that uneven development should be prevented. Temperature distribution in the preheating section and the heat development section is preferably in the range of ±1° C. or less, more preferably ±0.5° C. or less.

In the gradual cooling section C, in order to prevent deformation of the photothermographic material 10 due to rapid cooling, the guide panels 16 are preferably composed of a material showing low heat conductivity.

The photothermographic material of the present invention is preferably exposed and heat-developed in an on-line system comprising a plotter (light exposure apparatus), an auto carrier and a heat development apparatus (processor). The auto carrier automatically transports the exposed photothermographic material to the heat development apparatus. Although the transportation mechanism may be based on any of belt conveyor, roller transportation and so forth, roller transportation is preferred. Further, in the auto carrier, there is preferably provided a mechanism for preventing a heat flow from the heat development apparatus side to the light exposure apparatus side, and for example, a method of blowing a wind to the light exposure apparatus and the heat development apparatus from a lower position at the center of the auto carrier can be mentioned.

The development is preferably performed with such conditions that the line speed ratio of the preheating section and the heat development section should become 95.0–99.0% and the line speed ratio of the auto carrier and the preheating section should become 90.0–100.0%. If the line speed ratio of the preheating section and the heat development section is less than 95.0% and/or the line speed ratio of the auto carrier and the preheating section is less than 90.0%, scratches or jamming may be caused to degrade the transportability, and it becomes likely that uneven density is unfavorably generated.

The photothermographic material of the present invention is used in the form of, for example, a sheet having a width of 550–650 mm and a length of 1–65 m, and it is incorporated into the heat development system in a state that a part or all of the material is rolled around a core member of cylindrical shape so that the image-forming layer side should be exposed to the outside.

When the photothermographic material of the present invention is used for medical use, Fuji Medical Dry Laser Imager FM-DPL can be preferably used as a laser imager for medical use provided with a light exposure section and a heat development section. This system is explained in Fuji Medical Review, No. 8, pages 39–55. Further, the photothermographic material of the present invention can be preferably used as a photothermographic material for laser imagers in "AD network", which was proposed by Fuji Medical System as a network system that conforms to the DICOM standard.

Since the photothermographic material of the present invention can form images of high image quality excellent in sharpness and granularity and, in addition, provide cold monochromatic image color tone, it can be preferably used for medical use. For medical use, in particular, the γ value, which is represented by an inclination of a straight line connecting points corresponding to Dmin+density 0.3 and Dmin+density 3.0 on a characteristic curve, is preferably 2.0–5.0, more preferably 2.0–4.0, still more preferably 2.5–3.5. Further, when the photothermographic material of the present invention is subjected to light exposure and heat development at 121° C. for 24 seconds, it is preferred that 90% of developed silver grains in terms of grain number should be in contact with the silver halide for medical use. The photothermographic material of the present invention satisfying there requirements can form images of preferred color tone and gradation required for medical use.

The present invention will be further specifically explained with reference to the following examples and comparative examples. The materials, amounts, ratios, types of procedure, orders of procedure and so forth shown in the following examples can be optionally changed so long as such change does not depart from the spirit of the present invention. Therefore, the scope of the present invention is not limited by the following examples.

EXAMPLE 1

<<Preparation of Polyethylene Terephthalate Support>>

Polyethylene terephthalate (henceforth abbreviated as "PET") pellets were dried at 130° C. for 4 hours, melted at 300° C., then extruded from a T-die and rapidly cooled to form an unstretched film. The film was stretched along the longitudinal direction by 3.0 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Thereafter, the film was subjected to a heat treatment by passing it through a zone at 200° C. at a speed of 20 m/min over 10 minutes with a rolling up tension of 3.5 kg/cm$^2$.

Subsequently, the chuck of the tenter was released, the both edges of the film were knurled, and the film was rolled up with a force of 40 N. Thus, a roll of a PET film having a width of 2.4 m, length of 800 m and thickness of 130 $\mu$m was obtained. The PET film showed a glass transition temperature of 79° C.

The both surfaces of the biaxially stretched and thermally fixed PET support having a thickness of 130 $\mu$m, which was prepared as described above, was subjected to a corona discharge treatment of 8 W/m$^2$·minute.

<<Formation of Undercoat Layers>>

On one surface of the obtained support, Undercoat coating solution a-1 mentioned below was coated in such an amount that a dry film thickness of 0.8 $\mu$m should be obtained and dried to form Undercoat layer A-1, and on the opposite surface, Undercoat coating solution b-1 mentioned below containing an antistatic component was applied in such an amount that a dry film thickness of 0.8 $\mu$m should be obtained and dried to form Undercoat layer B-1 having antistatic property.

| Undercoat coating solution a-1 | |
|---|---|
| Copolymer latex solution (solid content: 30%, butyl acrylate/ tert-butyl acrylate/styrene/ 2-hydroxyethyl acrylate = 30/20/25/25 (weight %)) | 270 g |
| (C-1) | 0.6 g |
| Hexamethylene-1,6-bis (ethyleneurea) | 0.8 g |
| Polystyrene microparticles (mean particle size: 3 $\mu$m) | 0.05 g |
| Colloidal silica (mean particle size: 90 nm) | 0.1 g |
| Water | Amount giving a total volume of 1000 mL |

| Undercoat coating solution b-1 | |
|---|---|
| $SnO_2$/Sb (weight ratio: 9/1, mean particle size: 0.18 $\mu$m) | Amount giving coating amount of 200 mg/m$^2$ |
| Copolymer latex solution (solid content: 30%, butyl acrylate/ styrene/glycidyl acrylate = 30/20/40 (weight %) | 270 g |
| (C-1) | 0.6 g |
| Hexamethylene-1,6-bis (ethyleneurea) | 0.8 g |
| Water | Amount giving a total volume of 1000 mL |

The upper surfaces of Undercoat layer A-1 and Undercoat layer B-1 were subjected to a corona discharge treatment of 8 W/m$^2$·minute. On Undercoat layer A-1, Upper undercoat coating solution a-2 mentioned below was coated to form Upper undercoat layer A-2 having a dry film thickness of 0.1 $\mu$m, and on Undercoat layer B-1, Upper undercoat coating solution b-2 mentioned below was applied to form Upper undercoat layer B-2 having a dry film thickness of 0.8 $\mu$m and antistatic property.

| Upper undercoat coating solution a-2 | |
|---|---|
| Gelatin | Amount giving coated amount of 0.4 g/m$^2$ |
| (C-1) | 0.2 g |
| (C-2) | 0.2 g |
| (C-3) | 0.1 g |
| Silica particles (mean particle size: 3 $\mu$m) | 0.1 g |
| Water | Amount giving a total volume of 1000 mL |

| Upper undercoat coating solution b-2 | |
|---|---|
| (C-4) | 60 g |
| Latex solution containing (C-5) (solid content: 20%) | 80 g |
| Ammonium sulfate | 0.5 g |
| (C-6) | 12 g |
| Polyethylene glycol (weight average molecular weight: 600) | 6 g |
| Water | Amount giving a total volume of 1000 mL |

In the drying process of the aforementioned undercoated support, the support was heated at 150° C. and then gradually cooled. The rolling up tension was 3.6 kg/cm$^2$.

On the layer of B-2 of the support, a solution having the following composition was coated.

| | |
|---|---|
| Cellulose acetate butyrate (10% solution in methyl ethyl ketone) | 15 mL/m$^2$ |
| Dye A | 60 mg/m$^2$ |
| Matting agent (monodispersed silica, monodispersion degree: 15%, mean particle size: 8 $\mu$m) | 89 mg/m$^2$ |

-continued

| | |
|---|---|
| $C_8F_{17}(CH_2CH_2O)_{12}C_8F_{17}$ | 50 mg/m$^2$ |
| $C_9F_{19}$—$C_6H_4$—$SO_3Na$ | 10 mg/m$^2$ |

<<Formation of Image-Forming Layer and Surface Protective Layer>>

(Preparation of Silver Halide Emulsion)

In an amount of 7.5 g of inert gelatin and 10 mg of potassium bromide were dissolved in 900 mL of water, and the solution was adjusted to a temperature of 35° C. and pH 3.0, and added with 370 mL of an aqueous solution containing 74 g of silver nitrate and 370 mL of an aqueous solution containing sodium chloride, potassium bromide, potassium iodide in a molar ratio of 60/38/2, $[Ir(NO)Cl_5]$ salt in an amount of $1\times10^{-6}$ mole per mole of silver and rhodium chloride salt in an amount of $1\times10^{-6}$ mole per mole of silver by the controlled double jet method, while the pAg was kept at 7.7. Then, the solution was added with 4-hydroxy-6-methyl-1,3,3a,7-tetrazaindene and adjusted to pH 8.0 with NaOH and pAg 6.5 to perform reduction sensitization. Thus, cubic silver chloroiodobromide grains having a mean grain size of 0.06 μm, monodispersion degree of 10%, variation coefficient of 8% for diameter of projected area as circle and [100] face ratio of 87%. This emulsion was added with a gelatin coagulant to cause coagulation precipitation for desalting, added with 0.1 g of phenoxyethanol, adjusted to pH 5.9 and pAg 7.5 and then added with a compound shown in Table 1 (compound of any one of Types (i) to (iv)) in an amount of $5\times10^{-4}$ mole per mole of silver halide to obtain each of Silver halide emulsions A to I.

(Preparation of Sodium Behenate Solution)

In an amount of 32.4 g of behenic acid, 9.9 g of arachidic acid and 5.6 g of stearic acid were dissolved in 945 mL of pure water at 90° C. Then, the solution was added with 98 mL of 1.5 mol/L sodium hydroxide aqueous solution with stirring at high speed. Subsequently, the solution was added with 0.93 mL of concentrated nitric acid, cooled to 55° C. and stirred for 30 minutes to obtain a sodium behenate solution.

(Preparation of Preform Emulsion of Silver Behenate and Silver Halide Emulsion)

The aforementioned sodium behenate solution was added with the silver halide emulsion mentioned above, adjusted to pH 8.1 with a sodium hydroxide solution, then added with 147 mL of 1 mol/L silver nitrate solution over 7 minutes, and stirred for 20 minutes, and water-soluble salts were removed by ultrafiltration. The produced silver behenate was in the form of grains having a mean grain size of 0.8 μm and monodispersion degree of 8%. After flocculates of the dispersion was formed, water was removed and the residue was subjected to 6 times of washing with water and removal of water and dried to obtain a preform emulsion.

(Preparation of Photosensitive Emulsion)

The aforementioned preform emulsion was divided into portions and gradually added with 544 g of a solution of polyvinyl butyral (average molecular weight: 3,000) in methyl ethyl ketone (17 weight %) and 107 g of toluene, mixed and then dispersed at 30° C. for 10 minutes in a media dispersing machine utilizing a bead mill containing $ZrO_2$ having a size of 0.5 mm at 4000 psi to prepare a photosensitive emulsion. After the dispersion, the organic silver grains were examined by electron microphotography. As a result of measurement of grain size and thickness of 300 organic silver grains, it was found that 205 or more of the grains were monodispersed tabular organic silver grains having AR of 3 or more and monodispersion degree of 25%. The mean grain size was 0.7 μm. Moreover, the organic silver grains were examined also after coating and drying, and the same grains could be confirmed.

The both surfaces of the aforementioned support were simultaneously coated with the following layers to prepare a sample. The layers were dried at 60° C. for 15 minutes.

(Formation of Image-Forming layer)

A solution having the following composition was applied to the layer of A-1 of the support so that the coated silver amount should become 1.5 g/m$^2$ to form an image-forming layer.

| | |
|---|---|
| Photosensitive emulsion mentioned above | 240 g |
| Sensitizing dye (0.1% methanol solution) | 1.7 mL |
| Pyridinium perbromide (6% methanol solution) | 3 mL |
| Calcium bromide (0.1% methanol solution) | 1.7 mL |
| Oxidizing agent (10% methanol solution) | 1.2 mL |
| Antifoggant | 1.0 g |
| 2-Mercaptobenzimidazole (1% methanol solution) | 11 mL |
| Tribromomethylsulfoquinoline (5% methanol solution) | 8 mL |
| Tribromomethylsulfopyridine (5% methanol solution) | 9 mL |
| High contrast agent | 0.4 g |
| Hydrazine 1 | 0.3 g |
| Phthalazine | 0.6 g |
| 4-Methylphthalic acid | 0.25 g |
| Tetrachlorophthalic acid | 0.2 g |
| Calcium carbonate (mean particle size: 3 μm) | 0.1 g |
| Isocyanate compound (Desmodur N3300) | 0.5 g |
| 1,1-Bis(2-hydroxy-3,5-dimethylphenyl)-2-methylpropane (20% methanol solution) | 5.0 mL |
| 1,1-Bis(2-hydroxy-3,5-dimethylphenyl)-3,5,5-trimethylhexane (20% methanol solution) | 6.0 mL |

(Formation of Surface Protective Layer)

A solution having the following composition was applied on the image-forming layer simultaneously with the image-forming layer to form a surface protective layer.

| | |
|---|---|
| Acetone | 5 mL/m$^2$ |
| Methyl ethyl ketone | 21 mL/m$^2$ |
| Cellulose acetate butyrate | 2.3 g/m$^2$ |
| Methanol | 7 mL/m$^2$ |
| Phthalazine | 250 mg/m$^2$ |
| Matting agent (monodispersed silica, monodispersion degree: 10%, mean grain size: 4 μm) | 5 mg/m$^2$ |
| $CH_2$=$CHSO_2CH_2CONHCH_2CH_2NHCOCH_2SO_2CH$=$CH_2$ | 35 mg/m$^2$ |
| Fluorine-containing surfactants | |
| $C_{12}F_{25}(CH_2CH_2O)_{10}C_{12}F_{25}$ | 10 mg/m$^2$ |
| $C_8F_{17}$—$C_6H_4$—$SO_3Na$ | 10 mg/m$^2$ |

<<Evaluation>>

The following performance evaluation was performed for each of the photothermographic materials prepared as described above.

(Light Exposure)

The obtained photothermographic material was light exposed for $1.2\times10^{-8}$ second by using a laser light-exposure apparatus of single channel cylindrical internal surface scanning type provided with a semiconductor laser with a beam diameter (½ of FWHM of beam intensity) of 12.56 μm, laser output of 50 mW and output wavelength of 783 nm at a mirror revolution number of 60000 rpm. The overlap coefficient of the light exposure was 0.449, and the laser energy density on the photothermographic material surface was 75 $\mu J/cm^2$. A test step was output at 175 lines/inch with varying exposure by using the aforementioned laser exposure apparatus.

(Heat Development)

Each light-exposed photothermographic material was heat-developed by using such a heat development apparatus as shown in FIG. 1. The heat development was performed under an environment of 25° C. and relative humidity of 50%. The roller surface material of the heat development section was composed of silicone rubber, and the flat surface consisted of Teflon non-woven fabric. The heat development was performed at a transportation line speed of 25 mm/second for 12.2 seconds in the preheating section (driving units of the preheating section and the heat development section were independent from each other, and speed difference of the preheating section as to the heat development section was adjusted to −0.5% to −1%, temperatures of each of the metallic rollers and processing times in the preheating section were as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), for 17.2 seconds in the heat development section at 120° C. (surface temperature of photothermographic material), and for 13.6 seconds in the gradual cooling section. The temperature precision as for the transverse direction was ±0.5° C. As for temperature setting of each roller, the temperature precision was secured by using a length of rollers longer than the width of the photothermographic material (for example, width of 61 cm) by 5 cm for the both sides and also heating the protruding portions. Since the rollers showed marked temperature decrease at the both end portions, the temperature of the portions protruding by 5 cm from the ends of the photothermographic material was controlled to be higher than that of the roller center by 1–3° C., so that uniform image density of finished developed image should be obtained for the photothermographic material (for example, within a width of 61 cm).

(Evaluation Method)

Dmin (fog) and Dmax (maximum density) of images were evaluated by using a Macbeth TD904 densitometer (visible density). Sensitivity was represented with a reciprocal of exposure giving a density of 1.5 and referred to as S1.5. Photographic sensitivity of Sample No. 1 was represented as 100 as a relative value. A larger value means higher sensitivity. As an index representing contrast of images, γ (gradation) was obtained as follows. A point corresponding to Dmin+density 0.3 and a point corresponding to Dmin+density 3.0 on the characteristic curve were connected with a straight line, and the inclination of this straight line was used as γ value. That is, γ is given by an equation: γ=(3.0−0.3)/(log(Exposure giving density of 3.0)−log(Exposure giving density of 0.3)), and a larger γ value means photographic characteristic of higher contrast.

Dmin is preferably 0.15 or less, Dmax is preferably 4.0 or more, and contrast is preferably 15 or more for practical use.

The results of the aforementioned evaluation performed for each of the photothermographic materials are shown in Table 1. As seen from the results shown in Table 1, the photothermographic materials of the present invention utilizing compounds of Types (i) to (iv) exhibited low Dmin, high Dmax (maximum dendity), high sensitivity and high contrast (γ). Further, it can also be seen that the photothermographic materials of the present invention exhibited high Dmax and γ even with a line speed of 30 mm/second for transportation in the heat development section, and such a speed may be practically used.

TABLE 1

| Sample No. | Emulsion | Compound of Type (i), (ii), (iii) or (iv) | Photographic Performance: Line speed 25 mm/second Dmin | Sensitivity | γ | Dmax | Line speed 30 mm/second Dmin | Sensitivity | γ | Dmax | Note |
|---|---|---|---|---|---|---|---|---|---|---|---|
| 1 | A | — | 0.12 | 100 | 16 | 4.5 | 0.11 | 55 | 12 | 3.5 | Comparative |
| 2 | B | 3 | 0.13 | 215 | 17 | 4.6 | 0.12 | 120 | 15 | 4.3 | Invention |
| 3 | C | 8 | 0.13 | 200 | 17 | 4.6 | 0.12 | 110 | 15 | 4.3 | |
| 4 | D | 9 | 0.12 | 190 | 18 | 4.5 | 0.11 | 105 | 15 | 4.2 | |
| 5 | E | 10 | 0.12 | 180 | 16 | 4.5 | 0.11 | 100 | 15 | 4.2 | |
| 6 | F | 11 | 0.12 | 175 | 17 | 4.5 | 0.11 | 100 | 16 | 4.1 | |
| 7 | G | 12 | 0.12 | 185 | 16 | 4.5 | 0.11 | 105 | 15 | 4.2 | |
| 8 | H | 13 | 0.12 | 180 | 17 | 4.5 | 0.11 | 100 | 16 | 4.1 | |
| 9 | I | 24 | 0.12 | 195 | 16 | 4.5 | 0.11 | 110 | 16 | 4.1 | |
| 10 | J | 34 | 0.12 | 180 | 17 | 4.5 | 0.11 | 100 | 15 | 4.1 | |
| 11 | K | 41 | 0.12 | 190 | 17 | 4.6 | 0.11 | 105 | 16 | 4.2 | |
| 12 | L | 46 | 0.12 | 195 | 17 | 4.5 | 0.11 | 110 | 15 | 4.1 | |
| 13 | M | 56 | 0.12 | 200 | 16 | 4.5 | 0.11 | 105 | 16 | 4.1 | |

(C-1)

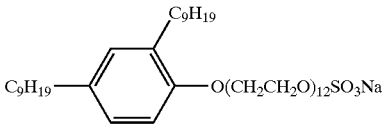

(C-2)

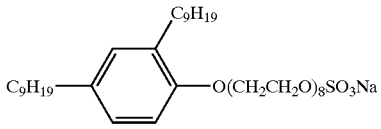

-continued
(C-3)
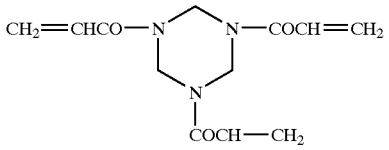
(C-4)
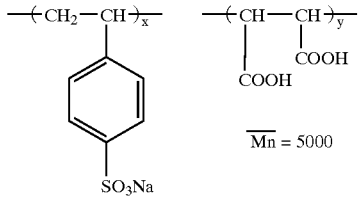
(Mn: number average molecular weight)
x:y = 76:25(weight ratio)
(C-5)
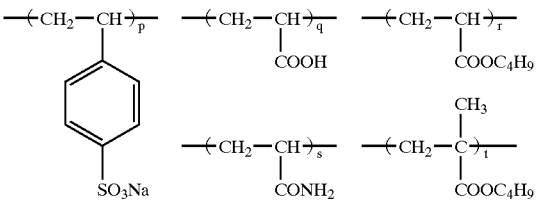
p:q:r:s:t = 40:5:10:5:40(weight ratio)
(C-6)
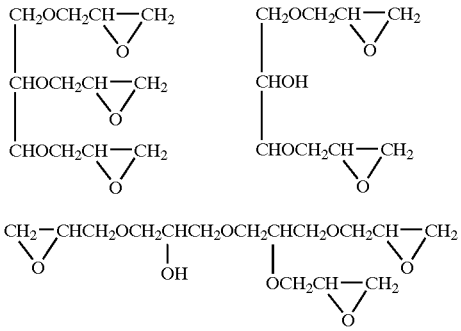
Mixture of the three compounds
Sensitizing dye
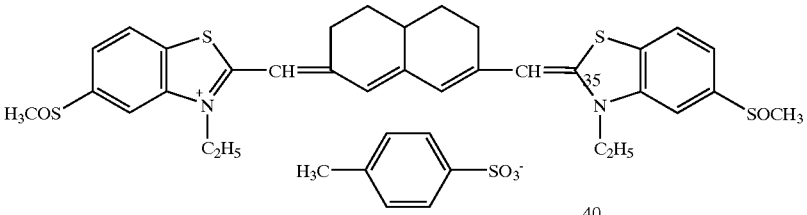
Oxidizing agent
Dye A
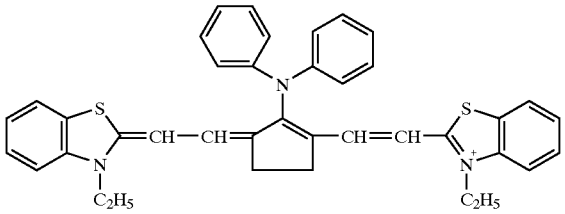
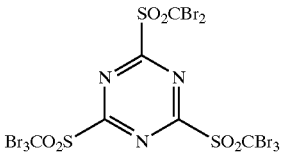
Antifoggant
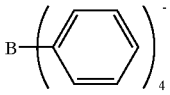
High contrast agent
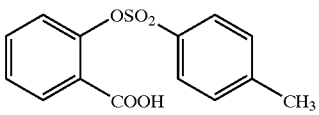
Hydrazine 1
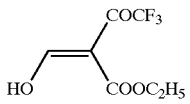
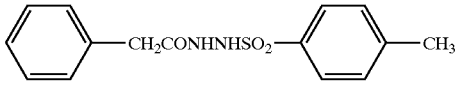

EXAMPLE 2

<<Preparation of PET Support>>

PET having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, then melted at 300° C., extruded from a T-die and rapidly cooled to form an unstretched film having such a thickness that the thickness should become 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4 m, length of 3500 m and thickness of 120 μm was obtained.

The obtained PET support was subjected to a corona discharge treatment of 0.375 kV·A·minute/m$^2$.

<<Formation of Undercoat Layers>>

(i) First Undercoat Layer

A coating solution having the following composition was M2 coated on the support in an amount of 6.2 mL/m$^2$, and dried at 125° C. for 30 seconds, 150° C. for 30 seconds and 185° C. for 30 seconds.

| | |
|---|---|
| Latex A | 280 g |
| KOH | 0.5 g |
| Polystyrene microparticles (mean particle diameter: 2 μm, variation coefficient of 7% for mean particle diameter) | 0.03 g |
| 2,4-Dichloro-6-hydroxy-s-triazine | 1.8 g |
| Compound Bc-C | 0.097 g |
| Distilled water | Amount giving total weight of 1000 g |

(ii) Second Undercoat Layer

A coating solution having the following composition was coated on the first undercoat layer in an amount of 5.5 mL/m$^2$ and dried at 125° C. for 30 seconds, 150° C. for 30 seconds and 170° C. for 30 seconds.

| | |
|---|---|
| Deionized gelatin ($Ca^{2+}$ content: 0.6 ppm, jelly strength: 230 g) | 10 g |
| Acetic acid (20 weight % aqueous solution) | 10 g |
| Compound Bc-A | 0.04 g |
| Methyl cellulose (2 weight % aqueous solution) | 25 g |
| Polyethyleneoxy compound | 0.3 g |
| Distilled water | Amount giving total weight of 1000 g |

(iii) First Back Layer

The surface of the support opposite to the surface coated with the undercoat layers was subjected to a corona discharge treatment of 0.375 kV·A·minute/m$^2$, coated with a coating solution having the following composition in an amount of 13.8 mL/m$^2$, and dried at 125° C. for 30 seconds, 150° C. for 30 seconds and 185° C. for 30 seconds.

| | |
|---|---|
| Julimer ET-410 (30 weight % aqueous dispersion Nihon Junyaku Co., Ltd.) | 23 g |
| Alkali-treated gelatin (molecular weight: about 10,000, $Ca^{2+}$ content: 30 ppm) | 4.44 g |
| Deionized gelatin ($Ca^{2+}$ content: 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Aqueous dispersion of Sb-doped $SbO_2$ acicular grains (FS-10D, Ishihara Sangyo Kaisha, Ltd.) | 24 g |
| Polystyrene microparticles (mean diameter: 2.0 μm, variation coefficient of 7% for mean particle diameter) | 0.03 g |
| Distilled water | Amount giving total weight of 1000 g |

(iv) Second Back Layer

A coating solution having the following composition was coated on the first back layer in an amount of 5.5 mL/m$^2$ and dried at 125° C. for 30 seconds, 150° C. for 30 seconds and 170° C. for 30 seconds.

| | |
|---|---|
| Julimer ET-410 (30 weight % aqueous dispersion Nihon Junyaku Co., Ltd.) | 57.5 g |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Cellosol 524 (30 weight % aqueous solution, Chukyo Yushi Co., Ltd.) | 6.6 g |
| Distilled water | Amount giving total weight of 1000 g |

(v) Third Back Layer

The same coating solution as that for the first undercoat layer was coated on the second back layer in an amount of 6.2 mL/m$^2$ and dried at 125° C. for 30 seconds, 150° C. for 30 seconds and 185° C. for 30 seconds.

(vi) Fourth Back Layer

A coating solution having the following composition was coated on the third back layer in an amount of 13.8 mL/m$^2$ and dried at 125° C. for 30 seconds, 150° C. for 30 seconds and 170° C. for 30 seconds.

| | |
|---|---|
| Latex B | 286 g |
| Compound Bc-B | 2.7 g |
| Compound Bc-C | 0.6 g |
| Compound Bc-D | 0.5 g |
| 2,4-Dichloro-6-hydroxy-s-triazine | 2.5 g |
| Polymethyl methacrylate | 7.7 g |

-continued

| | |
|---|---|
| (10 weight % aqueous dispersion, mean particle diameter: 5 μm, variation coefficient of 7% for mean particle diameter) | |
| Distilled water | Amount giving total weight of 1000 g |

Latex A

Core/shell type latex comprising 90 weight % of core and 10 weight % of shell,

Core: copolymer of vinylidene chloride/methyl acrylate/methyl methacrylate/acrylonitrile/acrylic acid=93/3/3/0.9/0.1 (weight %), Shell: copolymer of vinylidene chloride/methyl acrylate/methyl methacrylate/acrylonitrile/acrylic acid=88/3/3/3/3 (weight %) Weight average molecular weight: 38000

Latex B

Latex of copolymer of methyl methacrylate/styrene/2-ethylhexyl acrylate/2-hydroxyethyl methacrylate/acrylic acid=59/9/26/5/1 (weight %)

(Heat Treatment During Transportation)

The PET support with back layers and undercoat layers prepared as described above was introduced into a heat treatment zone having a total length of 200 m set at 160° C., and transported at a tension of 2 kg/cm$^2$ and a transportation speed of 20 m/minute.

Following the aforementioned heat treatment, the support was subjected to a post-heat treatment by passing it through a zone at 40° C. for 15 seconds, and rolled up. The rolling up tension for this operation was 10 kg/cm$^2$.

<<Formation of Image-Forming Layer etc.>>

(Preparation of Silver Halide Emulsions)

In 700 mL of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 45° C., 159 mL of an aqueous solution containing 18.6 g of silver nitrate and an aqueous solution containing 1 mol/L of potassium bromide, $5\times10^{-6}$ mol/L of $(NH_4)_2RhCl_5(H_2O)$ and $2\times10^{-5}$ mol/L of $K_3IrCl_6$ were added by the control double jet method over 6 minutes and 30 seconds while pAg was maintained at 7.7. Then, 476 mL of an aqueous solution containing 55.5 g of silver nitrate and a halide salt aqueous solution containing 1 mol/L of potassium bromide and $2\times10^{-5}$ mol/L of $K_3IrCl_6$ were added by the control double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.11 μm, variation coefficient of 9% for projected area and [100] face ratio of 90%.

The temperature of the silver halide grains obtained as described above was raised to 60° C., and the grains were added with 76 μmol per mole of silver of sodium benzenethiosulfonate. After 3 minutes, 71 μmol per mole of silver of triethylthiourea was further added, and the grains were ripened for 100 minutes, then added with $5\times10^{-4}$ mol/L of 4-hydroxy-6-methyl-1,3,3a,7-tetrazaindene and 0.17 g of Compound A, and cooled to 40° C.

Then, while the mixture was maintained at 40° C., it was added with a compound shown in Table 2 (compound of any one of Types (i) to (iv), added as solution in methanol), potassium bromide (added as aqueous solution), Sensitizing Dye A' mentioned below (added as solution in ethanol) and Compound B mentioned below (added as solution in methanol) in amounts of $1\times10^{-3}$ mole, $4.7\times10^{-2}$ mole, $12.8\times10^{-4}$ mole and $6.4\times10^{-3}$ mole, respectively, per mole of the silver halide with stirring. After 20 minutes, the emulsion was quenched to 30° C. to complete the preparation of each of Silver halide emulsions a to i. The obtained Silver halide emulsions a to i were used for the preparation of coating solution described below.

(Preparation of Silver Behenate Dispersion A)

In an amount of 87.6 kg of behenic acid (Edenor C22-85R, produced by Henkel Co.), 423 L of distilled water, 49.2 L of 5 mol/L aqueous solution of NaOH and 120 L of tert-butanol were mixed and allowed to react with stirring at 75° C. for one hour to obtain a solution of sodium behenate. Separately, 206.2 L of an aqueous solution containing 40.4 kg of silver nitrate was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous solution of sodium behenate should be added for 9 minutes and 30 seconds after finishing the addition of the aqueous silver nitrate solution. During the addition, the temperature was controlled so that the temperature in the reaction vessel should be 30° C. and the liquid temperature should not be raised. The piping of the addition system for the sodium behenate solution was warmed by steam trace and the steam amount was controlled so that the liquid temperature at the outlet orifice of the addition nozzle should be 75° C. Further, the piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 μS/cm. The solid content obtained as described above was stored as a wet cake without being dried.

When the shape of the obtained silver behenate grains was evaluated by electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content were added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight average diameter of 0.52 μm and variation coefficient of 15%. The measurement of the grain size was carried out by using Master Sizer X produced by Malvern Instruments Ltd. When the grains were evaluated by electron microscopic photography, the ratio of the long side to the short side was 1.5, the grain thickness was 0.14 μm, and the mean aspect ratio (ratio of diameter as circle of projected area of grain and grain thickness) was 5.1. The obtained Silver behenate dispersion A was used for the preparation of the coating solution described below.

(Preparation of Solid Microparticle Dispersion of Reducing Agent)

In an amount of 10 kg of reducing agent [1,1-bis(2-hydroxy-3,5-dimethylphenyl)-3,5,5-trimethylhexane] and 10 kg of 20 weight % aqueous solution of denatured polyvinyl alcohol (Poval MP203, produced by Kuraray Co. Ltd.) were added with 400 g of Safinol 104E (Nisshin Kagaku Co.), 640 g of methanol and 16 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 4 hours. Then, the slurry was added with 4 g of benzoisothiazolinone sodium salt and water so that the concentration of the reducing agent should become 25 weight % to obtain a solid microparticle dispersion of the reducing agent. The reducing agent particles contained in the obtained dispersion had a mean particle diameter of 0.43 μm, maximum particle diameter of 2.0 μm or less and variation coefficient of 35% for mean particle diameter. The obtained dispersion was filtered through a polypropylene filter having a pore size of 3.0 μm to remove contaminants such as dusts and stored. The obtained solid microparticle dispersion of reducing agent was used for the preparation of the coating solution described below.

(Preparation of Solid Microparticle Dispersion of Organic Polyhalogenated Compound A)

In an amount of 10 kg of Organic polyhalogenated compound A [tribromomethyl(4-(2,4,6-trimethylphenylsulfonyl)phenyl)sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 6 hours. Then, the slurry was added with water so that the concentration of Organic polyhalogenated compound A should become 25 weight % to obtain solid microparticle dispersion of Organic polyhalogenated compound A. The particles of the organic polyhalogenated compound contained in the dispersion obtained as described above had a mean particle diameter of 0.31 μm, maximum particle diameter of 2.0 μm or less and variation coefficient of 28% for mean particle diameter. The obtained dispersion was filtered through a polypropylene filter having a pore size of 3.0 μm to remove contaminants such as dusts and stored. The obtained solid microparticle dispersion of Organic polyhalogenated compound A was used for the preparation of the coating solution described below.

(Preparation of Solid Microparticle Dispersion of Organic Polyhalogenated Compound B)

In an amount of 5 kg of Organic polyhalogenated compound B [tribromomethylnaphthylsulfone], 2.5 kg of 20 weight % aqueous solution of denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 6 hours. Then, the slurry was added with 2.5 g of benzoisothiazolinone sodium salt and water so that the concentration of Organic polyhalogenated compound B should become 23.5 weight % to obtain solid microparticle dispersion of Organic polyhalogenated compound B. The particles of the organic polyhalogenated compound contained in the obtained dispersion had a mean particle diameter of 0.35 μm, maximum particle diameter of 2.0 μm or less and variation coefficient of 21% for mean particle diameter. The obtained dispersion was filtered through a polypropylene filter having a pore size of 3.0 μm to remove contaminants such as dusts and stored. The obtained solid microparticle dispersion of Organic polyhalogenated compound B was used for the preparation of the coating solution described below.

(Preparation of Aqueous Solution of Organic Polyhalogenated Compound C)

In an amount of 75.0 mL of water, 8.6 mL of 20 weight % aqueous solution of sodium triisopropylnaphthalenesulfonate, 6.8 mL of 5 weight % aqueous solution of sodium dihydrogenorthophosphate dihydrate and 9.5 mL of 1 mol/L aqueous solution of potassium hydroxide were successively added at room temperature with stirring, and the mixture was stirred for 5 minutes after the addition was completed. Further, the mixture was added with 4.0 g of Organic polyhalogenated compound C [3-tribromomethanesulfonylbenzoylaminoacetic acid] as powder, and it was uniformly dissolved until the solution became transparent to obtain 100 mL of aqueous solution of Organic polyhalogenated compound C.

The obtained aqueous solution was filtered through a polyester screen of 200 mesh to remove contaminants such as dusts and stored. The obtained aqueous solution of Organic polyhalogenated compound C was used for the preparation of the coating solution described below.

(Preparation of Solid Microparticle Dispersion of Organic Polyhalogenated Compound D)

In an amount of 6 kg of Organic polyhalogenated compound D, 12 kg of 10 weight % aqueous solution of denatured polyvinyl alcohol (Poval MP203, produced by Kuraray Co. Ltd.), 240 g of 20 weight % aqueous solution of sodium triisopropylnaphthalenesulfonate and 0.18 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 6 hours. Then, the slurry was added with 2 g of benzoisothiazolinone sodium salt and water so that the concentration of Organic polyhalogenated compound D should become 30 weight % to obtain solid microparticle dispersion of Organic polyhalogenated compound D. The particles of the organic polyhalogenated compound contained in the dispersion obtained as described above had a mean particle diameter of 0.37 μm, maximum particle diameter of 2.0 μm or less and variation coefficient of 23% for mean particle diameter. The obtained dispersion was filtered through a polypropylene filter having a pore size of 3.0 μm to remove contaminants such as dusts and stored. The obtained solid microparticle dispersion of Organic polyhalogenated compound D was used for the preparation of the coating solution described below.

(Preparation of Emulsion Dispersion of Compound Z)

In an amount of 10 kg of R-054 (Sanko Co., Ltd.) containing 85 weight % of Compound Z was mixed with 11.66 kg of MIBK and dissolved in the solvent at 80° C. for 1 hour in an atmosphere substituted with nitrogen. This solution was added with 25.52 kg of water, 12.76 kg of 20 weight % aqueous solution of MP polymer (MP-203, produced by Kuraray Co. Ltd.) and 0.44 kg of 20 weight % aqueous solution of sodium triisopropylnaphthalenesulfonate and subjected to emulsion dispersion at 20–40° C. and 3600 rpm for 60 minutes. The dispersion was further added with 0.08 kg of Safinol 104E (Nisshin Kagaku Co.) and 47.94 kg of water and distilled under reduced pressure to remove MIBK. Then, the concentration of Compound Z was adjusted to 10 weight %. The particles of Compound Z contained in the dispersion obtained as described above had a mean particle diameter of 0.19 μm, maximum particle diameter of 1.5 μm or less and variation coefficient of 17% for mean particle diameter. The obtained dispersion was filtered through a polypropylene filter having a pore size of 3.0 μm to remove contaminant such as dusts and stored.

(Preparation of Solid Microparticle Dispersion of High Contrast Agent X-1)

In an amount of 4 kg of High contrast agent X-1 was added with 1 kg of polyvinyl alcohol (Poval PVA-217, produced by Kuraray Co., Ltd.) and 36 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 13 hours. Then, the slurry was added with 4 g of benzoisothiazolinone sodium salt and water so that the concentration of the high contrast agent should become 10 weight % to obtain solid microparticle dispersion of the high contrast agent. The particles of the high contrast agent contained in the dispersion obtained as described above had a mean particle diameter of 0.33 μm, maximum particle diameter of 3.0 μm or less, and variation coefficient of 24% for the mean particle diameter. The obtained dispersion was filtered through a polypropylene filter having a pore size of 3.0 μm to remove contaminants such as dusts and stored.

(Preparation of Aqueous Solution of High Contrast Agent X-2)

In an amount of 4 kg of High contrast agent X-2, 6.9 kg of methanol and 61.8 kg of water were successively added. After the addition, they were mixed by stirring at 35° C., and dissolution was attained until the solution became transparent to obtain 72.7 kg of aqueous solution.

The obtained aqueous solution was filtered through a polyester screen of 200 mesh to remove contaminants such as dusts and stored. The obtained aqueous solution of High contrast agent X-2 was used for the preparation of the coating solution described below.

(Preparation of Solid Microparticle Dispersions of Development Accelerator)

In an amount of 10 kg of Development accelerator W1, 10 kg of 20 weight % aqueous solution of denatured polyvinyl alcohol (Poval MP203, produced by Kuraray Co., Ltd.) and 20 kg of water were added and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 6 hours. Then, the slurry was added with water so that the concentration of the development accelerator should become 20 weight % to obtain a solid microparticle dispersion of development accelerator. The particles of the development accelerator contained in the dispersion obtained as described above had a mean particle diameter of 0.37 μm, maximum particle diameter of 2.0 μm or less, and variation coefficient of 26% for the mean particle diameter. Development accelerator W2 was also dispersed in the same manner, and the particles of the development accelerator contained in the obtained dispersion had a mean particle diameter of 0.35 μm, maximum particle diameter of 2.0 μm or less, and variation coefficient of 33% for the mean particle diameter. The obtained dispersions were filtered through a polypropylene filter having a pore size of 3.0 μm to remove contaminants such as dusts and stored. The obtained solid microparticle dispersions of development accelerator were used for the preparation of the coating solution described below. dusts and so forth, and used for the preparation of the coating solution described below.

(Preparation of Coating Solution for Image-Forming Layer)

Silver behenate dispersion A prepared above was added with the following binder, materials and silver halide emulsion in the indicated amounts per mole of silver in Silver behenate dispersion A, and added with water to prepare a coating solution for image-forming layer. After the completion, the solution was degassed under reduced pressure of 0.54 atm for 45 minutes. The coating solution showed pH of 7.7 and viscosity of 50 mPa·s at 25° C.

| | |
|---|---|
| Binder: SBR latex (St/Bu/AA = 68/29/3 (weight %), glass transition temperature: 17° C. (calculated value) , $Na_2S_2O_8$ was used as polymerization initiator, pH was adjusted to 6.5 with NaOH, mean particle diameter: 118 nm) | 397 g as solid |
| 1,1-Bis(2-hydroxy-3,5-dimethylphenyl)-3,5,5-trimethylhexane | 149.5 g as solid |
| Organic polyhalogenated compound B | 36.3 g as solid |
| Organic polyhalogenated compound C | 2.34 g as solid |
| Sodium ethylthiosulfonate | 0.47 g |
| Benzotriazole | 1.02 g |
| Polyvinyl alcohol (PVA-235, produced by Kuraray Co., Ltd.) | 10.8 g |
| 6-Isopropylphthalazine | 12.8 g |
| Compound Z | 9.7 g as solid |
| High contrast agent X-1 | 12.7 g |
| Dye A (added as a mixture with low molecular weight gelatin having mean molecular weight of 15,000) | Amount giving optical density of 0.3 at 783 nm (about 0.40 g as solid) |
| Silver halide emulsion (mentioned in Table 2) | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

pH was adjusted by using NaOH as a pH adjusting agent. (The coated film showed a glass transition temperature of 17° C.)

(Preparation of Coating Solution for Protective Layer)

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 116 nm) was added with water, 1.62 g of Compound E, 114.8 g of the aqueous solution of Organic polyhalogenated compound C, 17.0 g as solid content of Organic polyhalogenated compound A, 0.69 g as solid content of sodium dihydrogenorthophosphate dihydrate, 11.55 g as solid content of Development accelerator W1, 1.58 g of matting agent (polystyrene particles, mean particle diameter: 7 μm, variation coefficient of 8% for mean particle diameter) and 29.3 g of polyvinyl alcohol (PVA-235, Kuraray Co., Ltd.), and further added with water to form a coating solution (containing 0.8 weight % of methanol solvent).

After the preparation, the solution was degassed under reduced pressure of 0.47 atm for 60 minutes. The obtained coating solution showed pH of 5.5 and viscosity of 45 mPa·s at 25° C.

(Preparation of Coating Solution for Lower Overcoat Layer)

In an amount of 625 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 74 nm) was added with water, 0.23 g of Compound C, 0.13 g of Compound E, 11.7 g of Compound F, 2.7 g of Compound H and 11.5 g of polyvinyl alcohol (PVA-235, Kuraray Co., Ltd.), and further added with water to form a coating solution (containing 0.1 weight % of methanol solvent). After the preparation, the solution was degassed under reduced pressure of 0.47 atm for 60 minutes. The obtained coating solution showed pH of 2.6 and viscosity of 30 mPa·s at 25° C.

(Preparation of Coating Solution for Upper Overcoat Layer)

In an amount of 649 g of polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of the copolymer: 46° C. (calculated value), solid content: 21.5 weight %, the solution contained Compound A at a concentration of 100 ppm and further contained Compound D as a film-forming aid in an amount of 15 weight % relative to solid content of the latex so that the glass transition temperature of coating solution should become 24° C., mean particle diameter: 116 nm) was added with water, 18.4 g of 30 weight % solution of carnauba wax (Cellosol 524, Chukyo Yushi Co., Ltd., silicone content: less than 5 ppm), 0.23 g of Compound C, 1.85 g of Compound E, 1.0 g of Compound G, 3.45 g of matting agent (polystyrene particles, mean diameter: 7 μm, variation coefficient for mean particle diameter: 8%) and 26.5 g of polyvinyl alcohol (PVA-235, Kuraray Co., Ltd.) and further added with water to form a coating solution (containing 1.1 weight % of methanol solvent). After the preparation, the coating solution was degassed under a reduced pressure of 0.47 atm for 60 minutes. The obtained coating solution showed pH of 5.3 and viscosity of 25 mPa·s at 25° C.

(Preparation of Photothermographic Material)

On the second undercoat layer of the PET support, the aforementioned coating solution for image-forming layer was coated so that the coated silver amount should become 1.5 g/m$^2$ by the slide bead method disclosed in JP-A-2000-2964, FIG. 1. On the image-forming layer, the aforementioned coating solution for protective layer was coated simultaneously with the coating solution for image-forming layer as stacked layers so that the coated solid content of the polymer latex should become 1.29 g/m$^2$. Then, the aforementioned coating solution for lower overcoat layer and coating solution for upper overcoat layer were simultaneously coated on the protective layer as stacked layers, so that the coated solid contents of the polymer latex should become 1.97 g/m$^2$ and 1.07 g/m$^2$, respectively, to prepare a photothermographic material.

After the coating, the layers were dried in a horizontal drying zone (the support was at an angle of 1.5–3° to the horizontal direction of the coating machine) under the conditions of dew point of 14–25° C. and liquid film surface temperature of 35–40° C. for both of the constant rate drying process and the decreasing rate drying process until it reached around a drying point where flow of coating solutions substantially ceased. After the drying, the material was rolled up under the conditions of a temperature of 23±5° C. and relative humidity of 45±5%. The material was rolled up in such a rolled shape that the image-forming layer side should be toward the outside so as to conform to the subsequent processing (image-forming layer outside roll). The relative humidity in the package of the photothermographic material was 20–40% (measured at 25° C.). Each obtained photothermographic material showed a film surface pH of 5.0 for the image-forming layer side. The opposite surface showed a film surface pH of 5.9. From each photothermographic material, a light-shielded photosensitive material roll was prepared as follows.

(Preparation of Light-Shielding Leader)

Light shielding films (low density polyethylene sheets containing 5 weight % of carbon black and having a thickness of 30 μm) were adhered to both surfaces of a shrink film having a thickness of 30 μm (TNS, Gunze Ltd.) to prepare heat-shrinkable light-shielding film strips. The obtained heat-shrinkable light-shielding film strips showed heat shrinking ratios of 13.3% for the length direction and 11.9% for the width direction at 100° C., and Elmendorf tear load of 0.43 N along the length direction. These heat-shrinkable light-shielding film strips were adhered on both sides of a light-shielding sheet, consisting of a PET sheet having a thickness of 100 μm and low density polyethylene sheets containing 5 weight % of carbon black and having a thickness of 40 μm adhered on the both surfaces of the PET sheet, along the side ends so that the strips each should extend from the light-shielding sheet in the transverse direction to produce a light-shielding leader.

(Production of Light-Shielded Photosensitive Material Roll)

The above light-shielding leader was adhered to an end of rolled photosensitive material with an adhesive tape, and disk-shaped light-shielding members were attached to the both ends of the light-sensitive material roll. Subsequently, the light-shielding leader of the rolled light-sensitive material was wound around the photosensitive material roll, while blowing the surfaces of the heat-shrinkable light-shielding film strips of the light-shielding leader with a hot wind at 270° C. so that the heat-shrinkable light-shielding film strips of the light-shielding leader should be contacted with the outside surfaces of the disk-shaped light-shielding members in a heat-shrunk state exceeding the outer peripheries thereof. Further, the end of the rolled light-shielding leader and the outside surface of light-shielding leader at a position corresponding to the previous round of winding were fixed with an adhesive, and then heaters at 130° C. were pressed against the surfaces of the heat-shrinkable light-shielding film strips adhered to the outside surfaces of the disk-shaped light-shielding members to fuse the outside surfaces of the disk-shaped light-shielding members and the heat-shrinkable light-shielding film strips. The roll had a width of 610 mm and the rolled light sensitive material had a length of 59 m.

<<Evaluation>>

The same evaluation as in Example 1 was performed for each of the photothermographic material. The results are shown in Table 2. As seen from the results shown in Table 2, the photothermographic materials of the present invention utilizing compounds of Types (i) to (iv) exhibited low Dmin, high Dmax (maximum dendity), high sensitivity and high contrast (γ). Further, it can also be seen that the photothermographic materials of the present invention exhibited high Dmax and γ even with a line speed of 30 mm/second for transportation in the heat development section, and such a speed may be practically used.

TABLE 2

| Sample No. | Emulsion | Compound of Type (i), (ii), (iii) or (iv) | Photographic Performance: Line speed 25 mm/second Dmin | Sensitivity | γ | Dmax | Line speed 30 mm/second Dmin | Sensitivity | γ | Dmax | Note |
|---|---|---|---|---|---|---|---|---|---|---|---|
| 1 | a | — | 0.12 | 100 | 15 | 4.2 | 0.11 | 55 | 12 | 3.5 | Comparative Invention |
| 2 | b | 3 | 0.12 | 215 | 15 | 4.5 | 0.11 | 120 | 15 | 4.2 | |
| 3 | c | 8 | 0.12 | 200 | 15 | 4.5 | 0.11 | 110 | 15 | 4.2 | |
| 4 | d | 9 | 0.12 | 190 | 16 | 4.4 | 0.11 | 105 | 15 | 4.1 | |
| 5 | e | 10 | 0.12 | 180 | 15 | 4.3 | 0.11 | 100 | 15 | 4.0 | |
| 6 | f | 11 | 0.12 | 175 | 17 | 4.4 | 0.11 | 100 | 16 | 4.1 | |
| 7 | g | 12 | 0.12 | 185 | 15 | 4.3 | 0.11 | 105 | 15 | 4.0 | |
| 8 | h | 13 | 0.12 | 180 | 16 | 4.3 | 0.11 | 100 | 16 | 4.0 | |
| 9 | i | 24 | 0.12 | 195 | 16 | 4.3 | 0.11 | 110 | 16 | 4.0 | |
| 10 | j | 34 | 0.12 | 180 | 16 | 4.3 | 0.11 | 100 | 16 | 4.1 | |
| 11 | k | 41 | 0.12 | 190 | 17 | 4.4 | 0.11 | 105 | 15 | 4.0 | |
| 12 | l | 46 | 0.12 | 195 | 16 | 4.5 | 0.11 | 110 | 15 | 4.1 | |
| 13 | m | 56 | 0.12 | 200 | 16 | 4.3 | 0.11 | 105 | 16 | 4.0 | |

Sensitizing dye A′

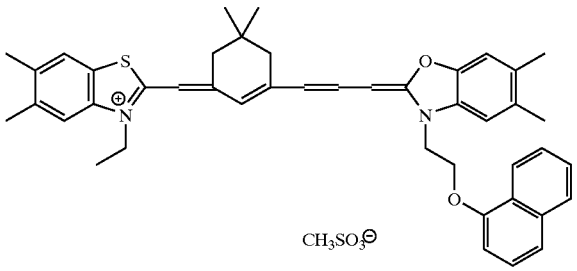

Compound A

-continued

Compound B

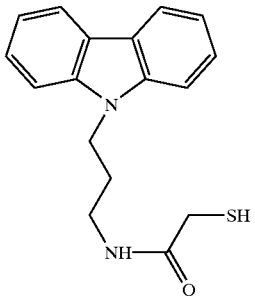

-continued

Dye Bc-A

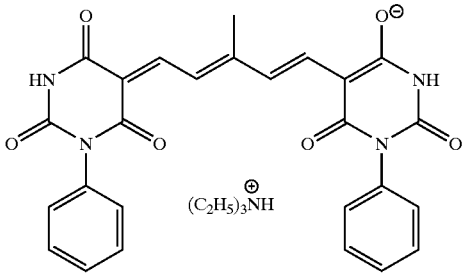

Compound Bc-A

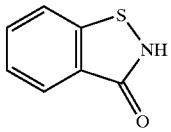

Compound Bc-B

-continued
Compound Bc-C
$C_8F_{17}SO_3Li$
Compound Bc-D
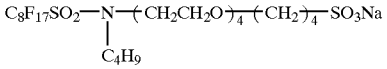
Organic polyhalogenated compound A
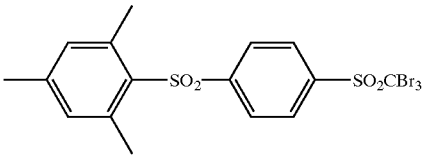
Organic polyhalogenated compound B
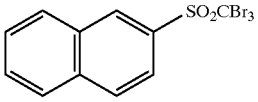
Organic polyhalogenated compound C
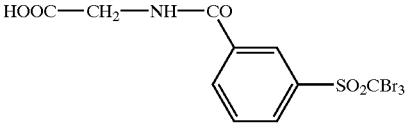
Organic polyhalogenated compound D
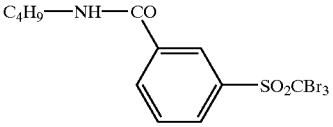
Compound Z
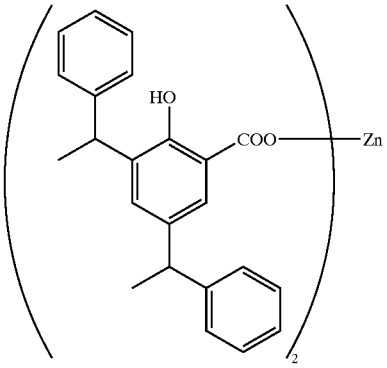
Dye A
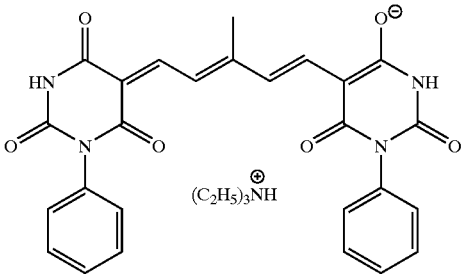
Development accelerator W1
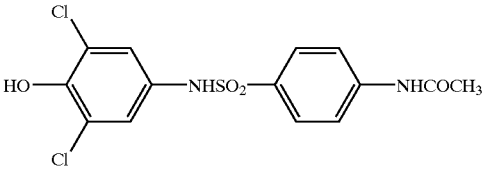
-continued
Development accelerator W2
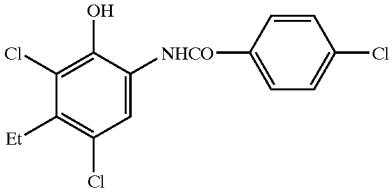
X-1
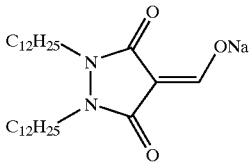
X-2
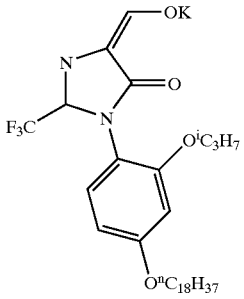
Compound C
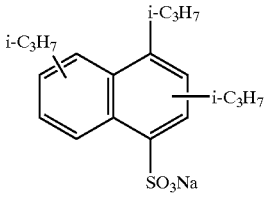
Compound D
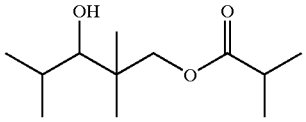
Compound E
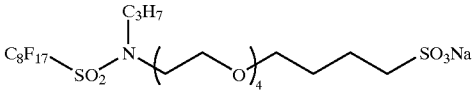
Compound F
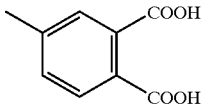
Compound G
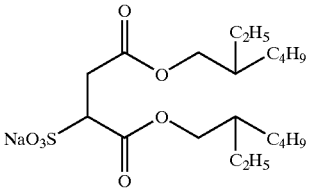

-continued

Compound H

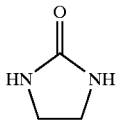

EXAMPLE 3

Photothermographic materials were prepared in the same manner as in Example 2 except that coating solutions and coating method were changed as described below.

<<Preparation of Coating Solutions>>

(Preparation of Coating Solution for Image-Forming Layer)

Silver behenate dispersion A prepared in Example 2 was added with the following binder, materials and each of Silver halide emulsions a to i in the indicated amounts per mole of silver in Silver behenate dispersion A, and added with water to prepare a coating solution for image-forming layer. After the preparation, the solution was degassed under reduced pressure of 0.54 atm for 45 minutes. The coating solution showed pH of 7.3–7.7 and viscosity of 40–50 mPa·s at 25° C.

Binder: SBR Latex

| | |
|---|---|
| (St/Bu/AA = 68/29/3 (weight %), $Na_2S_2O_8$ was used as polymerization Initiator | 397 g as solid |
| 1,1-Bis(2-hydroxy-3,5-dimethyl-phenyl)-3,5,5-trimethylhexane | 149.5 g as solid |
| Organic polyhalogenated compound B | 11.9 g as solid |
| Organic polyhalogenated compound D | 40.5 g as solid |
| Development accelerator W2 | 5.5 g as solid |
| Sodium ethylthiosulfonate | 0.3 g |
| Benzotriazole | 1.2 g |
| Polyvinyl alcohol (PVA-235, produced by Kuraray Co., Ltd.) | 10.8 g |
| 6-Isopropylphthalazine | 12.8 g |
| Compound Z | 9.6 g as solid |
| Compound C | 0.2 g |
| Dye A (added as a mixture with low molecular weight gelatin having mean molecular weight of 15,000) | Amount giving optical density of 0.3 at 783 nm (about 0.40 g as solid) |
| High contrast agent X-2 | 9.7 g |
| Silver halide emulsions a to i | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

NaOH was used as a pH adjusting agent.

(The coated film showed a glass transition temperature of 17° C.)

(Preparation of Coating Solution for Lower Protective Layer)

In an amount of 900 g of a polymer latex solution containing copolymer of butyl acrylate/methyl methacrylate=42/58 (weight ratio, mean particle diameter: 110 nm, weight average molecular weight: 800,000, glass transition temperature of copolymer: 30° C., solid content: 28.0 weight %, containing 100 ppm of Compound A) was added with water, 0.2 g of Compound E and 35.0 g of polyvinyl alcohol (PVA-235, Kuraray Co., Ltd.) and further added with water to form a coating solution (containing 0.5 weight % of methanol solvent). After completion, the solution was degassed under reduced pressure of 0.47 atm for 60 minutes. The coating solution showed pH of 5.2 and viscosity of 35 mPa·s at 25° C.

(Preparation of Coating Solution for Upper Protective Layer)

In an amount of 900 g of a polymer latex solution containing copolymer of butyl acrylate/methyl methacrylate=40/60 (weight ratio, mean particle diameter: 110 nm, weight average molecular weight: 800,000, glass transition temperature of copolymer: 35° C., solid content: 28.0 weight %, containing 100 ppm of Compound A) was added with 10.0 g of 30 weight % solution of carnauba wax (Cellosol 524, silicone content: less than 5 ppm, Chukyo Yushi Co., Ltd.), 0.3 g of Compound C, 1.2 g of Compound E, 25.0 g of Compound F, 6.0 g of Compound H, 5.0 g of matting agent (polystyrene particles, mean particle diameter: 7 μm, variation coefficient of 8% for mean particle diameter) and 40.0 g of polyvinyl alcohol (PVA-235, Kuraray Co., Ltd.), and further added with water to form a coating solution (containing 1.5 weight % of methanol solvent). After the preparation, the solution was degassed under reduced pressure of 0.47 atm for 60 minutes. The coating solution showed pH of 2.4 and viscosity of 35 mPa·s at 25° C.

<<Preparation of Photothermographic Material>>

On undercoat layers of a PET support coated with the undercoat layers as described in Example 2, the aforementioned coating solution for image-forming layer, coating solution for lower protective layer and coating solution for upper protective layer were simultaneously coated as stacked three layers in this order from the support by the slide bead method disclosed in JP-A-2000-2964, FIG. 1, so that the coated silver amount in the image-forming layer should become 1.5 g/m$^2$, the coated solid content of the polymer latex in the lower protective layer should become 1.0 g/m$^2$, and the coated solid content of the polymer latex in the upper protective layer should become 1.3 g/m$^2$.

As for drying conditions after the coating, the layers were dried in a first drying zone (low wind velocity drying region) at a dry-bulb temperature of 70–75° C., dew point of 9–23° C., wind velocity of 8–10 m/second at the support surface and liquid film surface temperature of 35–40° C., and in a second drying zone (high wind velocity drying region) at a dry-bulb temperature of 65–70° C., dew point of 20–23° C. and wind velocity of 20–25 m/second at the support surface. The drying was performed with the residence time in the first drying zone corresponding to ⅔ of the period of the constant ratio drying in this zone, and thereafter the material was transferred to the second drying zone and dried. The first drying zone was a horizontal drying zone (the support was at an angle of 1.5–3° to the horizontal direction of the coating machine). The coating speed was 60 m/minute. After the drying, the material was rolled up under the conditions of a temperature of 25±5° C. and relative humidity of 45±10%. The material was rolled up in such a rolled shape that the image-forming layer side should be exposed to the outside so as to conform to the subsequent processing (image-forming layer outside roll). The humidity in the package of the photothermographic material was 20–40% of relative humidity (measured at 25° C.). The obtained photothermographic material showed a film surface pH of 5.0 and Beck's smoothness of 5000 seconds for the image-forming layer side. The opposite surface showed a film surface pH of 5.9 and Beck's smoothness of 500 seconds.

<<Evaluation>>

When the photothermographic materials were subjected to heat development and evaluated in the same manner as in Example 2, the photothermographic materials having the characteristics of the present invention substantially reproduced the results of Example 2. Thus, favorable effects of the present invention were confirmed.

EXAMPLE 4

Photothermographic materials were prepared in the same manner as in Examples 2 and 3 except that the support described below was used instead of the support used in Examples 2 and 3.

<<Preparation of PET Support>>

PET having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the thickness should become 120 μm after thermal fixation.

The film was stretched along the longitudinal direction by 3.3 times using rollers of different peripheral speeds, and then stretched along the transverse direction by 4.5 times using a tenter. These operations were performed at temperatures of 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 1.4 m, length of 3500 m, and thickness of 120 μm was obtained.

<<Preparation of Undercoat Layers and Back Layers>>

Coating solutions S-A to S-C were prepared, and Coating solutions S-C and S-A were coated on the image-forming layer coating side of the support in that order from the support in amounts of 13.8 ml/m$^2$ and 6.2 ml/m$^2$, respectively. Further, Coating solutions S-A and S-B were coated on the back layer coating side in that order from the support in amounts of 6.2 ml/m$^2$ and 13.8 ml/m$^2$, respectively. The coated layers were dried at 125° C. for 30 seconds, 150° C. for 30 seconds and 185° C. for 30 seconds. Both surfaces of the PET support were subjected to a corona discharge treatment of 0.375 kV·A·minute/m$^2$.

| (i) Coating solution S-A | |
|---|---|
| Latex A | 280 g |
| KOH | 0.5 g |
| Polystyrene microparticles (mean particle diameter: 2 μm, variation coefficient of 7% for mean particle diameter) | 0.03 g |
| 2,4-Dichloro-6-hydroxy-s-triazine | 1.8 g |
| Compound Bc-C | 0.06 g |
| Distilled water | Amount giving total weight of 1000 g |

| (ii) Coating solution S-C | |
|---|---|
| Pesresin A520 (30 weight % aqueous dispersion Takamatsu Yushi Co., Ltd.) | 46 g |
| Alkali-treated gelatin (molecular weight: about 10000, $Ca^{2+}$ content: 30 ppm) | 4.44 g |

-continued

| | |
|---|---|
| Deionized gelatin ($Ca^{2+}$ content: 0.6 ppm) | 0.84 g |
| Compound Bc-A | 0.02 g |
| Dye Bc-A | Amount giving optical density of 1.3 at 783 nm, |
| Polyoxyethylene phenyl ether | 1.7 g |
| Water-soluble melamine compound (Sumitex Resin M-3, Sumitomo Chemical Co., Ltd., 8 weight % aqueous solution) | 15 g |
| Aqueous dispersion of Sb-doped $SbO_2$ acicular grains (FS-10D, Ishihara Sangyo Kaisha, Ltd.) | 81.5 g |
| Polystyrene microparticles (mean diameter: 2.0 μm, variation coefficient of 7% for mean particle diameter) | 0.03 g |
| Distilled water | Amount giving total weight of 1000 g |

| (iii) Coating solution S-B | |
|---|---|
| Chemipearl S120 (27 weight % aqueous dispersion Mitsui Chemical Co., Ltd.) | 73.1 g |
| Pesresin A615G (25 weight % aqueous dispersion Takamatsu Yushi Co., Ltd.) | 78.9 g |
| Compound Bc-B | 2.7 g |
| Compound Bc-C | 0.3 g |
| Compound Bc-D | 0.25 g |
| Water-soluble epoxy compound (Denacol EX-521, Nagase Kasei Co., Ltd.) | 3.4 mg/m$^2$ |
| Polymethyl methacrylate (10 weight % aqueous dispersion, mean particle diameter: 5.0 μm, variation coefficient of 7% for mean particle diameter) | 7.7 g |
| Distilled water | Amount giving total weight of 1000 g |

(Heat Treatment During Transportation)

The PET support with back layers and undercoat layers prepared as described above was introduced into a heat treatment zone having a total length of 200 m set at 160° C., and transported at a tension of 2 kg/cm$^2$ and a transportation speed of 20 m/minute.

Following the aforementioned heat treatment, the support was subjected to a post-heat treatment by passing it through a zone at 40° C. for 15 seconds, and rolled up. The rolling up tension for this operation was 10 kg/cm$^2$.

<<Evaluation>>

When the photothermographic-materials were subjected to heat development and evaluated in the same manner as in Example 1, the photothermographic materials having the characteristics of the present invention substantially reproduced the results of Examples 1, 2 and 3. Thus, favorable effects of the present invention were confirmed.

EXAMPLE 5

Photothermographic materials were prepared in the same manner as in Example 2 by using compounds of Types (i) to (iv) except that coating solutions for image-forming layer and protective layer were changed as described below.

<<Preparation of Coating Solutions>>

(Preparation of Coating Solution for Image-Forming Layer)

Silver behenate dispersion A prepared in Example 2 was added with the following binder, materials and each of Silver halide emulsions a to i in the indicated amounts per mole of silver in Silver behenate dispersion A, and added with water to prepare a coating solution for image-forming layer. After completion, the solution was degassed under reduced pressure of 0.54 atm for 45 minutes. The coating solution showed pH of 7.3–7.7 and viscosity of 52–59 mPa·s at 25° C.

| | |
|---|---|
| Binder: SBR latex (St/Bu/AA = 68/29/3 (weight %), glass transition temperature: 17° C. (calculated value), $Na_2S_2O_8$ was used as polymerization initiator, pH was adjusted to 6.5 with NaOH, mean particle diameter: 122 nm) | 395.6 g as solid |
| 1,1-Bis(2-hydroxy-3,5-dimethylphenyl)-3,5,5-trimethylhexane | 149.5 g as solid |
| Organic polyhalogenated compound B | 36.7 g as solid |
| Organic polyhalogenated compound C | 2.39 g as solid |
| Development accelerator W2 | 5.73 g as solid |
| Sodium ethylthiosulfonate | 0.5 g |
| Benzotriazole | 1.0 g |
| Polyvinyl alcohol (PVA-235, produced by Kuraray Co., Ltd.) | 11.0 g |
| 6-Isopropylphthalazine | 14.0 g |
| Compound Z | 9.8 g as solid |
| High contrast agent X-1 | 7.5 g |
| High contrast agent X-2 | 5.8 g |
| Dye A (added as a mixture with low molecular weight gelatin having mean molecular weight of 15,000) | Amount giving optical density of 0.3 at 783 nm (about 0.40 g as solid) |
| Silver halide emulsions a to i | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

(Preparation of Coating Solution for Protective Layer)

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 116 nm) was added with water, 1.66 g of Compound E, 109.6 g of the aqueous solution of Organic polyhalogenated compound C, 17.0 g as solid content of Organic polyhalogenated compound A, 0.73 g as solid content of sodium dihydrogenorthophosphate dihydrate, 1.59 g of matting agent (polystyrene particles, mean particle diameter: 7 μm, variation coefficient of 8% for mean particle diameter) and 29.7 g of polyvinyl alcohol (PVA-235, Kuraray Co., Ltd.) to form a coating solution (containing 0.8 weight % of methanol solvent). After completion, the solution was degassed under reduced pressure of 0.47 atm for 60 minutes. The obtained coating solution showed pH of 5.6 and viscosity of 40 mPa·s at 25° C.

<<Evaluation>>

When photothermographic materials were prepared in the same manner as in Example 2 by using compounds of Types (i) to (iv) except that coating solutions for image-forming layer and protective layer were changed as described above and evaluated, the photothermographic materials having the characteristics of the present invention exhibited favorable performance as in Example 2.

EXAMPLE 6

Photothermographic materials were prepared in the same manner as in Example 1 by using compounds satisfying the requirements of the present invention except that coating solutions for image-forming layer and protective layer were changed as described below.

<<Preparation of Coating Solutions>>

(Preparation of Coating Solution for Image-Forming Layer)

Silver behenate dispersion A prepared in Example 2 was added with the following binder, materials and each of Silver halide emulsions a to i in the indicated amounts per mole of silver in Silver behenate dispersion A, and added with water to prepare a coating solution for image-forming layer. After completion, the solution was degassed under reduced pressure of 0.54 atm for 45 minutes. The coating solution showed pH of 7.3–7.7 and viscosity of 52–59 mPa·s at 25° C.

| | |
|---|---|
| Binder: SBR latex (St/Bu/AA = 68/29/3 (weight %), glass transition temperature: 17° C. (calculated value), $Na_2S_2O_8$ was used as polymerization initiator, pH was adjusted to 6.5 with NaOH, mean particle diameter: 122 nm) | 395.6 g as solid |
| 1,1-Bis(2-hydroxy-3,5-dimethylphenyl)-3,5,5-trimethylhexane | 149.5 g as solid |
| Organic polyhalogenated compound B | 12.0 g as solid |
| Organic polyhalogenated compound D | 41.1 g as solid |
| Development accelerator W2 | 5.73 g as solid |
| Sodium ethylthiosulfonate | 0.5 g |
| Benzotriazole | 1.0 g |
| Polyvinyl alcohol (PVA-235, produced by Kuraray Co., Ltd.) | 11.0 g |
| 6-Isopropylphthalazine | 12.8 g |
| Compound Z | 9.8 g as solid |
| High contrast agent X-1 | 7.5 g |
| High contrast agent X-2 | 5.8 g |
| Dye A (added as a mixture with low molecular weight gelatin having mean molecular weight of 15,000) | Amount giving optical density of 0.3 at 783 nm (about 0.40 g as solid) |
| Silver halide emulsions a to i | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

(Preparation of Coating Solution for Protective Layer)

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of copolymer: 46° C. (calculated value), solid content: 21.5 weight %, the solution contained 100 ppm of Compound A and further contained Compound D as a film-forming aid in an amount of 15 weight % relative to solid content of the latex so that the glass transition temperature of the coating solution should become 24° C., mean particle diameter: 116 nm) was added with water, 1.66 g of Compound E, 1.82 g as solid content of sodium dihydrogenorthophosphate dihydrate, 1.59 g of matting agent (polystyrene particles, mean particle diameter: 7 μm, variation coefficient of 8% for mean particle diameter) and 29.7 g of polyvinyl alcohol (PVA-235, Kuraray Co., Ltd.) to form a coating solution (containing 0.8 weight % of methanol solvent). After complesion, the solution was degassed under reduced pressure of 0.47 atm for 60 minutes. The obtained coating solution showed pH of 5.6 and viscosity of 40 mPa·s at 25° C.

<<Evaluation>>

When photothermographic materials were prepared in the same manner as in Example 1 by using compounds satisfying the requirements of the present invention except that coating solutions for image-forming layer and protective layer were changed as described above and evaluated, the photothermographic materials having the characteristics of the present invention exhibited favorable performance as in Example 1.

EXAMPLE 7

The photothermographic materials used in Examples 1 to 6 were exposed by using a cylinder external surface scanning type multichannel exposure apparatus (provided with 30 of 50 mW semiconductor laser heads, laser energy density on the photothermographic material surface: 75 $\mu J/cm^2$), and subjected to heat development in the same manner as in Example 1. As a result, the photothermographic materials of the present invention substantially reproduced the results of Examples 1 to 6, and thus the advantages of the present invention were clearly demonstrated.

EXAMPLE 8

The photothermographic materials used in Examples 1 to 6 were subjected to a heat development by using DRY FILM PROCESSOR FDS-6100X produced by Fuji Photo Film Co., Ltd., and similar evaluation was performed. As a result, results similar to those of Examples 1 to 7 were obtained, and thus the advantages of the present invention were clearly demonstrated.

EXAMPLE 9

<<Preparation of PET Support>>

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, then melted at 300° C., added with 0.04 weight % of Dye BB having the structure mentioned below and then extruded from a T-die and rapidly cooled to form an unstretched film having such a thickness that the film should have a thickness of 175 $\mu$m after thermal fixation.

This film was stretched along the longitudinal direction by 3.3 times using rollers of different peripheral speeds, and then stretched along the transverse direction by 4.5 times using a tenter. The temperatures for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 $kg/cm^2$. Thus, a roll of a film having a thickness of 175 $\mu$m was obtained.

By using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/$m^2$. The discharging frequency of the treatment was 9.6 kHz, and the gap clearance between the electrode and the dielectric roll was 1.6 mm.

<<Formation of Undercoat Layers>>

On one surface (photosensitive layer side) of the biaxially stretched polyethylene terephthalate subjected to the above corona discharging treatment, Undercoat coating solution (i) was coated by a wire bar in a wet coating amount of 6.6 mL/$m^2$ (for one surface) and dried at 180° C. for 5 minutes. Then, the opposite surface (back surface) thereof was coated with Undercoat coating solution (ii) by a wire bar in a wet coating amount of 5.7 mL/$m^2$ and dried at 180° C. for 5 minutes. The back surface thus coated was further coated with Undercoat coating solution (iii) by a wire bar in a wet coating amount of 7.7 mL/$m^2$ and dried at 180° C. for 6 minutes to prepare a support having undercoat layers.

| | |
|---|---|
| Undercoat coating solution (i) | |
| Pesresin A-520 (Takamatsu Yushi K.K., 30 weight % solution) | 59 g |
| Polyethylene glycol monononyl phenyl ether (mean ethylene oxide number = 8.5, 10 weight % solution) | 5.4 g |
| MP-1000 (Soken Kagaku K.K. polymer microparticles, mean particle size: 0.4 $\mu$m) | 0.91 g |
| Distilled water | 935 mL |
| Undercoat coating solution (ii) | |
| Styrene/butadiene copolymer latex (solid content: 40 weight %, weight ratio of styrene/butadiene = 68/32) | 158 g |
| 2,4-Dichloro-6-hydroxy-S-triazine sodium salt (8 weight % aqueous solution) | 20 g |
| 1 weight % Aqueous solution of sodium laurylbenzenesulfonate | 10 mL |
| Distilled water | 854 mL |
| Undercoat coating solution (iii) | |
| $SnO_2$/SbO (weight ratio: 9/1, mean particle diameter: 0.038 $\mu$m, 17 weight % dispersion) | 84 g |
| Gelatin (10% aqueous solution) | 89.2 g |
| Metorose TC-5 (Shin-Etsu Chemical Co., Ltd., 2% aqueous solution) | 8.6 g |
| MP-1000 (Soken Kagaku K.K.) | 0.01 g |
| 1 weight % Aqueous solution of sodium dodecylbenzenesulfonate | 10 mL |
| NaOH (1 weight %) | 6 mL |
| Proxel (ICI Co.) | 1 mL |
| Distilled water | 805 mL |

<<Formation of Back Layer>>

(Preparation of Base Precursor Solid Microparticle Dispersion (a))

In an amount of 1.5 kg of Base precursor compound 1, 225 g of Demor N (trade name, Kao Corporation), 937.5 g of diphenylsulfone and 15 g of p-hydroxybenzoic acid methyl ester (trade name: Mekkins M, Ueno Fine Chemicals Industry) were added with distilled water to a total weight of 5.0 kg and mixed, and the mixture was dispersed in a sand mill of horizontal type (UVM-2, Imex Co.). As for the dispersion conditions, the mixture was fed by a diaphragm pump to UVM-2 containing zirconia beads having a mean diameter of 0.5 mm, and dispersion was continued at an internal pressure of 50 hPa or higher until the desired dispersion degree was attained. A ratio of absorbance at 450 nm and absorbance at 650 nm (D450/D650) of the dispersion obtained by spectrophotometric measurement of absorbance was used as an index of the dispersion degree, and the dispersion operation was continued until the ratio reached 2.2 or more. After the dispersion operation, the dispersion was diluted with distilled water so as to obtain a base precursor concentration of 20 weight %, and filtered through a filter (mean pore size: 3 $\mu$m, made of polypropylene) to remove dusts.

(Preparation of Dye Solid Microparticle Dispersion (a))

In an amount of 6.0 kg of Cyanine dye compound 1, 3.0 kg of sodium p-dodecylsulfonate, 0.6 kg of Demor SMB (trade name, Kao Corporation) and 0.15 kg of Safinol 104E (trade name, Nisshin Kagaku Co.) were mixed with distilled water to obtain a total amount of 60 kg. The mixture was dispersed in a sand mill of horizontal type (UVM-2, Imex) using zirconia beads having a mean diameter of 0.5 mm. The dispersion operation was continued until a ratio of absorbance at 650 nm and absorbance at 750 nm (D650/D750) reached 5.0 or more. After the dispersion operation, the dispersion was diluted with distilled water so as to obtain a cyanine dye concentration of 6 weight %, and filtered through a filter (mean pore size: 1 μm, made of polypropylene) to remove dusts.

(Preparation of Coating Solution for Antihalation Layer)

In an amount of 30 g of gelatin, 24.5 g of polyacrylamide, 2.2 g of 1 mol/L sodium hydroxide, 2.4 g of monodispersed polymethyl methacrylate microparticles (average particle diameter: 8 μm, standard deviation of particle size: 0.4 μm), 0.08 g of benzoisothiazolinone, 35.9 g of Dye solid microparticle dispersion (a) mentioned above, 74.2 g of Base precursor solid microparticle dispersion (a) mentioned above, 0.6 g of sodium polyethylenesulfonate, 0.21 g of Blue color dye compound 1, 0.15 g of Yellow color dye compound 1, 8.3 g of acrylic acid/ethyl acrylate copolymer latex (copolymerization ratio: 5/95) and water were mixed to a total volume of 818 ml to prepare a coating solution for antihalation layer.

(Preparation of Coating Solution for Back Surface Protective Layer)

In a vessel kept at 40° C., 40 g of gelatin, 6.8 g of 1 mol/L sodium hydroxide, 0.27 g of sodium polystyrenesulfonate, 2.0 g of N,N-ethylenebis(vinylsulfonacetamide), 0.5 g of sodium t-octylphenoxyethoxyethanesulfonate, 35 mg of benzisothisazolinone, 37 mg of Fluorine-containing surfactant F-1, 150 mg of Fluorine-containing surfactant F-2, 64 mg of Fluorine-containing surfactant F-3, 32 mg of Fluorine-containing surfactant F-4, 6.0 g of acrylic acid/ethyl acrylate copolymer latex (copolymerization ratio: 5/95), 0.6 g of Aerosol OT (American Cyanamid), 1.5 g as liquid paraffin of liquid paraffin emulsion and 10 L of water were mixed to form a coating solution for back surface protective layer.

(Coating of Back Surface)

On the back surface side of the undercoated support, the coating solution for antihalation layer and the coating solution for back surface protective layer were simultaneously applied as stacked layers so that the coated gelatin amount in the antihalation layer should become 0.44 g/m$^2$, and the coated gelatin amount in the back surface protective layer should become 1.7 g/m$^2$, and dried to form a back layer.

<<Formation of Image-Forming Layer and Surface Protective Layer>>

(Preparation of Silver Halide Emulsion 1)

In an amount of 1421 mL of distilled water was added with 3.1 mL of 1 weight % potassium bromide solution, and further added with 3.5 mL of 0.5 mol/L sulfuric acid and 31.7 g of phthalized gelatin. Separately, Solution A was prepared by adding distilled water to 22.22 g of silver nitrate to dilute it to 95.4 mL, and Solution B was prepared by diluting 15.3 g of potassium bromide and 0.8 g of potassium iodide with distilled water to a volume of 97.4 mL. To the aforementioned mixture maintained at 30° C. and stirred in a stainless steel reaction vessel, the whole volume of Solution A and Solution B was added over 45 seconds at constant flow rates. Then, the mixture was added with 10 mL of 3.5 weight % aqueous hydrogen peroxide solution, and further added with 10.8 mL of 10 weight % aqueous solution of benzimidazole.

Further, Solution C was prepared by adding distilled water to 51.86 g of silver nitrate to dilute it to 317.5 mL, and Solution D was prepared by diluting 44.2 g of potassium bromide and 2.2 g of potassium iodide with distilled water to a volume of 400 mL. The whole volume of Solution C was added to the mixture over 20 minutes at a constant flow rate. Solution D was added by the control double jet method while pAg was maintained at 8.1. Hexachloroiridic acid (III) potassium salt in an amount of $1\times10^{-4}$ mole per mole of silver was added at one time 10 minutes after the addition of Solutions C and D was started. Further, an aqueous solution of potassium iron(II) hexacyanide in an amount of $3\times10^{-4}$ mole per mole of silver was added at one time 5 seconds after the addition of Solution C was completed. Then, the mixture was adjusted to pH 3.8 by using 0.5 mol/L sulfuric acid, and the stirring was terminated. Then, the mixture was subjected to precipitation, desalting and washing with water, and adjusted to pH 5.9 with 1 mol/L sodium hydroxide to form a silver halide dispersion having pAg of 8.0.

The aforementioned silver halide dispersion was added with 5 mL of a 0.34 weight % methanol solution of 1,2-benzisothiazolin-3-one with stirring at 38° C., and after 40 minutes since then, added with a methanol solution of Spectral sensitization dye A and Spectral sensitization dye B in a molar ratio of 1:1 in an amount of $1.2\times10^{-3}$ mole as the total amount of Spectral sensitization dye A and Spectral sensitization dye B per mole of silver. After 1 minutes, the mixture was warmed to 47° C., and 20 minutes after the warming, added with $7.6\times10^{-5}$ mole of sodium benzenethiosulfonate per mole of silver as a methanol solution. After further 5 minutes, the mixture was added with Tellurium sensitizer C as a methanol solution in an amount of $2.9\times10^{-4}$ mole per mole of silver, followed by ripening for 91 minutes.

The mixture was added with 1.3 mL of 0.8 weight % methanol solution of N,N'-dihydroxy-N'-diethylmelamine, and 4 minutes later, added with $4.8\times10^{-3}$ mole per mole of silver of 5-methyl-2-mercaptobenzimidazole as a methanol solution and $5.4\times10^{-3}$ mole per mole of silver of 1-phenyl-2-heptyl-5-mercapto-1,3,4-triazole as a methanol solution to prepare Silver halide emulsion 1.

The grains in the prepared silver halide emulsion were silver iodobromide grains having a mean diameter of 0.042 μm as spheres and a variation coefficient of 20% for diameter as spheres and uniformly containing 3.5 mole % of iodine. The grain size and others were obtained from averages for 1000 grains by using an electron microscope. The [100] face ratio of these grains was determined to be 80% by the Kubelka-Munk method.

(Preparation of Silver Halide Emulsion 2)

Silver halide emulsion 2 was prepared in the same manner as the preparation of Silver halide emulsion 1 except that the liquid temperature upon grain formation was changed from 30° C. to 47° C., Solution B was prepared by diluting 15.9 g of potassium bromide with distilled water to a volume of 97.4 mL, Solution D was prepared by diluting 45.8 g of potassium bromide with distilled water to a volume of 400 mL, addition time of Solution C was changed to 30 minutes and potassium iron(II) hexacyanide was not used. Furthermore, in the same manner as in the case of Silver halide emulsion 1 except that the addition amount of a methanol solution of Spectral sensitization dye A and Spectral sensitization dye B in a molar ratio of 1:1 was changed to $7.5\times10^{-4}$ mole as the total amount of Spectral sensitization dye A and Spectral sensitization dye B per mole of silver, the addition amount of Tellurium sensitiser C was changed to $1.1\times10^{-4}$ mole per mole of silver, and the addition amount of 1-phenyl-2-heptyl-5-mercapto-1,3,4-triazole was changed to $3.3\times10^{-3}$ mole of per mole of silver, spectral sensitization, chemical sensitization, and addition of 5-methyl-2-mercaptobenzimidazole and 1-phenyl-2-heptyl-5-mercapto-1,3,4-triazole were performed to obtain Silver halide emulsion 2.

The obtained silver halide emulsion grains were pure silver bromide cubic grains having a mean grain diameter of 0.080 μm as spheres and a variation coefficient of 20% for diameter as spheres.

(Preparation of Silver Halide Emulsion 3)

Silver halide emulsion 3 was prepared in the same manner as the preparation of Silver halide emulsion 1 except that the liquid temperature upon grain formation was changed from 30° C. to 27° C. Further, as in the case of Silver halide emulsion 1, the steps of precipitation, desalting and washing with water were performed. Then, Silver halide emulsion 3 was obtained in the same manner as in the case of Silver halide emulsion 1 except that Spectral sensitization dye A and Spectral sensitization dye B were added in a molar ratio of 1:1 as a solid dispersion (dispersed in a gelatin aqueous solution) in an amount of $6\times10^{-3}$ mole per mole of silver as the total amount of Spectral sensitization dye A and Spectral sensitization dye B, the addition amount of Tellurium sensitizer C was changed to 5.2×10−4 mole per mole of silver, and $5\times10^{-4}$ mole per mole of silver of bromoauric acid and $2\times10^{-3}$ mole per mole of silver of potassium thiocyanate were added 3 minutes after the addition of Tellurium sensitizer.

The obtained silver halide emulsion grains were silver iodobromide grains having a mean grain diameter of 0.034 μm as spheres and a variation coefficient of 20% for diameter as spheres and uniformly containing 3.5 mole % of iodine.

(Preparation of Mixed Emulsion A for Coating Solution)

In an amount of 70% by weight of Silver halide emulsion 1, 15% by weight of Silver halide emulsion 2 and 15% by weight of Silver halide emulsion 3 were mixed and added with benzothiazolium iodide in an amount of $7\times10^{-3}$ mole per mole of silver as a 1 weight % aqueous solution. Then, the mixture was further added with each of the compounds of the formulas (1-1) to (4-2) mentioned in Tables 3 and 4 in an amount of $7\times10^{-3}$ mole per mole of silver and further added with water so that the silver halide content per 1 kg of the mixed emulsion for coating solution should become 38.2 g to form Mixed emulsion A for coating solution.

(Preparation of Aliphatic Acid Silver Salt Dispersion A)

In an amount of 87.6 kg of behenic acid (Edenor C22-85R, trade name, Henkel Co.), 423 L of distilled water, 49.2 L of 5 mol/L aqueous solution of NaOH and 120 L of tert-butyl alcohol were mixed and allowed to react at 75° C. for one hour with stirring to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butyl alcohol contained in a reaction vessel kept at 30° C. was added with the whole volume of the aforementioned sodium behenate solution and the whole volume of the aqueous silver nitrate solution with sufficient stirring at constant flow rates over the periods of 93 minutes and 15 seconds and 90 minutes, respectively.

In this operation, they were added in such a manner that only the aqueous silver nitrate solution should be added for 11 minutes after starting the addition of the aqueous silver nitrate solution. Then, the addition of the sodium behenate solution was started so that only the sodium behenate solution should be added for 14 minutes and 15 seconds after finishing the addition of the aqueous silver nitrate solution. In this operation, the outside temperature was controlled so that the temperature in the reaction vessel should become 30° C. and the liquid temperature should be constant.

The piping of the addition system for the sodium behenate solution was warmed by circulating warmed water outside a double pipe, and temperature was controlled such that the liquid temperature at the outlet orifice of the addition nozzle should become 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature, and then the temperature was increased to 35° C. over 30 minutes, followed by ripening for 210 minutes. After completion of the ripening, the solid content was immediately separated by centrifugal filtration and washed with water until electric conductivity of the filtrate became 30 μS/cm. Thus, a silver salt of an organic acid was obtained. The obtained solid content was stored as a wet cake without being dried.

When the shape of the obtained silver behenate grains was evaluated by electron microscopic photography, the grains showed a=0.14 μm, b=0.4 μm, and c=0.6 μm in mean values, and mean aspect ratio of 5.2 (a, b and c have the meanings defined above). Measurement by a laser beam scattering type grain size measurement apparatus revealed that the grains were scaly crystals having a mean diameter of 0.52 μm as spheres and variation coefficient of 15% for diameter as spheres.

To the wet cake corresponding to 260 kg of the dry solid content was added with 19.3 kg of polyvinyl alcohol (PVA-217, trade name) and water to make the total amount 1000 kg, and the mixture was made into slurry by dissolver fins and further pre-dispersed by a pipeline mixer (PM-10, Mizuho Kogyo).

Then, the pre-dispersed stock dispersion was treated three times by using a dispersing machine (Microfluidizer M-610, Microfluidex International Corporation, using Z interaction chamber) with a pressure controlled to be 1260 kg/cm$^2$ to obtain Silver behenate dispersion A. As for the cooling operation, a dispersion temperature of 18° C. was achieved by providing coiled heat exchangers fixed before and after the interaction chamber and controlling the temperature of refrigerant.

(Preparation of Aliphatic Acid Silver Salt Dispersion B)

In an amount of 100 kg of behenic acid (Edenor C22-85R, trade name, Henkel Co.) was added with 1200 kg of isopropyl alcohol, dissolved at 50° C., filtered through a filter of 10 μm and cooled to 30° C. for recrystallization. The cooling rate for the recrystallization was controlled to be 3° C./hour. The obtained crystals were filtered by centrifugation, washed with 100 kg of flowing isopropyl alcohol and dried. There was obtained behenic acid of high purity having a behenic acid content of 96 weight %, lignoceric acid content of 2 weight % and arachidic acid content of 2 weight %. The composition was analyzed by the measurement based on the GC-FID method after the recrystallization product was esterified.

In an amount of 88 kg of the recrystallized behenic acid, 422 L of distilled water, 49.2 L of 5 mol/L aqueous solution of NaOH and 120 L of tert-butyl alcohol were mixed and allowed to react at 75° C. for one hour with stirring to obtain a solution of sodium behenate. Separately, 206.2 L of an aqueous solution containing 40.4 kg of silver nitrate (pH 4.0) was prepared and kept at 10° C. A mixture of 635 L of distilled water and 30 L of tert-butyl alcohol contained in a reaction vessel kept at 30° C. was added with the whole volume of the aforementioned sodium behenate solution and the whole volume of the aqueous silver nitrate solution with sufficient stirring at constant flow rates over the periods of 93 minutes and 15 seconds and 90 minutes, respectively.

In this operation, they were added in such a manner that only the aqueous silver nitrate solution should be added for 11 minutes after starting the addition of the aqueous silver nitrate solution. Then, the addition of the sodium behenate solution was started so that only the sodium behenate solution should be added for 14 minutes and 15 seconds after finishing the addition of the aqueous silver nitrate solution. In this operation, the outside temperature was controlled so that the temperature in the reaction vessel should become 30° C. and the liquid temperature should be constant.

The piping of the addition system for the sodium behenate solution was warmed by circulating warmed water outside a double pipe, and temperature was controlled such that the liquid temperature at the outlet orifice of the addition nozzle should become 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled to be at heights for not contacting with the reaction mixture.

After finishing the addition of the sodium behenate solution, the mixture was left with stirring for 20 minutes at the same temperature and then the temperature was increased to 35° C. over 30 minutes, followed by ripening for 210 minutes. After completion of the ripening, the solid content was immediately separated by centrifugal filtration and washed with water until electric conductivity of the filtrate became 30 μS/cm. Thus, a silver salt of an organic acid was obtained. The obtained solid content was stored as a wet cake without being dried.

As for the shape of the obtained silver behenate grains, they were crystals having a=0.21 μm, b=0.4 μm and c=0.4 μm in mean values, mean aspect ratio of 2.1, mean diameter of 0.51 μm as spheres, and variation coefficient of 11% for mean diameter as spheres.

To the wet cake corresponding to 260 kg of the dry solid content was added with 19.3 kg of polyvinyl alcohol (PVA-217, trade name) and water to make the total amount 1000 kg, and the mixture was made into slurry by dissolver fins and further pre-dispersed by a pipeline mixer PM-10.

Then, the pre-dispersed stock dispersion was treated three times by using Microfluidizer M-610 (using Z interaction chamber) with a pressure controlled to be 1150 kg/cm$^2$ to obtain Silver behenate dispersion B. As for the cooling operation, a dispersion temperature of 18° C. was achieved by providing coiled heat exchangers fixed before and after the interaction chamber and controlling the temperature of refrigerant.

(Preparation of Dispersion of Reducing Agent Complex 1)

In an amount of 10 kg of Reducing agent complex 1, 0.12 kg of triphenylphosphine oxide and 16 kg of 10 weight % aqueous solution of denatured polyvinyl alcohol (Poval MP203, Kuraray Co., Ltd.) were added with 10 kg of water, and mixed sufficiently to form slurry. The slurry was-fed by a diaphragm pump to a sand mill of horizontal type (UVM-2, Imex) containing zirconia beads having a mean diameter of 0.5 mm, and dispersed for 4 hours and 30 minutes. Then, the slurry was added with 0.2 g of benzothiazolinone sodium salt and water so that the concentration of the reducing agent should become 22 weight % to obtain a dispersion of Reducing agent complex 1.

The reducing agent complex particles contained in the dispersion of reducing agent complex obtained as described above had a mean diameter of 0.45 μm as a median diameter and the maximum particle size of 1.4 μm or less. The obtained dispersion was filtered through a polypropylene filter having a pore size of 3.0 μm to remove contaminants such as dusts and stored.

(Preparation of Dispersion of Reducing Agent 2)

In an amount of 10 kg of Reducing agent 2 and 16 kg of 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type, UVM-2, containing zirconia beads having a mean diameter of 0.5 mm, and dispersed for 3 hours and 30 minutes. Then, the slurry was added with 0.2 g of benzothiazolinone sodium salt and water so that the concentration of the reducing agent should become 25 weight %, and then treated by heating at 60° C. for 5 hours to obtain a dispersion of Reducing agent 2.

The reducing agent particles contained in the dispersion of reducing agent obtained as described above had a mean diameter of 0.40 μm as a median diameter and the maximum particle size of 1.5 μm or less. The obtained dispersion was filtered through a polypropylene filter having a pore size of 3.0 μm to remove contaminants such as dusts and stored.

(Preparation of Dispersion of Hydrogen Bond-Forming Compound 1)

In an amount of 10 kg of Hydrogen bond-forming compound 1 and 16 kg of 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type, UVM-2, containing zirconia beads having a mean diameter of 0.5 mm, and dispersed for 3 hours and 30 minutes. Then, the slurry was added with 0.2 g of benzothiazolinone sodium salt and water so that the concentration of the hydrogen bond-forming compound should become 25 weight %. The dispersion was heated at 80° C. for 1 hour to obtain a dispersion of Hydrogen bond-forming compound 1.

The hydrogen bond-forming compound particles contained in the dispersion obtained as described above had a mean diameter of 0.35 μm as a median diameter and the maximum particle size of 1.5 μm or less. The obtained dispersion was filtered through a polypropylene filter having a pore size of 3.0 μm to remove contaminants such as dusts and stored.

(Preparation of Dispersion of Development Accelerator 1)

In an amount of 10 kg of Development accelerator 1 and 20 kg of a 10 weight % aqueous solution of denatured polyvinyl alcohol (Poval MP203, Kuraray Co., Ltd.) were added with 10 kg of water, and mixed sufficiently to form slurry. The slurry was fed by a diaphragm pump to a sand mill of horizontal type, UVM-2, containing zirconia beads having a mean diameter of 0.5 mm, and dispersed for 3 hours and 30 minutes. Then, the slurry was added with 0.2 g of benzothiazolinone sodium salt and water so that the concentration of the development accelerator should become 20 weight % to obtain a dispersion of Development accelerator 1.

The development accelerator particles contained in the dispersion of Development accelerator 1 obtained as described above had a median diameter of 0.48 μm and the maximum particle size of 1.4 μm or less. The obtained dispersion of Development accelerator 1 was filtered through a polypropylene filter having a pore size of 3.0 μm to remove contaminants such as dusts and stored.

(Preparation of Solid Dispersions of Development Accelerators 2, 3 and Toning Agent 1)

Solid dispersions of Development accelerators 2, 3 and Toning agent 1 were also obtained as 20 weight % dispersions in the same manner as the method used for obtaining the dispersion of Development accelerator 1

(Dispersion of Organic Polyhalogenated Compound 1)

In an amount of 10 kg of Organic polyhalogenated compound 1, 10 kg of 20 weight % aqueous solution of denatured polyvinyl alcohol MP203, 0.4 kg of 20 weight % aqueous solution of sodium triisopropylnaphthalenesulfonate and 14 kg of water were mixed sufficiently to form slurry.

The slurry was fed by a diaphragm pump to a sand mill of horizontal type, UVM-2, containing zirconia beads having a mean particle size of 0.5 mm, and dispersed for 5 hours as a basic period. Then, the slurry was added with 0.2 g of benzisothiazolinone sodium salt and water so that the concentration of the organic polyhalogenated compound should become 26 weight % to obtain dispersion of Organic polyhalogenated compound 1.

The organic polyhalogenated compound particles contained in the organic polyhalogenated compound dispersion obtained as described above had a median particle size of 0.41 μm and the maximum particle size of 2.0 μm or less. The obtained organic polyhalogenated compound dispersion was filtered through a polypropylene filter having a pore size of 10.0 μm to remove contaminant such as dusts and stored.

(Preparation of Dispersion of Organic Polyhalogenated Compound 2)

In an amount of 10 kg of Organic polyhalogenated compound 2, 20 kg of 10 weight % aqueous solution of denatured polyvinyl alcohol MP203 and 0.4 kg of 20 weight % aqueous solution of sodium triisopropylnaphthalenesulfonate were mixed sufficiently to form slurry.

The slurry was fed by a diaphragm pump to a sand mill of horizontal type, UVM-2, containing zirconia beads having a mean particle size of 0.5 mm, and dispersed for 5 hours. Then, the slurry was added with 0.2 g of benzisothiazolinone sodium salt and water so that the concentration of the organic polyhalogenated compound should become 30 weight %. This dispersion was warmed to 40° C. for 5 hours to obtain dispersion of Organic polyhalogenated compound 2.

The organic polyhalogenated compound particles contained in the organic polyhalogenated compound dispersion obtained as described above had a mean particle size of 0.40 μm as a median particle size and the maximum particle size of 1.3 μm or less. The obtained organic polyhalogenated compound dispersion was filtered through a polypropylene filter having a pore size of 3.0 μm to remove contaminant such as dusts and stored.

(Preparation of Solution of Phthalazine Compound 1)

In an amount of 8 kg of denatured polyvinyl alcohol MP-203 was dissolved in 174.57 kg of water and then added with 3.15 kg of 20 weight % aqueous solution of sodium triisopropylnaphthalenesulfonate and 14.28 kg of 70 weight % aqueous solution of Phthalazine compound 1 to obtain 5 weight % solution of Phthalazine compound 1.

(Preparation of Aqueous Solution of Mercapto Compound 1)

In an amount of 7 g of Mercapto compound 1 was dissolved in 993 g of water to obtain 0.7 weight % aqueous solution.

(Preparation of Aqueous Solution of Mercapto Compound 2)

In an amount of 20 g of Mercapto compound 2 was dissolved in 980 g of water to obtain 2.0 weight % aqueous solution.

(Preparation of Aqueous Solutions of Compounds of Types (i) to (iv))

In an amount of 2 g of each of compounds of Types (i) to (iv) was dissolved in 98 g of methanol to obtain 2 weight % aqueous solution.

(Preparation of Dispersion of Pigment 1)

In an amount of 64 g of C.I. Pigment Blue 60 and 6.4 g of Demor N was added with 250 g of water and mixed sufficiently to form slurry. Then, 800 g of zirconia beads having a mean particle size of 0.5 mm were placed in a vessel together with the slurry, and the slurry was dispersed by using ¼ G Sand Grinder Mill (Imex) for 25 hours and diluted with water so that the pigment concentration should become 5 weight % to obtain dispersion of Pigment 1. The pigment particles contained in the obtained dispersion had a mean particle size of 0.21 μm.

(Preparation of SBR Latex Solution)

SBR latex having Tg of 22° C. was prepared as follows. By using ammonium persulfate as a polymerization initiator and an anionic surfactant as an emulsifier, 70.0 weight % of styrene, 27.0 weight % of butadiene and 3.0 weight % of acrylic acid were emulsion-polymerized and aged at 80° C. for 8 hours. Then, the reaction mixture was cooled to 40° C., adjusted to pH 7.0 with aqueous ammonia and added with Sandet BL (manufactured by SANYO CHEMICAL INDUSTRIES, LTD.) to a concentration of 0.22 weight %. Further, the mixture was adjusted to pH 8.3 with addition of 5% sodium hydroxide and further adjusted to pH 8.4 with aqueous ammonia.

The ratio of $Na^+$ ions and $NH_4^+$ ions used in this case was 1:2.3 (molar ratio). Further, this mixture was added with 0.15 mL of 7% aqueous solution of benzoisothiazolinone sodium salt per 1 kg of the mixture to prepare SBR latex solution.

The obtained SBR latex [latex of -St(70.0)-Bu(27.0)-AA (3.0)-] had the following characteristics: Tg: 22° C., mean particle size: 0.1 μm, concentration: 43 weight %, equilibrated moisture content: 0.6 weight % at 25° C. and relative humidity of 60%, ion conductivity: 4.2 mS/cm (measured for the latex stock solution (43 weight %) at 25° C. by using a conductometer, CM-30S, manufactured by Toa Electronics, Ltd.), pH 8.4.

SBR latex having a different Tg can be prepared in the same manner by changing ratios of styrene and butadiene.

(Preparation of Coating Solution 1 for Emulsion Layer)

In an amount of 1000 g of Aliphatic acid silver salt dispersion A, 276 mL of water, 33.2 g of the dispersion of Pigment 1, 21 g of the dispersion of Organic polyhalogenated compound 1, 58 g of the dispersion of Organic polyhalogenated compound 2, 173 g of the solution of Phthalazine compound 1, 1082 g of the SBR latex solution (Tg: 22° C.), 299 g of the dispersion of Reducing agent complex 1, 6 g of the dispersion of Development accelerator 1, 9 mL of the aqueous solution of Mercapto compound 1 and 27 mL of the aqueous solution of Mercapto compound 2, which were obtained above, were successively added, and 117 g of Mixed emulsion A of silver halide was added and mixed sufficiently immediately before coating to prepare a coating solution for emulsion layer, which was fed as it was to a coating die and coated.

The viscosity of the coating solution for emulsion layer was measured by a B-type viscometer manufactured by Tokyo Keiki K.K. and found to be 25 [mPa·s] at 40° C. (Rotor No. 1, 60 rpm).

Viscosity of the coating solution measured at 25° C. by an RFS fluid spectrometer produced by Rheometric Far East Co., Ltd. was 230, 60, 46, 24 and 18 [mPa·s] at shear rates of 0.1, 1, 10, 100 and 1000 [1/second], respectively.

The zirconium content in the coating solution was 0.38 mg per 1 g of silver.

(Preparation of Coating Solution 2 for Emulsion Layer)

In an amount of 1000 g of Aliphatic acid silver salt dispersion B obtained above, 276 mL of water, 32.8 g of the dispersion of Pigment 1, 21 g of the dispersion of Organic polyhalogenated compound 1, 58 g of the dispersion of Organic polyhalogenated compound 2, 173 g of the solution of Phthalazine compound 1, 1082 g of the SBR latex solution (Tg: 22° C.), 155 g of the dispersion of Reducing agent 2, 55 g of the dispersion of Hydrogen bond-forming compound 1, 6 g of the dispersion of Development accelerator 1, 2 g of the dispersion of Development accelerator 2, 3 g of the dispersion of Development accelerator 3, 2 g of the dispersion of Toning agent 1 and 6 mL of the aqueous solution of Mercapto compound 2, which were obtained above, were successively added, and 117 g of Mixed emulsion A of silver halide was added and mixed sufficiently immediately before coating to prepare a coating solution for emulsion layer, which was fed as it was to a coating die and coated.

The viscosity of the coating solution for emulsion layer was measured by a B-type viscometer manufactured by Tokyo Keiki K.K. and found to be 40 [mPa·s] at 40° C. (Rotor No. 1, 60 rpm).

Viscosity of the coating solution measured at 25° C. by an RFS fluid spectrometer produced by Rheometric Far East Co., Ltd. was 530, 144, 96, 51 and 28 [mPa·s] at shear rates of 0.1, 1, 10, 100 and 1000 [1/second], respectively.

The zirconium content in the coating solution was 0.25 mg per 1 g of silver.

(Preparation of Coating Solution for Intermediate Layer)

In an amount of 1000 g of polyvinyl alcohol, PVA-205 (Kuraray Co., Ltd.), 272 g of 5 weight % dispersion of pigment and 4200 mL of 19 weight % solution of methyl methacrylate/styrene/butyl acrylate/hydroxyethyl methacrylate/acrylic acid copolymer (copolymerization ratio (by weight): 64/9/20/5/2) latex were added with 27 mL of 5 weight % aqueous solution of Aerosol OT (American Cyanamid), 135 mL of 20 weight % aqueous solution of phthalic acid diammonium salt and water in such an amount giving a total amount of 10000 g and adjusted to pH 7.5 with NaOH to form a coating solution for intermediate layer. This coating solution was fed to a coating die in such an amount that gave a coating amount of 9.1 mL/m$^2$.

The viscosity of the coating solution measured by a B-type viscometer at 40° C. (Rotor No. 1, 60 rpm) was 58 [mPa·s].

(Preparation of Coating Solution for 1st Surface Protective Layer)

In an amount of 64 g of inert gelatin was dissolved in water, and added with 80 g of 27.5 weight % latex solution of methyl methacrylate/styrene/butyl acrylate/hydroxyethyl methacrylate/acrylic acid copolymer (copolymerization ratio (by weight): 64/9/20/5/2), 23 mL of 10 weight % methanol solution of phthalic acid, 23 mL of 10 weight % aqueous solution of 4-methylphthalic acid, 28 mL of 0.5 mol/L sulfuric acid, 5 mL of 5 weight % aqueous solution of Aerosol OT, 0.5 g of phenoxyethanol, 0.1 g of benzoisothiazolinone and water in such an amount that gave a total amount of 750 g to form a coating solution. The coating solution was mixed with 26 mL of 4 weight % chromium alum by a static mixer immediately before coating, and fed to a coating die in such an amount that gave a coating amount of 18.6 mL/m$^2$.

The viscosity of the coating solution measured by a B-type viscometer (Rotor No. 1, 60 rpm) at 40° C. was 20 [mPa·s].

(Preparation of Coating Solution for 2nd Surface Protective Layer)

In an amount of 80 g of inert gelatin was dissolved in water, added with 102 g of 27.5 weight % latex solution of methyl methacrylate/styrene/butyl acrylate/hydroxyethyl methacrylate/acrylic acid copolymer (copolymerization ratio (by weight): 64/9/20/5/2), 3.2 mL of 5 weight % solution of Fluorine-containing surfactant F-1, 32 mL of 2 weight % aqueous solution of Fluorine-containing surfactant F-2, 23 mL of 5 weight % aqueous solution of Aerosol OT, 4 g of polymethyl methacrylate microparticles (mean particle size: 0.7 μm), 21 g of polymethyl methacrylate microparticles (mean particle size: 4.5 μm), 1.6 g of 4-methylphthalic acid, 4.8 g of phthalic acid, 44 mL of 0.5 mol/L sulfuric acid, 10 mg of benzoisothiazolinone and water in such an amount that gave a total amount of 650 g, and further mixed with 445 mL of an aqueous solution containing 4 weight % of chromium alum and 0.67 weight % of phthalic acid by a static mixer immediately before coating to form a coating solution for surface protective layer, which was fed to a coating die in such an amount that gave a coating amount of 8.3 mL/m$^2$.

Viscosity of the coating solution measured by a B-type viscometer (Rotor No. 1, 60 rpm) at 40° C. was 19 [mPa·s].

(Preparation of Photothermographic Materials (1') to (14'))

On the undercoated surface on the side opposite to the back surface side of the support, an image-forming layer, intermediate layer, first surface protective layer and second surface protective layer were simultaneously coated in this order as stacked layers by the slide bead coating method to prepare a sample of photothermographic material. In the preparation, temperature of coating solution was adjusted to 31° C. for the image-forming layer and the intermediate layer, 36° C. for the first protective layer and 37° C. for the second protective layer. Each of compounds of Types (i) to (iv) was added to the image-forming layer. Types and amounts thereof are shown in Table 3.

The coating amounts (g/m$^2$) of the compounds in the emulsion layer were as follows.

| | |
|---|---|
| Aliphatic acid silver salt dispersion A | 5.55 (as amount of aliphatic acid silver salt) |
| Pigment 1 (C. I. Pigment Blue 60) | 0.036 |
| Organic polyhalogenated compound 1 | 0.12 |
| Organic polyhalogenated compound 2 | 0.37 |
| Phthalazine compound 1 | 0.19 |
| SBR Latex | 9.97 |
| Reducing agent complex 1 | 1.41 |
| Development accelerator 1 | 0.024 |
| Compound of Type (i), (ii), (iii) or (iv) | Amount mentioned in Table 3 |

-continued

| | |
|---|---|
| Mercapto compound 1 | 0.002 |
| Mercapto compound 2 | 0.012 |
| Silver halide (as Ag) | 0.091 |

The conditions for coating and drying were as follows.

The coating was performed at a speed of 160 m/min, the clearance between the end of the coating die and the support was set to be 0.10–0.30 mm, and pressure of the decompression chamber was set to be lower than the atmospheric pressure by 196–882 Pa. The support was destaticized with an ionic wind before the coating.

The coating solutions were cooled with a wind at a dry bulb temperatures of 10–20° C. in a subsequent chilling zone, then transported without contact, and dried with a dry wind at a dry bulb temperatures of 23–45° C. and a wet bulb temperature of 15–21° C. in a coiled type drying apparatus of non-contact type.

After the drying, the coated support was conditioned for moisture content at 25° C. and relative humidity of 40–60% and heated so that the film surface temperature should become 70–90° C. After the heating, the film surface was cooled to 25° C.

Matting degree of the produced photothermographic materials was 550 seconds for each image-forming layer side and 130 seconds for each back surface as Beck's smoothness. Further, pH of film surface was measured and found to be 6.0 for each image-forming layer side.

(Preparation of Photothermographic Materials (15') to (28'))

Photothermographic materials (15') to (28') were prepared in the same manner as the preparation of Photothermographic material (1') except that Coating solution 1 for image-forming layer was changed to Coating solution 2 for image-forming layer, Yellow dye compound 1 was excluded from the antihalation layer, Fluorine-containing surfactants F-1, F-2, F-3 and F-4 in the back surface protective layer were changed to F-5, F-6, F-7 and F-8, respectively, and Fluorine-containing surfactant F-1 and F-2 in the surface protective layer for image-forming layer side were changed to F-5 and F-6.

The coating amounts (g/m$^2$) of the compounds in the emulsion layer were as follows.

| | |
|---|---|
| Aliphatic acid silver salt dispersion B | 5.55 (as amount of aliphatic acid silver salt) |
| Pigment (C. I. Pigment Blue 60) | 0.036 |
| Organic polyhalogenated compound 1 | 0.12 |
| Organic polyhalogenated compound 2 | 0.37 |
| Phthalazine compound 1 | 0.19 |
| SBR Latex | 9.67 |
| Reducing agent 2 | 0.81 |
| Hydrogen bond-forming compound 1 | 0.30 |
| Development accelerator 1 | 0.024 |
| Development accelerator 2 | 0.010 |
| Development accelerator 3 | 0.015 |
| Toning agent | 0.010 |
| Compound of Type (i), (ii), (iii) or (iv) | Amount mentioned in Table 3 |
| Mercapto compound 2 | 0.002 |
| Silver halide (as Ag) | 0.091 |

<<Evaluation of Photographic Performance>>

A packaging material consisting of PET (10 μm)/PE (12 μm)/aluminum foil (9 μm)/Ny (15 μm)/polyethylene containing 3% of carbon (50 μm) was prepared. This packaging material had an oxygen permeability of 0.02 mL/atm·m$^2$·25° C.·day and a moisture permeability of 0.10 g/atm·m$^2$·25° C.·day. Each of the photosensitive materials obtained above was cut into the half size, packaged with the packaging material in an environment at a temperature of 25° C. and a relative humidity of 50%, and stored at an ordinary temperature for 2 weeks.

The photosensitive material was taken out from the package, exposed and heat-developed by using Fuji Medical Dry Laser Imager FM-DP L (provided with a semiconductor laser of maximum output of 60 mW (IIIB) at 660 nm). The heating was performed with four panel heaters set at 112° C., 119° C., 121° C. and 121° C., respectively, for 24 seconds in total for Photothermographic materials (1') to (14') or 14 seconds in total for Photothermographic materials (15') to (28').

Density of the obtained image was measured by using a densitometer, and a characteristic curve of density versus logarithm of exposure was prepared. The γ value, which represents gradation, was represented by an inclination of a straight line connecting points corresponding to Dmin+density 0.25 and Dmin+density 2.0 on the characteristic curve. That is, γ is given by an equation: γ=(2.0–0.25)/(log (Exposure giving density of 2.0)–log (Exposure giving density of 0.25)), and a larger γ value means photographic characteristic of higher contrast. Further, numbers of developed silver grains in contact with the silver halide was also measured according to the definition mentioned above. As for sensitivity, optical density of un-exposed area is considered fog, and sensitivity was represented by reciprocal of exposure giving an optical density higher than the fog by 1.0 as an relative value based on the sensitivity of Photothermographic material (1'), which was taken as 100. A larger value means higher sensitivity.

The results are shown in Table 3 and 4. Although γ values are not shown in the tables, all the values were within the range of 2.5–3.5. Although the numbers of developed silver grains are not shown in the tables too, all the values were not less than 90%.

As demonstrated by the results shown in Tables 3 and 4, the photothermographic materials containing the compounds of Types (i) to (iv) according to the present invention showed little increase of fog and could provide extremely high sensitivity while maintaining favorable gradation and quality of developed silver.

TABLE 3

| Sample | Compound of Type (i), (ii), (iii) or (iv) | | Relative | | |
|---|---|---|---|---|---|
| No. | Type | Amount | sensitivity | Fog | Note |
| 1' | Not contained | — | 100 | 0.17 | Comparative |
| 2' | 3 | $1 \times 10^{-3}$ | 315 | 0.17 | Invention |
| 3' | 8 | $1 \times 10^{-3}$ | 295 | 0.17 | |
| 4' | 9 | $1 \times 10^{-3}$ | 325 | 0.16 | |
| 5' | 10 | $1 \times 10^{-3}$ | 315 | 0.17 | |
| 6' | 11 | $1 \times 10^{-3}$ | 295 | 0.16 | |
| 7' | 12 | $1 \times 10^{-3}$ | 325 | 0.17 | |
| 8' | 13 | $1 \times 10^{-3}$ | 305 | 0.16 | |
| 9' | 24 | $1 \times 10^{-3}$ | 310 | 0.17 | |
| 10' | 34 | $1 \times 10^{-3}$ | 330 | 0.17 | |
| 11' | 41 | $1 \times 10^{-3}$ | 300 | 0.16 | |
| 12' | 46 | $1 \times 10^{-3}$ | 315 | 0.17 | |
| 13' | 56 | $1 \times 10^{-3}$ | 325 | 0.17 | |
| 14' | 59 | $1 \times 10^{-3}$ | 305 | 0.16 | |

Amonts of compounds of Types (i) to (iv) are represented interms of "mol/mol of silver halide".

TABLE 4

| Sample No. | Compound of Type (i), (ii), (iii) or (iv) Type | Amount | Relative sensitivity | Fog | Note |
|---|---|---|---|---|---|
| 15' | Not contained | — | 95 | 0.16 | Comparative |
| 16' | 3 | $1 \times 10^{-3}$ | 305 | 0.16 | Invention |
| 17' | 8 | $1 \times 10^{-3}$ | 280 | 0.15 | |
| 18' | 9 | $1 \times 10^{-3}$ | 305 | 0.16 | |
| 19' | 10 | $1 \times 10^{-3}$ | 300 | 0.16 | |
| 20' | 11 | $1 \times 10^{-3}$ | 275 | 0.15 | |
| 21' | 12 | $1 \times 10^{-3}$ | 305 | 0.16 | |
| 22' | 13 | $1 \times 10^{-3}$ | 290 | 0.15 | |
| 23' | 24 | $1 \times 10^{-3}$ | 295 | 0.16 | |
| 24' | 34 | $1 \times 10^{-3}$ | 315 | 0.16 | |
| 25' | 41 | $1 \times 10^{-3}$ | 285 | 0.15 | |
| 26' | 46 | $1 \times 10^{-3}$ | 310 | 0.16 | |
| 27' | 56 | $1 \times 10^{-3}$ | 305 | 0.16 | |
| 28' | 59 | $1 \times 10^{-3}$ | 290 | 0.15 | |

Amonts of compounds of Types (i) to (iv) are represented interms of "mol/mol of silver halide".

Dye BB

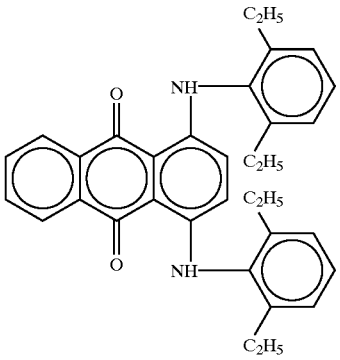

Spectral sensitization dye A

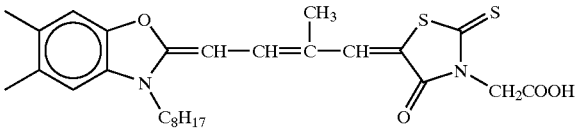

Spectral sensitization dye B

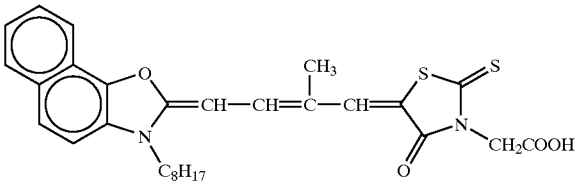

Tellurium sensitizer C

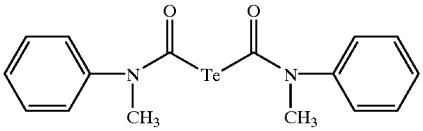

Base precursor compound 1

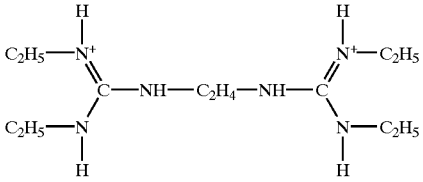

-continued

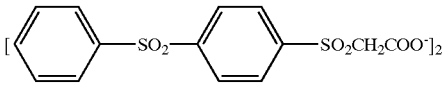

Cyanine dye compound 1

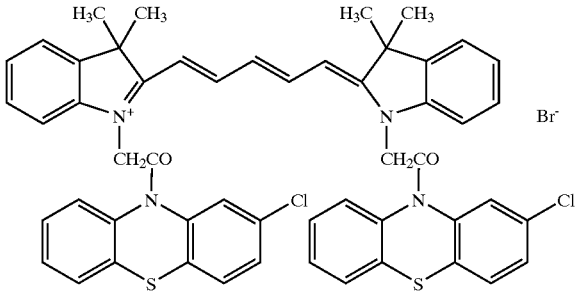

Blue color dye compound 1

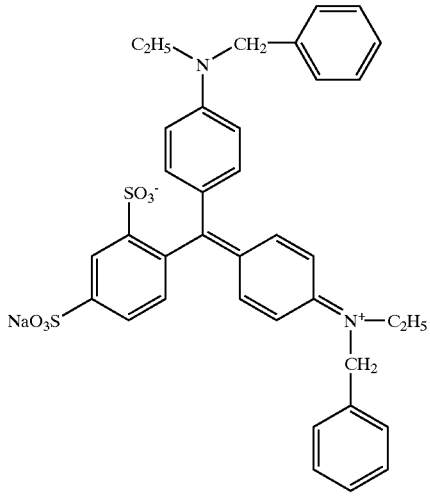

Yellow color dye compound 1

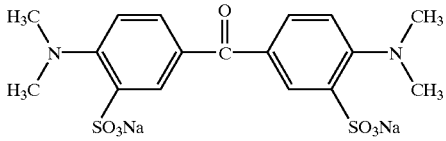

Reducing agent complex 1 (1:1 Complex of the following compounds)

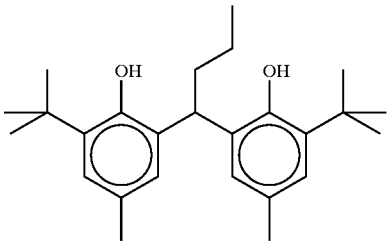

and

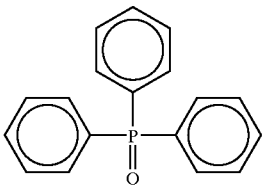

-continued
Reducing agent 2
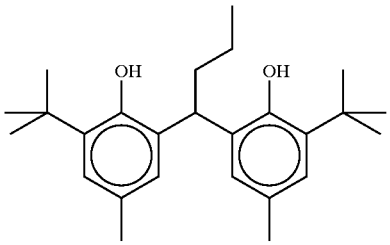
Hydrogen bond-forming compound 1
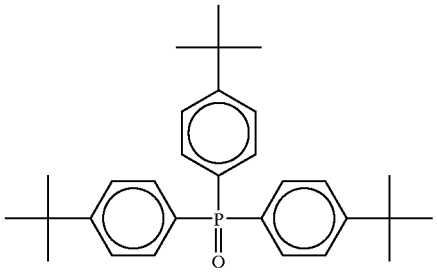
Polyhalogenated compound 1
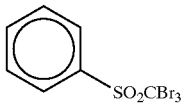
Polyhaolgenated compound 2
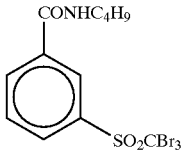
Mercapto compoud 1
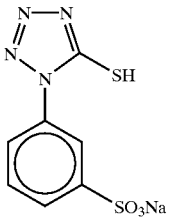
Mercapto compound 2
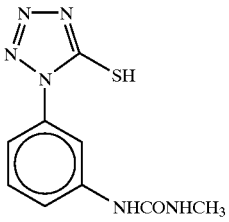
Phthalazine compound 1
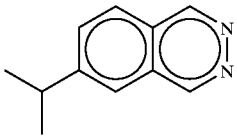
-continued
Development accelerator 1
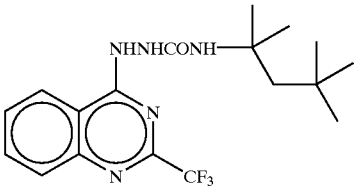
Development accelerator 2
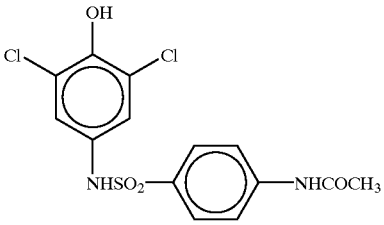
Development accelerator 3
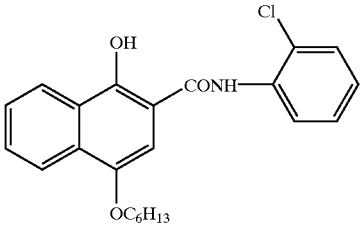
Toning agent 1
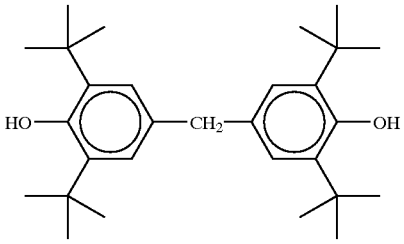
(F-1)
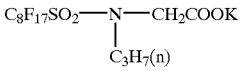
(F-2)
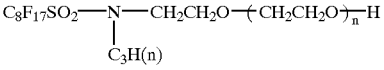
n = 15 (av.)
(F-3)
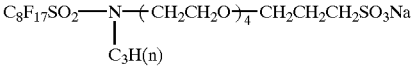
(F-4)
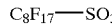
(F-5)
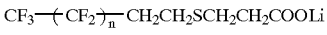
n = mix of 5 to 11
(F-6)
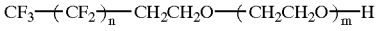
n = mix. of 5 to 11
m = mix. of 5 to 15
(F-7)
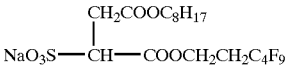

-continued (F-8)

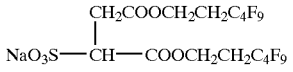

As explained above, the photothermographic material of the present invention shows low fog, high Dmax (maximum density) and high sensitivity. Therefore, it can realize quicker development, and in addition, it can furan image of good storability and surface condition. The photothermographic material of the present invention is extremely useful for photomechanical processes (especially for scanners and image setters) and medical use.

What is claimed is:

1. A photothermographic material containing a silver salt of an organic acid, a photosensitive silver halide, a reducing agent and a binder on a support, which contains at least one compound selected from compounds of the following Types (i) to (iv):

Type (i)

a compound of which one-electron oxidized derivative produced by one electron oxidation of the compound is capable of releasing two or more electrons with a bond cleavage;

Type (ii)

a compound of which one-electron oxidized derivative produced by one electron oxidation of the compound is capable of releasing one more electron with a bond cleavage and which has two or more groups adsorptive to silver halide in the molecule;

Type (iii)

a compound of which one-electron oxidized derivative produced by one electron oxidation of the compound is capable of releasing one or more electrons after undergoing a bond formation process;

Type (iv)

a compound of which one-electron oxidized derivative produced by one electron oxidation of the compound is capable of releasing one or more electrons after undergoing an intramolecular ring cleavage reaction.

2. The photothermographic material according to claim 1, wherein the compounds of Type (i)–Type (iv) are compounds represented by formulas (1-1) to (1-5), (2-1), (3-1), (4-1) and (4-2):

Formula (1-1)

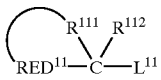

wherein, in the formula (1-1), $RED^{11}$ represents a reducing group that can be one electron-oxidized, $L^{11}$ represents a leaving group, $R^{112}$ represents a hydrogen atom or a substituent, and $R^{111}$ represents a nonmetallic group that can form a tetrahydro, hexahydro or octahydro derivative of a 5- or 6-membered aromatic ring (including an aromatic heterocyclic ring) together with the carbon atom to which $R^{111}$ bonds and $RED^{11}$;

Formula (1-2)

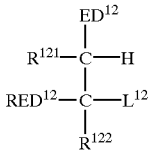

wherein, in the formula (1-2), $RED^{12}$ represents a reducing group that can be one electron-oxidized, $L^{12}$ represents a leaving group, $R^{121}$ and $R^{122}$ each independently represent a hydrogen atom or a substituent, $ED^{12}$ represents an electron donor group, and in the formula (1-2), $R1^{21}$ and $RED^{12}$, $R^{121}$ and $R^{122}$ or $ED^{12}$ and $RED^{12}$ may bond to each other to form a ring structure;

Formula (1-3)

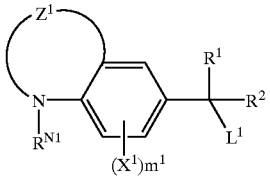

wherein, in the formula (1-3), $Z^1$ represents an atomic group that can form a 6-membered ring together with the nitrogen atom to which $Z^1$ bonds and two of the carbon atoms of the benzene ring, $R^1$, $R^2$ and $R^{N1}$ each independently represent a hydrogen atom or a substituent, $X^1$ represents a substituent that can substitute on the benzene ring, $m^1$ represents an integer of 0–3, $L^1$ represents a leaving group, and a compound of the formula (1-3) can, after it is one electron-oxidized, further release two or more electrons due to spontaneous cleavage of the C (carbon atom)-$L^1$ bond;

Formula (1-4)

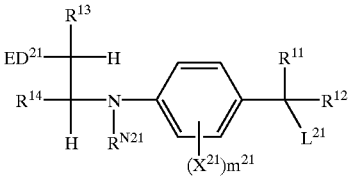

wherein, in the formula (1-4), $ED^{21}$ represents an electron donor group, $R^{11}$, $R^{12}$, $RN^{21}$, $R^{13}$ and $R^{14}$ each independently represents a hydrogen atom or a substituent, $X^{21}$ represents a substituent that can substitute on the benzene ring, $m^{21}$ represents an integer of 0–3, $L^{21}$ represents a leaving group, $RN^{21}$, $R^{13}$, $R^{14}$, $X^{21}$ and $ED^{21}$ may bond to each other to form a ring structure, and a compound of the formula (1-4) can, after it is one electron-oxidized, further release two or more electrons due to spontaneous cleavage of the C (carbon atom)-$L^{21}$ bond;

Formula (1-5)

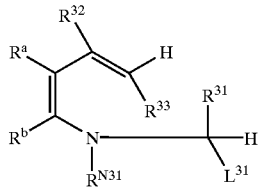

wherein, in the formula (1-5), $R^{32}$, $R^{33}$, $R^{31}$, $R^{N31}$, $R^{a}$ and $R^{b}$ each independently represents a hydrogen atom or a substituent, $L^{31}$ represents a leaving group, provided that when $R^{N31}$ represents a group other than aryl group, $R^{a}$ and $R^{b}$ bond to each other to form an aromatic ring, and a compound of the formula (1-5) can, after it is one electron-oxidized, further release two or more electrons due to spontaneous cleavage of the C (carbon atom)-$L^{31}$ bond;

Formula (2-1)

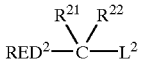

wherein, in the formula (2-1), $RED^{2}$ represents a reducing group that can be one electron-oxidized, and $L^{2}$ represents a leaving group, when $L^{2}$ represents a silyl group, the compound has two or more of nitrogen-containing heterocyclic groups substituted with a mercapto group as absorptive groups, $R^{21}$ and $R^{22}$ each independently represent a hydrogen atom or a substituent, $RED^{2}$ and $R^{21}$ may bond to each other to form a ring structure, and a compound of the formula (2-1) is a compound that can, after the reducing group represented by $RED^{2}$ is one electron-oxidized, further release one more electron due to spontaneous cleavage of the C (carbon atom)-$L^{2}$ bond;

$RED^{3}$—$L^{3}$—$Y^{3}$ Formula (3-1)

wherein, in the formula (3-1), $RED^{3}$ represents a reducing group that can be one electron-oxidized, $Y^{3}$ represents a reactive group moiety that reacts after $RED^{3}$ is one electron-oxidized, and $L^{3}$ represents a bridging group bonding $RED^{3}$ and $Y^{3}$;

Formula (4-1)

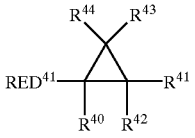

Formula (4-2)

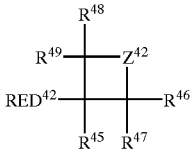

wherein, in the formulas (4-1) and (4-2), $RED^{41}$ and $RED^{42}$ each independently represent a reducing group that can be one electron-oxidized, $R^{40}$ to $R^{44}$ and $R^{45}$ to $R^{49}$ each independently represent a hydrogen atom or a substituent, in the formula (4-2), $Z^{42}$ represents —$CR^{420}R^{421}$—, —$NR^{423}$— or —O—, where $R^{420}$ and $R^{421}$ each independently represent a hydrogen atom or a substituent, and $R^{423}$ represents a hydrogen atom, an alkyl group, an aryl group or a heterocyclic group.

3. The photothermographic material according to claim 2, which contains a compound represented by the formula (1-1).

4. The photothermographic material according to claim 2, which contains a compound represented by the formula (1-2).

5. The photothermographic material according to claim 2, which contains a compound represented by the formula (1-3).

6. The photothermographic material according to claim 2, which contains a compound represented by the formula (1-4).

7. The photothermographic material according to claim 2, which contains a compound represented by the formula (1-5).

8. The photothermographic material according to claim 2, which contains a compound represented by the formula (2-1).

9. The photothermographic material according to claim 2, which contains a compound represented by the formula (3-1).

10. The photothermographic material according to claim 2, which contains a compound represented by the formula (4-1).

11. The photothermographic material according to claim 2, which contains a compound represented by the formula (4-2).

12. The photothermographic material according to claim 2, wherein the compound of formula (1-1) is represented by formula (1-1-1):

Formula (1-1-1)

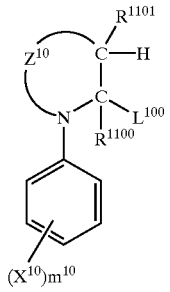

wherein, in the formula (1-1-1), $L^{100}$ represents a leaving group, $R^{1100}$ and $R^{1101}$ each independently represent a hydrogen atom or a substituent, $X^{10}$ represents a substituent that can substitute on the benzene ring, $m^{10}$ represents an integer of 0–3, and $Z^{10}$ represents a nonmetallic group that can form a tetrahydro or hexahydro derivative of a 5- or 6-membered nitrogen-containing aromatic heterocyclic ring together with the nitrogen atom and the two carbon atoms forming the ring with $Z^{10}$.

13. The photothermographic material according to claim 2, wherein the compound of formula (1-1) is represented by formula (1-1-2):

Formula (1-1-2)

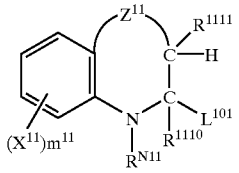

wherein, in the formula (1-1-2), L represents a leaving group, $R^{1110}$ and $R^{1111}$ each independently represent a hydrogen atom or a substituent, $X^{11}$ represents a substituent that can substitute on the benzene ring, $m^{11}$ represents an integer of 0–3, $R^{N11}$ represents a hydrogen atom or a substituent that can substitute on the nitrogen atom, and $Z^{11}$ represents a nonmetallic group that can form a tetrahydro or hexahydro derivative of a 5-or 6-membered nitrogen-containing aromatic heterocyclic ring together with the nitrogen atom and the four carbon atoms forming the ring with $Z^{11}$.

14. The photothermographic material according to claim 2, wherein the compound of formula (1-1) is represented by formula (1-1-3):

Formula (1-1-3)

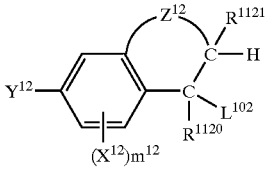

wherein, in the formula (1-1-3), $L^{102}$ represents a leaving group, $R^{1120}$ and $R^{1121}$ each independently represent a hydrogen atom or a substituent, $X^{12}$ represents a substituent that can substitute on the benzene ring, $m^{12}$ represents an integer of 0–3, $Y^{12}$ represents an amino group, an alkylamino group, an arylamino group, a non-aromatic nitrogen-containing heterocyclic group that substitutes at a nitrogen atom, a hydroxy group or an alkoxy group, and $Z^{12}$ represents a nonmetallic group that can form a tetrahydro or hexahydro derivative of a 5- or 6-membered nitrogen-containing aromatic heterocyclic ring together with the three carbon atoms forming the ring with $Z^{12}$.

15. The photothermographic material according to claim 2, wherein the compound of formula (1-2) is represented by formula (1-2-1):

Formula (1-2-1)

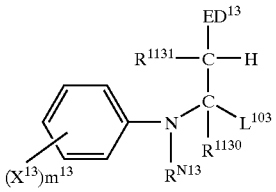

wherein, in the formula (1-2-1), $L^{103}$ represents a leaving group, $R^{1130}$ and $R^{1131}$ each independently represent a hydrogen atom or a substituent, $ED^{13}$ represents an electron donor group, $X^{13}$ represents a substituent that can substitute on the benzene ring, $m^{13}$ represents an integer of 0–3, and $R^{N13}$ represents a hydrogen atom or a substituent that can substitute on the nitrogen atom.

16. The photothermographic material according to claim 2, wherein the compound of formula (1-2) is represented by formula (1-2-2):

Formula (1-2-2)

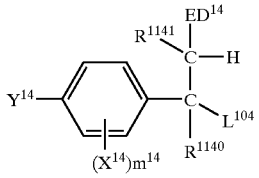

wherein, in the formula (1-2-2), $L^{104}$ represents a leaving group, $R^{1140}$ and $R^{1141}$ each independently represent a hydrogen atom or a substituent, $ED^{14}$ represents an electron donor group, represents a substituent that can substitute on the benzene ring, $m^{14}$ represents an integer of 0–3, and $Y^{14}$ represents an amino group, an alkylamino group, an arylamino group, a non-aromatic nitrogen-containing heterocyclic group that substitutes at a nitrogen atom, a hydroxy group or an alkoxy group.

17. The photothermographic material according to claim 2, wherein the compound of formula (3-1) is represented by formula (3-1-1):

Formula (3-1-1)

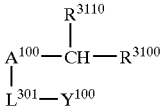

wherein, in the formula (3-1-1), $A^{100}$ represents an arylene group or a divalent heterocyclic group, $L^{301}$ represents a bridging group linking $A^{100}$ and $Y^{100}$, $R^{3100}$ and $R^{3110}$ each independently represent a hydrogen atom or a substituent, and $Y^{100}$ represents a reactive group that reacts after the compound is one electron-oxidized.

18. The photothermographic material according to claim 2, wherein the compound of formula (3-1) is represented by formula (3-1-2):

Formula (3-1-2)

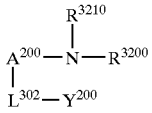

wherein, in the formula (3-1-2), $A^{200}$ represents an arylene group or a divalent heterocyclic group, $L^{302}$ represents a bridging group linking $A^{200}$ and $Y^{200}$, $R^{3200}$ and $R^{3210}$ each independently represent a hydrogen atom or a substituent, and $Y^{200}$ represents a reactive group that reacts after the compound is one electron-oxidized.

19. The photothermographic material according to claim 2, wherein the compound of formula (3-1) is represented by formula (3-1-3):

Formula (3-1-3)

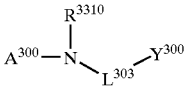

wherein, in the formula (3-1-3), $A^{300}$ represents an aryl group or a heterocyclic group, $L^{303}$ represents a bridging group linking the nitrogen atom and $Y^{300}$, $R^{3310}$ represents a hydrogen atom or a substituent, and $Y^{300}$ represents a reactive group that reacts after the compound is one electron-oxidized.

20. The photothermographic material according to claim 2, wherein the compound of formula (3-1) is represented by formula (3-1-4):

Formula (3-1-4)

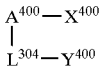

wherein, in the formula (3-1-4), $A^{400}$ represents an arylene group or a divalent heterocyclic group, $L^{304}$ represents a bridging group linking $A^{400}$ and $Y^{400}$, $X^{400}$ represents a hydroxy group, a mercapto group or an alkylthio group, and $Y^{400}$ represents a reactive group that reacts after the compound is one electron-oxidized.

21. The photothermographic material according to claim 1, wherein, when the photothermographic material is subjected to light exposure and heat development at 121° C. for 24 seconds, 90% of developed silver grains in terms of grain number are in contact with the silver halide.

22. The photothermographic material according to claim 1, wherein an inclination of a straight line connecting points corresponding to Dmin+density 0.25 and Dmin+density 2.0 on a characteristic curve of the photothermographic material is within the range of 2.0–5.0.

23. The photothermographic material according to claim 1, wherein an inclination of a straight line connecting points corresponding to Dmin+density 0.25 and Dmin+density 2.0 on a characteristic curve of the photothermographic material is within the range of 2.5–3.5.

24. The photothermographic material according to claim 1, which contains a high contrast agent.

* * * * *